US007153816B2

(12) United States Patent
Kessler et al.

(10) Patent No.: US 7,153,816 B2
(45) **Date of Patent: *Dec. 26, 2006**

(54) DISHWASHER DETERGENT WITH IMPROVED PROTECTION AGAINST GLASS CORROSION

(75) Inventors: Arnd Kessler, Leverkusen (DE); Rainer Sorg, Kempen (DE); Melanie Baumann, Duisburg (DE); Wolfgang Wick, Dormgen (DE)

(73) Assignee: Henkel Kommanditgesellschaft auf Aktien (Henkel KGaA), Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/780,102

(22) Filed: Feb. 17, 2004

(65) Prior Publication Data

US 2005/0075258 A1 Apr. 7, 2005

Related U.S. Application Data

(63) Continuation of application No. PCT/EP02/08864, filed on Aug. 8, 2002.

(30) Foreign Application Priority Data

Aug. 17, 2001 (DE) ..... 101 40 535
Oct. 30, 2001 (DE) ..... 101 53 555
Dec. 18, 2001 (DE) ..... 101 62 145

(51) Int. Cl.
*C11D 3/06* (2006.01)
*C11D 3/34* (2006.01)
*C11D 3/37* (2006.01)
*C11D 7/10* (2006.01)

(52) U.S. Cl. ..... 510/220; 510/223; 510/227; 510/229; 510/231; 510/531; 134/25.2; 134/25.3; 134/39; 134/42

(58) Field of Classification Search ..... 510/220, 510/223, 227, 224, 231, 531; 134/25.2, 25.3, 134/39, 42
See application file for complete search history.

(56) References Cited

U.S. PATENT DOCUMENTS

| | | | | |
|---|---|---|---|---|
| 3,677,820 A | | 7/1972 | Rutkowski | |
| 3,720,621 A | | 3/1973 | Smeets | |
| 4,752,409 A | * | 6/1988 | Drapier et al. | 510/222 |
| 5,082,578 A | | 1/1992 | Langer et al. | |
| 5,229,027 A | * | 7/1993 | Ahmed | 510/221 |
| 5,413,727 A | | 5/1995 | Drapier et al. | |
| 5,413,731 A | | 5/1995 | Adler et al. | |
| 5,691,292 A | | 11/1997 | Marshall et al. | |
| 6,114,292 A | | 9/2000 | Hoshiko et al. | |
| 6,153,913 A | | 11/2000 | Hsu et al. | |
| 6,207,780 B1 | | 3/2001 | Stockhausen et al. | |
| 6,462,006 B1 | | 10/2002 | Sorg et al. | |
| 6,622,736 B1 | | 9/2003 | Hahn | |
| 2004/0167048 A1 | | 8/2004 | Sunder et al. | |

FOREIGN PATENT DOCUMENTS

| | | | |
|---|---|---|---|
| CA | 2311173 | | 12/2000 |
| CA | 2 312 154 | | 1/2001 |
| DE | 20 29 598 | | 12/1970 |
| DE | 2 264 230 | | 7/1974 |
| DE | 37 29 381 A1 | | 3/1988 |
| DE | 37 43 739 A1 | | 7/1989 |
| DE | 44 17 919 | | 11/1995 |
| DE | 195 16 957 A1 | | 11/1996 |
| DE | 198 22 939 | | 11/1999 |
| DE | 199 26 378 A1 | | 12/2000 |
| DE | 200 19 913 U1 | | 5/2001 |
| EP | 0 070 587 A1 | | 1/1983 |
| EP | 0 383 482 A2 | | 2/1990 |
| EP | 383482 | * | 8/1990 |
| EP | 0 387 997 A2 | | 9/1990 |
| EP | 0 439 878 A1 | | 8/1991 |
| EP | 0 446 761 A1 | | 9/1991 |
| EP | 0 518 721 A1 | | 12/1992 |
| EP | 0 530 635 A2 | | 3/1993 |
| EP | 0 611 206 A2 | | 8/1994 |
| EP | 0 712 810 A2 | | 5/1996 |
| EP | 0 851 022 A2 | | 7/1998 |
| EP | 1 213 344 A2 | | 6/2002 |
| WO | WO 93/21299 A1 | | 10/1993 |
| WO | WO 96/12783 A1 | | 5/1996 |

(Continued)

OTHER PUBLICATIONS

"Wasserbestaendigkeit von Glasgrieß bei 98°C", DIN ISO 719, Normenausschuß Labor-geraete und Laboreinrichtungen, pp. 1-10, Dec. 1989.

(Continued)

*Primary Examiner*—Brian P. Mruk
(74) *Attorney, Agent, or Firm*—John S. Child, Jr.; Glenn E. J. Murphy

(57) ABSTRACT

A dishwasher detergent containing a builder and one or more magnesium and/or zinc salt(s) of at least one monomeric and/or polymeric organic acid, excluding zinc ricinoleate, zinc abietate, and zinc oxalate. A method of inhibiting glass corrosion by treatment with one or more salts of magnesium and/or zinc with organic acids, excluding formic acid, acetic acid, gluconic acid, and oxalic acid.

97 Claims, No Drawings

FOREIGN PATENT DOCUMENTS

| | | | |
|---|---|---|---|
| WO | WO 98/16613 | A1 | 4/1998 |
| WO | WO 99/57237 | A1 | 11/1999 |
| WO | WO 00/39259 | A1 | 7/2000 |
| WO | WO 00/56851 | A1 | 9/2000 |
| WO | WO 01/00781 | A1 | 1/2001 |
| WO | WO 01/72941 | A1 | 10/2001 |
| WO | WO 02/16205 | A1 | 2/2002 |
| WO | WO 02/20708 | A1 | 3/2002 |
| WO | WO 02/42408 | A2 | 5/2002 |
| WO | WO 02/074891 | A2 | 9/2002 |
| WO | WO 02/074892 | A1 | 9/2002 |
| WO | WO 03/006594 | A1 | 1/2003 |

OTHER PUBLICATIONS

CTFA International Cosmetic Ingredient Dictionary and Handbook, 7th Edition, The Cosmetic toiletry and Fragrance Association, Washington (1997).

Rompp Chemie Lexikon, Georg Thieme Veriag Stuttgart/New York, 9th Edition, p. 2507 (1990).

Rompp Chemie Lexikon, Georg Thieme Veriag Stuttgart/New York, 9th Edition, p. 3168 (1991).

* cited by examiner

DISHWASHER DETERGENT WITH IMPROVED PROTECTION AGAINST GLASS CORROSION

CROSS REFERENCE TO RELATED APPLICATIONS

This application is a continuation under 35 U.S.C. § 365(c) and 35 U.S.C. § 120 of international application PCT/EP/02/08864, filed on Aug. 8, 2002. This application also claims priority under 35 U.S.C. § 119 of DE 101 40 535.9, filed Aug. 17, 2001, DE 101 53 555.4, filed Oct. 30, 2001 and DE 101 62 145.0, filed Dec. 18, 2001, each of which is incorporated herein by reference in its entirety.

BACKGROUND OF THE INVENTION

The present invention is in the field of dishwasher detergents. In particular, the present invention relates to dishwasher detergents which comprise zinc salts.

With the continuing automation of very diverse washing and cleaning processes domestically and in industry, machine washing and cleaning compositions for textiles and dishes have become increasingly important in the past decades.

The so-called low-alkaline detergents required for machine dishwashing often comprise, as alkali carriers, mixtures of sodium disilicate and soda, builders such as citric acid, for example in combination with polycarboxylates, and preferably low-foam, nonionic surfactants. In addition, bleaches, bleach activators, silver protectants and corrosion protectants and, to enhance the detergency, enzymes may be present. In a typical dishwasher cycle, the dishes placed into baskets are cleaned as a result of intensive contact with the aqueous detergent solution at about 65° C. and pH values between 9 and 11 and are then rinsed clear.

An important criterion for assessing a dishwasher detergent is, as well as its detergency, the optical appearance of the dry dishes after washing. Any calcium carbonate deposits which arise on dishes or in the inside of the machine can, for example, adversely affect customer satisfaction and thus have a causal influence on the economic success of such a detergent. A further problem which has been in existence for a long time with machine dishwashing is the corrosion of glassware, which may usually manifest itself in the appearance of clouding, streaking or scratching, or else by iridescence of the glass surface. The observed effects are based essentially on two processes, the escape of alkali metal and alkaline earth metal ions from the glass combined with hydrolysis of the silicate network, and secondly deposition of silicatic compounds on the surface of the glass. To avoid such corrosion processes, the prior art gives a series of proposals, for example with regard to the use of various silicates.

For example, international patent application WO 96/12783 (Henkel KGaA) describes phosphate-free to low-phosphate dishwasher detergents with improved decoration protection and glass protection based on citrate-containing formulations which comprise crystalline layered silicates.

International patent application WO 99/57237 (Clariant, Henkel KGaA) provides phosphate-containing dishwasher detergents which comprise a pulverulent to granular additive which have, as essential constituents, a crystalline layered silicate of the general formula $NaMSi_xO_{2x+1}.yH_2O$, in which M is sodium or hydrogen, x is a number from 1.9 to 22 and y is a number from 0 to 33, and (co)polymeric polycarboxylic acid and, as well as having glass and decoration protective effects, also have excellent detergencies.

However, the use of zinc or zinc salts for preventing glass corrosion during machine dishwashing has also been described.

According to the teaching of the American patent specification U.S. Pat. No. 3,677,820 (Whirlpool), a zinc strip attached to the inside of the dishwasher prevents, for example, the corrosion of glass surfaces during the washing operation.

Finally, European patent application EP 0 383 482 (Procter & Gamble) describes dishwasher detergents comprising insoluble zinc salts which are characterized by improved glass corrosion protection. To achieve such an effect, the insoluble zinc salts must have a particle size below 1.7 millimeters.

International patent application WO 00/39259 (Reckitt Benckiser) discloses water-soluble glasses in accordance with DIN ISO 719, which comprise at least one glass corrosion-inhibiting active ingredient whose weight fraction in the glass is not more 85% by weight and which is released from this glass under the conditions of the wash and/or rinse cycle.

DESCRIPTION OF THE INVENTION

The object of the present invention was then to provide a dishwasher detergent which, even upon repeated use, does not corrosively change the surfaces of glassware, in particular does not cause clouding, smearing or scratches, nor iridescence of the glass surfaces. The aim was preferably to provide an additive for a dishwasher detergent which is suitable as a constituent of dishwasher detergents in any supply form, for example as a constituent of powder, tablet or liquid formulations, detergent mousses or donor products, without presupposing limitations of the formulations to these supply forms.

It has now been found that the above-mentioned objects are achieved by dishwasher detergents which comprise builders and optionally further constituents of cleaning compositions, and one or more magnesium and/or zinc salt(s) of at least one monomeric and/or polymeric organic acid with the exception of zinc ricinoleate, zinc abietate and zinc oxalate, where the magnesium and/or zinc salts of monomeric and/or polymeric organic acids from the group of unbranched saturated or unsaturated monocarboxylic acids, of branched saturated or unsaturated monocarboxylic acids, of saturated and unsaturated dicarboxylic acids, of aromatic mono-, di- and tricarboxylic acids, of sugar acids, of hydroxy acids, of oxo acids, of amino acids and/or of polymeric carboxylic acids are preferred, and it is further preferred that these dishwasher detergents comprise no magnesium or zinc salts of unbranched or branched, unsaturated or saturated, mono- or polyhydroxylated fatty acids having at least 8 carbon atoms and/or resin acids.

Although, with the exception of zinc ricinoleate, zinc abietate and zinc oxalate, it is possible according to the invention for all customary magnesium and/or zinc salt(s) of monomeric and/or polymeric organic acids to be present in the claimed compositions, as is described above, the magnesium and/or zinc salts of monomeric and/or polymeric organic acids from the groups of unbranched saturated or unsaturated monocarboxylic acids, of branched saturated or unsaturated monocarboxylic acids, of saturated and unsaturated dicarboxylic acids, of aromatic mono-, di- and tricarboxylic acids, of sugar acids, of hydroxy acids, of oxo acids, of amino acids and/or of polymeric carboxylic acids are preferred. For the purposes of the present invention, within this group, the acids specified below are in turn preferred:

From the group of unbranched saturated or unsaturated monocarboxylic acids: methanoic acid (formic acid), ethanoic acid (acetic acid), propanoic acid (propionic acid), pentanoic acid (valeric acid), hexanoic acid (caproic acid), heptanoic acid (enanthic acid), octanoic acid (caprylic acid), nonanoic acid (pelargonic acid), decanoic acid (capric acid), undecanoic acid, dodecanoic acid (lauric acid), tridecanoic acid, tetradecanoic acid (myristic acid), pentadecanoic acid, hexadecanoic acid (palmitic acid), heptadecanoic acid (margaric acid), octadecanoic acid (stearic acid), eicosanoic acid (arachidic acid), docosanoic acid (behenic acid), tetracosanoic acid (lignoceric acid), hexacosanoic acid (cerotic acid), triacontanoic acid (melissic acid), 9c-hexadecenoic acid (palmitoleic acid), 6c-octadecenoic acid (petroselic acid), 6t-octadecenoic acid (petroselaidic acid), 9c-octadecenoic acid (oleic acid), 9t-octadecenoic acid (elaidic acid), 9c,12c-octadecadienoic acid (linoleic acid), 9t,12t-octadecadienoic acid (linolaidic acid) and 9c,12c,15c-octadecatrienoic acid (linolenic acid).

From the group of branched saturated or unsaturated monocarboxylic acids: 2-methylpentanoic acid, 2-ethylhexanoic acid, 2-propylheptanoic acid, 2-butyloctanoic acid, 2-pentylnonanoic acid, 2-hexyldecanoic acid, 2-heptylundecanoic acid, 2-octyldodecanoic acid, 2-nonyltridecanoic acid, 2-decyltetradecanoic acid, 2-undecylpentadecanoic acid, 2-dodecylhexadecanoic acid, 2-tridecylheptadecanoic acid, 2-tetradecyloctadecanoic acid, 2-pentadecylnonadecanoic acid, 2-hexadecyleicosanoic acid, 2-heptadecylheneicosanoic acid.

From the group of unbranched saturated or unsaturated di- or tricarboxylic acids: propanedioic acid (malonic acid), butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), 2c-butenedioic acid (maleic acid), 2t-butenedioic acid (fumaric acid), 2-butynedicarboxylic acid (acetylenedicarboxylic acid).

From the group of aromatic mono-, di- and tricarboxylic acids: benzoic acid, 2-carboxybenzoic acid (phthalic acid), 3-carboxybenzoic acid (isophthalic acid), 4-carboxybenzoic acid (terephthalic acid), 3,4-dicarboxybenzoic acid (trimellitic acid), 3,5-dicarboxybenzoic acid (trimesionic acid).

From the group of sugar acids: galactonic acid, mannonic acid, fructonic acid, arabinonic acid, xylonic acid, ribonic acid, 2-deoxyribonic acid, alginic acid.

From the group of hydroxy acids: hydroxyphenylacetic acid (mandelic acid), 2-hydroxypropionic acid (lactic acid), hydroxysuccinic acid (malic acid), 2,3-dihydroxybutanedioic acid (tartaric acid), 2-hydroxy-1,2,3-propanetricarboxylic acid (citric acid), ascorbic acid, 2-hydroxybenzoic acid (salicylic acid), 3,4,5-trihydroxybenzoic acid (gallic acid).

From the group of oxo acids: 2-oxopropionic acid (pyruvic acid), 4-oxopentanoic acid (levulinic acid).

From the group of amino acids: alanine, valine, leucine, isoleucine, proline, tryptophan, phenylalanine, methionine, glycine, serine, tyrosine, threonine, cysteine, asparagine, glutamine, aspartic acid, glutamic acid, lysine, arginine, histidine.

From the group of polymeric carboxylic acids: polyacrylic acid, polymethacrylic acid, alkylacrylamide/acrylic acid copolymers, alkyl-acrylamide/methacrylic acid copolymers, alkylacryl-amide/methylmethacrylic acid copolymers, copolymers of unsaturated carboxylic acids, vinyl acetate/crotonic acid copolymers, vinylpyrrolidone/vinyl acrylate copolymers.

The spectrum of the zinc salts, preferred according to the invention, of organic acids, preferably of organic carboxylic acids, ranges from salts which are sparingly soluble or insoluble in water, i.e. have a solubility below 100 mg/l, preferably below 10 mg/l, in particular no solubility, to those salts which have a solubility in water above 100 mg/l, preferably above 500 mg/l, particularly preferably above 1 g/l and in particular above 5 g/l (all solubilities at 20° C. water temperature). The first group of zinc salts includes, for example, zinc citrate, zinc oleate and zinc stearate, and the group of soluble zinc salts includes, for example, zinc formate, zinc acetate, zinc lactate and zinc gluconate.

In a further preferred embodiment of the present invention, the compositions according to the invention comprise at least one zinc salt, but comprises no magnesium salt of an organic acid, where it is preferably at least one zinc salt of an organic carboxylic acid, particularly preferably a zinc salt from the group consisting of zinc stearate, zinc oleate, zinc gluconate, zinc acetate, zinc lactate and/or zinc citrate.

A composition preferred within the scope of the present invention comprises zinc salt in amounts of from 0.1 to 5% by weight, preferably from 0.2 to 4% by weight and in particular from 0.4 to 3% by weight, or zinc in oxidized form in amounts of from 0.01 to 1% by weight, preferably from 0.02 to 0.5% by weight and in particular from 0.04 to 0.2% by weight, in each case based on the total weight of the dishwasher detergent.

The present invention further provides for the use of salts of the metals magnesium and zinc with organic acids, with the exception of formic acid, acetic acid, gluconic acid and oxalic acid, as glass corrosion inhibitors.

As mentioned in the introduction, the incorporation of magnesium and/or zinc salts of organic acids according to the invention into the dishwasher detergents according to the invention presupposes no limitation with regard to the supply form or the formulations of these compositions. Dishwasher detergents within the scope of the present invention may therefore be prepared either in solid form or in liquid form.

Within the scope of the present invention, liquid detergents are aqueous and nonaqueous compositions based on liquid constituents and having dynamic viscosities in the range between 0.2 and 1000 mPa·s, but also higher-viscosity compositions with viscosities above 1000 mPa·s to firm-consistency and dimensionally stable gels are possible supply forms. Preferred nonaqueous liquid detergents comprise solvents from the group consisting of ethanol, n-propanol, isopropanol, 1-butanol, 2-butanol, glycol, propanediol, butanediol, glycerol, diglycol, propyl diglycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl or propyl ether, dipropylene glycol methyl or ethyl ether, methoxy-, ethoxy- or butoxytriglycol, 1-butoxyethoxy-2-propanol, 3-methyl-3-methoxybutanol, propylene glycol t-butyl ether or mixtures thereof.

To adjust the viscosity of liquid supply forms of the detergents according to the invention, they typically further comprise one or more thickeners. Preferred thickeners are agar agar, carrageen, tragacanth, gum arabic, alginates, pectins, polyoses, guar flour, carob seed grain, starch, dextrins, gelatin, casein, carboxymethylcellulose, hydroxyethylcellulose, hydroxy-propylcellulose, hydroxypropylmethylcellulose, seed flour ethers, polyacrylic and polymethacrylic compounds, vinyl polymers, polycarboxylic acids, polyethers, polyimines, polyamides, polysilicic acids, clay minerals, such as montmorillonites, zeolites and silicas.

A further typical constituent of liquid aqueous detergents are hydrotropes. The addition of such substances leads to a sparingly soluble substance in the presence of the hydrotrope, which is itself not a solvent, becoming soluble in water. Substances which bring about such an improvement in solubility are referred to as hydrotropes or hydrotropic agents. Typical hydrotropes, e.g. for the formulation of liquid washing or cleaning compositions, are xylene- and cumenesulfonate. Other substances, e.g. urea or N-methylacetamide, increase the solubility by a structure-breaking effect in which the water structure is broken down in the vicinity of the hydrophobic group of a sparingly soluble substance.

A dishwasher detergent preferred in the scope of this application is characterized in that it has a viscosity of from 500 to 500 000 mPas, preferably from 900 to 200 000 mPas and in particular from 1300 to 100 000 mPas. The viscosity of the compositions according to the invention is measured using customary standard methods (for example Brookfield viscometer LVT-II at 20 rpm and at 20° C., spindle 3).

As a preferred ingredient, the compositions according to the invention comprise one or more nonaqueous solvents. These originate, for example, from the groups of monoalcohols, diols, triols or polyols, ethers, esters and/or amides. Particular preference is given here to nonaqueous solvents which are water-soluble, where "water-soluble" solvents for the purposes of the present application are solvents which are completely miscible with water at room temperature, i.e. without miscibility gap.

Nonaqueous solvents which can be used in the compositions according to the invention preferably originate from the group of mono- or polyhydric alcohols, alkanolamines or glycol ethers, provided they are miscible with water in the given concentration range. The solvents are preferably chosen from ethanol, n- or isopropanol, butanols, glycol, propane- or butanediol, glycerol, diglycol, propyl or butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl or propyl ether, dipropylene glycol methyl or ethyl ether, methoxy, ethoxy or butoxy triglycol, 1-butoxyethoxy-2-propanol, 3-methyl-3-methoxybutanol, propylene glycol t-butyl ether, and mixtures of these solvents.

Nonionic surfactants which are liquid at room temperature are also preferred nonaqueous solvents within the scope of the application.

A dishwasher detergent which is particularly preferred within the scope of the present invention is characterized in that it comprises nonaqueous solvent(s), where the solvent(s) is/are preferably chosen from the group of polyethylene glycols and polypropylene glycols, glycerol, glycerol carbonate, triacetin, ethylene glycol, propylene glycol, propylene carbonate, hexylene glycol, ethanol and n-propanol and/or isopropanol.

Polyethylene glycols (abbreviation PEGS) which can be used according to the invention are liquid at room temperature. PEGs are polymers of ethylene glycol which satisfy the general formula (I)

$$H—(O—CH_2—CH_2)_n—OH \quad (I),$$

where n can assume values between 1 (ethylene glycol, see below) and about 16. For polyethylene glycols there exist various nomenclatures, which may lead to confusion. It is common in the art to state the average relative molecular weight after the letters "PEG", so that "PEG 200" characterizes a polyethylene glycol with a relative molar mass about 190 to about 210. In accordance with this nomenclature, the polyethylene glycols PEG 200, PEG 300, PEG 400 and PEG 600 customary in the art can be used within the scope of the present invention.

For cosmetic ingredients a different nomenclature is used, in which the abbreviation PEG is provided with a hyphen and the hyphen is followed directly by a number which corresponds to the number n in the above formula. According to this nomenclature (so-called INCI nomenclature, CTFA International Cosmetic Ingredient Dictionary and Handbook, 5th Edition, The Cosmetic, Toiletry and Fragrance Association, Washington, 1997), for example, PEG-4, PEG-6, PEG-8, PEG-9, PEG-10, PEG-12, PEG-14 and PEG-16 can be used in accordance with the invention.

Polyethylene glycols are commercially available, for example under the trade names Carbowax® PEG 200 (Union Carbide), Emkapol® 200 (ICI Americas), Lipoxol® 200 MED (HOLS America), Polyglycol® E-200 (Dow Chemical), Alkapol® PEG 300 (Rhone-Poulenc), Lutrol® E300 (BASF), and the corresponding trade names with higher numbers.

Polypropylene glycols (PPGs) which can be used according to the invention are polymers of propylene glycol which satisfy the general formula (II)

$$H—(O—\underset{\underset{CH_3}{|}}{CH}—CH_2)_n—OH, \quad (II)$$

where n can assume values between 1 (propylene glycol, see below) and about 12. Of industrial significance here are, in particular, di-, tri- and tetrapropylene glycol, i.e. the representatives where n=2, 3 and 4 in the above formula.

Glycerol is a colorless, clear, viscous, odorless, sweet-tasting hygroscopic liquid which has a density of 1.261 and solidifies at 18.2° C. Glycerol was originally only a by-product of fat saponification, but is nowadays synthesized industrially in large quantities. Most industrial processes start from propene, which is processed to glycerol via the intermediate stages of allyl chloride and epichlorohydrin. A further industrial process is the hydroxylation of allyl alcohol with hydrogen peroxide over a $WO_3$ catalyst, via the stage of the glycide.

Glycerol carbonate is obtainable by esterifying ethylene carbonate or dimethyl carbonate with glycerol, the by-products produced being ethylene glycol or methanol, respectively. A further synthesis route starts from glycidol (2,3-epoxy-1-propanol), which is reacted with $CO_2$ under pressure in the presence of catalysts to give glycerol carbonate. Glycerol carbonate is a clear, readily mobile liquid which has a density of 1.398 $gcm^{-3}$ and boils at 125–130° C. (0.15 mbar).

Ethylene glycol (1,2-ethanediol, "glycol") is a colorless, viscous, sweet-tasting, highly hygroscopic liquid which is miscible with water, alcohols and acetone and has a density of 1.113. The solidification point of ethylene glycol is −11.5° C.; the liquid boils at 198° C. Industrially, ethylene glycol is obtained from ethylene oxide by heating with water under pressure. Promising preparation processes may be based on the acetoxylation of ethylene and subsequent hydrolysis, or on synthesis gas reactions.

Propylene glycol exists in two isomers, 1,3-propanediol and 1,2-propanediol. 1,3-Propanediol (trimethylene glycol) is a neutral, colorless and odorless, sweet-tasing liquid with a density of 1.0597 which solidifies at −32° C. and boils at 214° C. 1,3-Propanediol is prepared from acrolein and water with subsequent catalytic hydrogenation.

Of far more industrial importance is 1,2-propanediol (propylene glycol), which is an oily, colorless, virtually odorless liquid of density 1.0381 which solidifies at −60° C. and boils at 188° C. 1,2-Propanediol is prepared from propylene oxide by water addition.

Propylene carbonate is a water-white, readily mobile liquid with a density of 1.21 $gcm^{-3}{}_1$ a melting point of −49° C. and a boiling point of 242° C. Propylene carbonate is also accessible industrially by reacting propylene oxide and $CO_2$ at 200° C. and 80 bar.

In preferred dishwasher detergents according to the invention, the content of the nonaqueous solvent(s) is 0.1 to 70% by weight, preferably from 0.5 to 60% by weight, particularly preferably from 1 to 50% by weight, very particularly preferably from 2 to 40% by weight and in particular from 2.5 to 30% by weight, in each case based on the total composition.

Within the scope of this invention, "nonaqueous" is understood here as meaning a state in which the content of free water in the compositions is significantly below 5% by weight. It is preferred for the content of free water, i.e, water not in the form of water of hydration and/or water of constitution, in the compositions according to the invention to be less than 10% by weight, preferably less than 8% by weight and in particular even less than 6% by weight, in each case based on the composition. Accordingly, water may be introduced into the composition essentially only in chemically and/or physically bound form or as a constituent of the solid raw materials or compounds, but not as a liquid, solution or dispersion.

As a further preferred ingredient, the compositions according to the invention comprise one or more nonionic surfactants. According to the invention, the amounts in which the nonionic surfactants are used are between 1 and 30% by weight, preference being given to dishwasher detergents according to the invention which comprise 1 to 25% by weight, more preferably 2 to 22.5% by weight, particularly preferably 3 to 20% by weight and in particular 4 to 17.5% by weight, of nonionic surfactant(s).

For a detailed description of the surface-active ingredients, reference is made to the sections below to avoid repetition.

In addition to the ingredients mentioned thus far, the compositions according to the invention can comprise further customary ingredients of detergents. Of importance in this connection are, in particular, the builders. Builders are used in the compositions according to the invention primarily for binding calcium and magnesium. Customary builders which, within the scope of the invention, are present preferably in amounts of from 22.5 to 45% by weight, preferably from 25 to 40% by weight and in particular from 27,5 to 35% by weight, in each case based on the total composition, are the low molecular weight polycarboxylic acids and their salts, the homopolymeric and copolymeric polycarboxylic acids and their salts, the carbonates, phosphates and sodium and potassium silicates. For the detergents according to the invention, preference is given to using trisodium citrate and/or pentasodium tripolyphosphate and silicatic builders from the class of alkali metal disilicates. In general, with the alkali metal salts, the potassium salts are preferred over the sodium salts since they often have a greater solubility in water. Preferred water-soluble builders are, for example, tripotassium citrate, potassium carbonate and the potassium waterglasses.

Particularly preferred dishwasher detergents comprise, as builders, phosphates, preferably alkali metal phosphates, particularly preferably pentasodium or pentapotassium triphosphate (sodium or potassium tripolyphosphate).

Preferred dishwasher detergents comprise 20 to 60% by weight of one or more water-soluble builders, preferably citrates and/or phosphates, preferably alkali metal phosphates, particularly preferably the pentasodium and pentapotassium triphosphate (sodium and potassium tripolyphosphate).

A detailed description of said builders, in particular the phosphates, can be found under the heading "Builders" later in the text. Reference is made to this section of the description at this point to avoid repetitions.

In preferred embodiments of the present invention, the content of water-soluble builders in the compositions is within relatively narrow limits. In this regard, preference is given to dishwasher detergents which comprise the water-soluble builder(s) in amounts of from 22.5 to 55% by weight, preferably from 25 to 50% by weight and in particular from 27.5 to 45% by weight, in each case based on the total composition.

The compositions according to the invention can particularly advantageously comprise condensed phosphates as water-softening substances. These substances form a group of phosphates—due to their preparation also called fused or high-temperature phosphates—which can be derived from acidic salts of orthophosphoric acid (phosphoric acids) by condensation. The condensed phosphates can be divided into the metaphosphates $[M^I_n(PO_3)_n]$ and polyphosphates ($M^I_{n+2}P_nO_{3n+1}$ or $M^I_nH_2P_nO_{3n+1}$).

The term "metaphosphates" was originally the general name for condensed phosphates with the composition $M_n[P_nO_{3n}]$ (M=monovalent metal), but is nowadays mostly restricted to salts with ring-shaped cyclo(poly)phosphate anions. When n=3, 4, 5, 6 etc. the names are tri-, tetra-, penta-, hexametaphosphates, etc. According to the systematic nomenclature of the isopolyanions, the anion where n=3 is, for example, referred to as cyclotriphosphate.

Metaphosphates are obtained as accompanying substances of the Graham salt—incorrectly referred to as sodium hexametaphosphate—by melting $NaH_2PO_4$ at temperatures exceeding 620° C., where so-called Maddrell's salt is also formed as an intermediate. This salt and Kurrol's salt are linear polyphosphates which are mostly nowadays not included with the metaphosphates, but which can likewise be used advantageously as water-softening substances for the purposes of the present invention.

The crystalline, water-insoluble Maddrell's salt, $(NaPO_3)_x$, where x is >1000, which can be obtained at 200–300° C. from $NaH_2PO_4$, converts, at about 600° C., into the cyclic metaphosphate $[Na_3(PO_3)_3]$, which melts at 620° C. The quenched, glass-like melt is, depending on the reaction conditions, the water-soluble Graham's salt $(NaPO_3)_{40-50}$, or a glass-like condensed phosphate of the composition $(NaPO_3)_{15-20}$, which is known as Calgon. For both compositions, the erroneous name hexametaphosphates is still in use. The so-called Kurrol's salt, $(NaPO_3)_n$, where n is >>5000, likewise arises from the 600° C.-hot melt of the Maddrell's salt if this is left for a short time at about 500° C. It forms highly polymeric water-soluble fibers.

The "hexametaphosphates" Budit® H6 and H8 from Budenheim have proven particularly preferred water-softening substances from the classes of condensed phosphates specified above.

As well as the surfactants and builders, bleaches, bleach activators, enzymes, silver protectants, dyes and fragrances etc. in particular are preferred ingredients of dishwasher detergents. In addition, further ingredients may be present, preference being given to dishwasher detergents according to the invention which additionally comprise one or more substances from the group of acidifying agents, chelate complexing agents or of film-inhibiting polymers.

Possible acidifiers are either inorganic acids or organic acids provided these are compatible with the other ingredients. For reasons of consumer protection and handling safety, the solid mono-, oligo- and polycarboxylic acids in particular can be used. From this group, preference is in turn given to citric acid, tartaric acid, succinic acid, malonic acid, adipic acid, maleic acid, fumaric acid, oxalic acid, and polyacrylic acid. The anhydrides of these acids can also be used as acidifiers, maleic anhydride and succinic anhydride in particular being commercially available. Organic sulfonic acids, such as amidosulfonic acid can likewise be used. A composition which is commercially available and which can likewise preferably be used as acidifier for the purposes of the present invention is Sokalan® DCS (trademark of BASF), a mixture of succinic acid (max. 31% by weight), glutaric acid (max. 50% by weight) and adipic acid (max. 33% by weight).

A further possible group of ingredients are the chelate complexing agents. Chelate complexing agents are substances which form cyclic compounds with metal ions, where a single ligand occupies more than one coordination site on a central atom, i.e. is at least "bidentate". In this case, stretched compounds are thus normally closed by complex formation via an ion to give rings. The number of bonded ligands depends on the coordination number of the central ion.

Chelate complexing agents which are customary and preferred for the purposes of the present invention are, for example, polyoxycarboxylic acids, polyamines, ethylenediaminetetraacetic acid (EDTA) and nitrilotriacetic acid (NTA). Complex-forming polymers, i.e. polymers which carry functional groups either in the main chain itself or laterally relative to this, which can act as ligands and react with suitable metal atoms usually to form chelate complexes, can also be used according to the invention. The polymer-bonded ligands of the resulting metal complexes can originate from just one macromolecule or else belong to different polymer chains. The latter leads to crosslinking of the material, provided the complex-forming polymers have not already been crosslinked beforehand via covalent bonds.

Complexing groups (ligands) of customary complex-forming polymers are iminodiacetic acid, hydroxyquinoline, thiourea, guanidine, dithiocarbamate, hydroxamic acid, amidoxime, aminophosphoric acid, (cycl.) polyamino, mercapto, 1,3-dicarbonyl and crown ether radicals, some of which have very specific activities toward ions of different metals. Basis polymers of many complex-forming polymers, which are also commercially important, are polystyrene, polyacrylates, polyacrylonitriles, polyvinyl alcohols, polyvinylpyridines and polyethylenimines. Natural polymers, such as cellulose, starch or chitin are also complex-forming polymers. Moreover, these may be provided with further ligand functionalities as a result of polymer-analogous modifications.

For the purposes of the present invention, particular preference is given to dishwasher detergents which comprise one or more chelate complexing agents from the groups of (i) polycarboxylic acids in which the sum of the carboxyl and optionally hydroxyl groups is at least 5,
(ii) nitrogen-containing mono- or polycarboxylic acids,
(iii) geminal diphosphonic acids,
(iv) aminophosphonic acids,
(v) phosphonopolycarboxylic acids,
(vi) cyclodextrins in amounts above 0.1% by weight, preferably above 0.5% by weight, particularly preferably above 1% by weight and in particular above 2.5% by weight, in each case based on the weight of the dishwasher composition.

For the purposes of the present invention, it is possible to use all complexing agents of the prior art. These may belong to different chemical groups. Preference is given to using the following, individually or in a mixture with one another:

a) polycarboxylic acids in which the sum of the carboxyl and optionally hydroxyl groups is at least 5, such as gluconic acid,
b) nitrogen-containing mono- or polycarboxylic acids, such as ethylenediaminetetraacetic acid (EDTA), N-hydroxyethylethylenediaminetriacetic acid, diethylenetriaminepentaacetic acid, hydroxy-ethyliminodiacetic acid, nitridodiacetic acid-3-propionic acid, isoserinediacetic acid, N,N-di(β-hydroxyethyl)glycine, N-(1,2-dicarboxy-2-hydroxyethyl)glycine, N-(1,2-dicarboxy-2-hydroxyethyl)-aspartic acid or nitrilotriacetic acid (NTA),
c) geminal diphosphonic acids, such as 1-hydroxyethane-1,1-diphosphonic acid (HEDP), higher homologs thereof having up to 8 carbon atoms, and hydroxy or amino group-containing derivatives thereof and 1-aminoethane-1,1-diphosphonic acid, higher homologs thereof having up to 8 carbon atoms, and hydroxy or amino group-containing derivatives thereof,
d) aminophosphonic acids, such as ethylenediamine-tetra (methylenephosphonic acid), diethylenetriaminepenta(methylenephosphonic acid) or nitrilotri(methylenephosphonic acid),
e) phosphonopolycarboxylic acids, such as 2-phosphonobutane-1,2,4-tricarboxylic acid, and
f) cyclodextrins.

For the purposes of this patent application, polycarboxylic acids a) are understood as meaning carboxylic acids—including monocarboxylic acids—in which the sum of carboxyl and the hydroxyl groups present in the molecule is at least 5. Complexing agents from the group of nitrogen-containing polycarboxylic acids, in particular EDTA, are preferred. At the alkaline pH values of the treatment solutions required according to the invention, these complexing agents are at least partially in the form of anions. It is unimportant whether they are introduced in the form of acids or in the form of salts. In the case of using salts, alkali metal, ammonium or alkylammonium salts, in particular sodium salts, are preferred.

Film-inhibiting polymers may likewise be present in the compositions according to the invention. These substances, which may have chemically different structures, originate, for example, from the groups of low molecular weight polyacrylates with molar masses between 1000 and 20 000 daltons, preference being given to polymers with molar masses below 15 000 daltons.

Film-inhibiting polymers may also have cobuilder properties. Organic cobuilders which may be used in the dishwasher detergents according to the invention are, in particular, polycarboxylates/polycarboxylic acids, polymeric polycarboxylates, aspartic acid, polyacetals, dextrins, further organic cobuilders (see below) and phosphonates. These classes of substance are described below.

Organic builder substances which can be used are, for example, the polycarboxylic acids usable in the form of their sodium salts, the term polycarboxylic acids meaning carboxylic acids which carry more than one acid function. Examples of these are citric acid, adipic acid, succinic acid, glutaric acid, malic acid, tartaric acid, maleic acid, fumaric acid, sugar acids, aminocarboxylic acids, nitrilotriacetic acid (NTA), provided such a use is not objectionable on ecological grounds, and mixtures thereof. Preferred salts are the salts of the polycarboxylic acids such as citric acid, adipic acid, succinic acid, glutaric acid, tartaric acid, sugar acids and mixtures thereof.

The acids per se may also be used. In addition to their builder action, the acids typically also have the property of an acidifying component and thus also serve to establish a lower and milder pH of detergents or cleaners. In this connection, particular mention is made of citric acid, succinic acid, glutaric acid, adipic acid, gluconic acid and any mixtures thereof.

Also suitable as builders or film inhibitors are polymeric polycarboxylates; these are, for example, the alkali metal salts of polyacrylic acid or of polymethacrylic acid, for example those having a relative molecular mass of from 500 to 70 000 g/mol.

The molar masses given for polymeric polycarboxylates are, for the purposes of this specification, weight-average molar masses Mw of the respective acid form, determined fundamentally by means of gel permeation chromatography (GPC) using a UV detector. The measurement was made against an external polyacrylic acid standard which, owing to its structural similarity to the polymers under investigation, provides realistic molecular weight values. These figures differ considerably from the molecular weight values obtained using polystyrenesulfonic acids as the standard. The molar masses measured against polystyrenesulfonic acids are usually considerably higher than the molar masses given in this specification.

Suitable polymers are, in particular, polyacrylates which preferably have a molecular mass of from 2000 to 20 000 g/mol. Owing to their superior solubility, preference in this group may be given in turn to the short-chain polyacrylates which have molar masses of from 2000 to 10 000 g/mol and particularly preferably from 3000 to 5000 g/mol.

Also suitable are copolymeric polycarboxylates, in particular those of acrylic acid with methacrylic acid and of acrylic acid or methacrylic acid with maleic acid. Copolymers which have proven to be particularly suitable are those of acrylic acid with maleic acid which contain from 50 to 90% by weight of acrylic acid and 50 to 10% by weight of maleic acid. Their relative molecular mass, based on free acids, is generally 2000 to 70 000 g/mol, preferably 20 000 to 50 000 g/mol and in particular 30 000 to 40 000 g/mol.

The (co)polymeric polycarboxylates can either be used as powders or as aqueous solutions. The (co)polymeric polycarboxylate content of the agents is preferably 0.5 to 20% by weight, in particular 3 to 10% by weight.

Particular preference is also given to biodegradable polymers of more than two different monomer units, for example those which contain, as monomers, salts of acrylic acid or of maleic acid, and vinyl alcohol or vinyl alcohol derivatives, or those which contain, as monomers, salts of acrylic acid and of 2-alkylallyl-sulfonic acid, and sugar derivatives. Further preferred copolymers are those which preferably have, as monomers, acrolein and acrylic acid/acrylic acid salts or acrolein and vinyl acetate.

Further preferred builder substances which are likewise to be mentioned are polymeric aminodicarboxylic acids, salts thereof or precursor substances thereof. Particular preference is given to polyaspartic acids or salts and derivatives thereof, which also have a bleach-stabilizing effect as well as cobuilder properties.

Further suitable builder substances are polyacetals which can be obtained by reacting dialdehydes with polyolcarboxylic acids which have 5 to 7 carbon atoms and at least 3 hydroxyl groups. Preferred polyacetals are obtained from dialdehydes, such as glyoxal, glutaraldehyde, terephthalaldehyde, and mixtures thereof and from polyolcarboxylic acids, such as gluconic acid and/or glucoheptonic acid.

Further suitable organic builder substances are dextrins, for example oligomers or polymers of carbohydrates, which can be obtained by partial hydrolysis of starches. The hydrolysis can be carried out in accordance with customary processes, for example acid-catalyzed or enzyme-catalyzed processes. The hydrolysis products preferably have average molar masses in the range from 400 to 500 000 g/mol. Preference is given here to a polysaccharide with a dextrose equivalent (DE) in the range from 0.5 to 40, in particular from 2 to 30, where DE is a common measure of the reducing effect of a polysaccharide compared with dextrose, which has a DE of 100. It is also possible to use maltodextrins with a DE between 3 and 20 and dried glucose syrups with a DE between 20 and 37, and also so-called yellow dextrins and white dextrins with relatively high molar masses in the range from 2000 to 30 000 g/mol.

The oxidized derivatives of such dextrins are their reaction products with oxidizing agents which are able to oxidize at least one alcohol function of the saccharide ring to the carboxylic acid function. A product oxidized on the $C_6$ of the saccharide ring may be particularly advantageous.

Oxydisuccinates and other derivatives of disuccinates, preferably ethylenediaminedisuccinate, are also further suitable cobuilders. Here, ethylenediamine N,N'-disuccinate (EDDS) is preferably used in the form of its sodium or magnesium salts. In this connection, preference is also given to glycerol disuccinates and glycerol trisuccinates. Suitable use amounts in zeolite-containing and/or silicate-containing formulations are 3 to 15% by weight.

Further organic cobuilders which can be used are, for example, acetylated hydroxycarboxylic acids or salts thereof, which may also be present in lactone form and which contain at least 4 carbon atoms and at least one hydroxyl group and at most two acid groups.

A further class of substances with cobuilder properties is the phosphonates. These are, in particular, hydroxyalkane- and aminoalkanephosphonates. Among the hydroxyalkanephosphohates, 1-hydroxyethane-1,1-diphosphonate (HEDP) is of particular importance as cobuilder. It is preferably used as the sodium salt, the disodium salt giving a neutral reaction and the tetrasodium salt giving an alkaline reaction (pH 9), Suitable aminoalkanephosphonates are preferably ethylenediaminetetramethylenephosphonate (EDTMP), diethylenetriaminepentamethylenephosphonate (DTPMP) and higher homologs thereof. They are preferably used in the form of the neutrally reacting sodium salts, e.g. as the hexasodium salt of EDTMP or as the hepta- and octasodium salt of DTPMP. Here, preference is given to using HEDP as builder from the class of phosphonates. In addition, the aminoalkanephosphonates have a marked heavy metal-binding capacity. Accordingly, particularly if the compositions also comprise bleaches, it may be preferable to use aminoalkanephosphonates, in particular DTPMP, or mixtures of said phosphonates.

To regulate the viscosity, the compositions according to the invention can comprise further ingredients, the use of which can, for example, control the settling behavior or the pourability or flowability in a targeted manner. In nonaqueous systems, combinations of structure-imparting agents and thickeners in particular have proven successful.

Dishwasher detergents preferred for the purposes of the present invention further comprise a) 0.1 to 1.0% by weight of one or more structure-imparting agents from the group of bentonites and/or at least partially etherified sorbitols and b) 5.0 to 30% by weight of one or more thickeners from the group of carbonates, sulfates and amorphous or crystalline disilicates.

The structure-imparting agent a) originates from the group of bentonites and/or at least partially etherified sorbitols. These substances are used in order to ensure the physical stability of the compositions and to adjust the viscosity. Although conventional thickeners such as polyacrylates or polyurethanes do not work in nonaqueous media, viscosity regulation is possible using said substances in the nonaqueous system.

Bentonites are contaminated clays which are formed as a result of the weathering of vulcanic tuffs. Because of their high content of montmorillonite, bentonites have valuable properties, such as swellabilityl ion exchangeability and thixotropy. Here, it is possible to correspondingly modify the properties of the bentonites to the intended use. Bentonites are often as clay constituent in tropical soils and are recovered as sodium bentonite e.g. in Wyoming/USA. Sodium bentonite has the most favorable application properties (swellability), meaning that its use for the purposes of the present invention is preferred. Naturally occurring calcium bentonites originate, for example, from Mississippi/USA or Texas/USA or from Landshut/Germany. The naturally obtained Ca bentonites are converted artificially into the more swellable Na bentonites by exchanging Ca with Na.

The main constituents of the bentonites are formed by so-called montmorillonites which can also be used in pure form for the purposes of the present invention. Montmorillonites are clay minerals which belong to the phyllosilicates and here to the dioctahedral smectites and produce monoclinic-pseudohexagonal crystals. Montmorillonites form predominantly white, gray-white to yellowish masses which appear completely amorphous, are readily friable, which swell in water but do not become plastic and which can be described by the general formulae $$Al_2[(OH)_2/Si_4O_{10}].nH_2O$$

or $$Al_2O_3.4SiO_2.H_2O.nH_2O$$

or $$Al_2[(OH)_2/Si_4O_{10}]$$

(dried at 150°).

Dishwasher detergents are characterized in that the structure-imparting agents used are montmorillonites. Montmorillonites have a three-layer structure which consists of two tetrahedron layers which are electrostatically crosslinked via the cations of an intermediate octahedron layer. The layers are not connected in rigid fashion, but can swell as a result of reversible intercalation of water (in 2–7 times the amount) and other substances such as, for example, alcohols, glycols, pyridine, α-picoline, ammonium compounds, hydroxyaluminosilicate ions etc. The formulae given above represent only approximated formulae since montmorillonites have a great capacity for ion exchange. Thus, Al can be exchanged for Mg, $Fe^{2+}$, $Fe^{3+}$, Zn, Cr, Cu and other ions. The result of such a substitution is a negative charge of the layers, which is balanced by other cations, in particular $Na^+$ and $Ca^{2+}$.

In combination with the bentonites or as a replacement for them, if their use is not desired, it is possible to use at least partially etherified sorbitols as structure-imparting agents.

Sorbitol is a 6-hydric alcohol (sugar alcohol) belonging to the hexitols which relatively readily eliminates one or two mol of water intramolecularly and forms cyclic ethers (for example sorbitan and sorbide). The elimination of water is also possible intermolecularly, with noncyclic ethers forming from sorbitol and the alcohols in question. Here too, the formation of monoethers and bisethers is possible, it also being possible for higher degrees of etherification such as 3 and 4 to arise. At least partially etherified sorbitols to be used with preference for the purposes of the present invention are dietherified sorbitols, of which particular preference is given to dibenzylidenesorbitol; Preference is given here to dishwasher detergents which comprise dietherified sorbitols, in particular dibenzylidenesorbitol, as structure-imparting agent.

The compositions according to the invention can comprise the structure-imparting agents in amounts of from 0.1 to 1.0% by weight, based on the total composition and on the active substance of the structure-imparting agent. Preferred compositions comprise the structure-imparting agent in amounts of from 0.2 to 0.9% by weight, preferably in amounts of from 0.25 to 0.75% by weight and in particular in amounts of from 0.3 to 0.5% by weight, in each case based on the total composition.

As thickeners, the preferred compositions according to the invention can comprise inorganic salts from the group of carbonates, sulfates and amorphous or crystalline disilicates. In this connection, it is in principle possible to use said salts of all metals, preference being given to the alkali metal salts. For the purposes of the present invention, the thickeners particularly preferably used are alkali metal carbonate(s), alkali metal sulfate(s) and/or amorphous and/or crystalline alkali metal disilicate(s), preferably sodium carbonate, sodium sulfate and/or amorphous or crystalline sodium disilicate.

The preferred compositions according to the invention comprise the thickeners in amounts of from 5 to 30% by weight, based on the total composition. Particularly preferred compositions comprise the thickener or thickeners in amounts of from 7.5 to 28% by weight, preferably in amounts of from 10 to 26% by weight and in particular in amounts of from 12.5 to 25% by weight, in each case based on the total composition.

With regard to an increased settling stability, it is preferred for the solids present in the compositions according to the invention to be used in as finely divided a form as possible. This is particularly advantageous for the inorganic thickeners and the bleaches. Preference is given here to dishwasher detergents according to the invention in which the average particle size of the bleaches and thickeners and of the optionally used builders is less than 75 μm, preferably less than 50 μm and in particular less than 25 μm.

The liquid dishwasher detergents according to the invention can also comprise other viscosity regulators or thickeners to establish any desired higher viscosity. In this connection, it is possible to use all known thickeners, i.e. those based on natural or synthetic polymers.

Naturally occurring polymers which are used as thickeners are, for example, agar agar, carrageen, tragacanth, gum arabic, alginates, pectins, polyoses, guar flour, carob seed flour, starch, dextrins, gelatins and casein.

Modified natural substances originate primarily from the group of modified starches and celluloses, examples which may be mentioned here being carboxymethylcellulose and other cellulose ethers, hydroxyethylcellulose and hydroxypropylcellulose, and carob flour ether.

Dishwasher detergents which are preferred within the scope of the present invention comprise, as thickener, hydroxyethylcellulose and/or hydroxypropylcellulose, preferably in amounts of from 0.01 to 4.0% by weight, particularly preferably in amounts of from 0.01 to 3.0% by weight and in particular in amounts of from 0.01 to 2.0% by weight, in each case based on the total composition.

A large group of thickeners which are used widely in very diverse fields of application are the completely synthetic polymers, such as polyacrylic and polymethacrylic compounds, vinyl polymers, polycarboxylic acids, polyethers, polyimines, polyamides and polyurethanes.

Thickeners from said classes of substance are commercially broadly available and are obtainable, for example, under the trade names Acusol®-820 (methacrylic acid (stearyl alcohol-20 EO) ester-acrylic acid copolymer, 30% strength in water, Rohm & Haas), Dapral®-GT-282-S (alkyl polyglycol ether, Akzo), Deuterol® polymer-11 (dicarboxylic acid copolymer, Schöner GmbH), Deuteron®-XG (anionic heteropolysaccharide based on β-D-glucose, D-manose, D-glucuronic acid, Schöner GmbH), Deuteron®-XN (nonionogenic polysaccharide, Schoner GmbH), Dicrylan® thickener-O (ethylene oxide adduct, 50% strength in water/isopropanol, Pfersse Chemie), EMA®-81 and EMA®-91 (ethylene-maleic anhydride copolymer, Monsanto), thickener-QR-1001 (polyurethane emulsion, 19–21% strength in water/diglycol ether, Rohm & Haas), Mirox®-AM (anionic acrylic acid-acrylic ester copolymer dispersion, 25% strength in water, Stockhausen), SER-AD-FX-1100 (hydrophobic urethane polymer, Servo Delden), Shellflo®-S (high molecular weight polysaccharide, stabilized with formaldehyde, Shell) and Shellflo®-XA (xanthan biopolymer, stabilized with formaldehyde, Shell).

A preferred polymeric thickener is xanthan, a microbial anionic heteropolysaccharide which is produced by *Xanthomonas campestris* and some other species under aerobic conditions and has a molar mass of from 2 to 15 million daltons. Xanthan is formed from a chain with β-1,4-bonded glucose (cellulose) with side chains. The structure of the subgroups consists of glucose, mannose, glucuronic acid, acetate and pyruvate, where the number of pyruvate units determines the viscosity of the xanthan.

Thickeners likewise to be used preferably for the purposes of the present invention are polyurethanes or modified polyacrylates which, based on the total product, can be used, for example, in amounts of from 0.1 to 5% by weight.

Polyurethanes (PURs) are prepared by polyaddition from di- or polyhydric alcohols and isocyanates and can be described by the general formula III

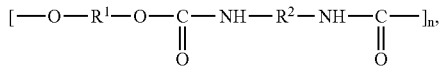

III in which $R^1$ is a low molecular weight or polymeric diol radical, $R^2$ is an aliphatic or aromatic group and n is a natural number. $R^1$ here is preferably a linear or branched $C_{2-12}$-alk(en)yl group, but can also be a radical of a polyhydric alcohol, as a result of which crosslinked polyurethanes are formed which differ from the formula VIII given above by virtue of the fact that further —O—CO—NH groups are bonded to the radical $R^1$.

Industrially important PURs are prepared from polyester- and/or polyetherdiols and, for example, e.g. from toluene 2,4- or 2,6-diisocyanate (TDI, $R^2{=}C_6H_3{-}CH_3$), 4,4'-methylenedi(phenylisocyanate) ($MD^1$, $R^2{=}C_6H_4{-}CH_2{-}C_6H_4$) or hexamethylene diisocyanate [$HMD^1$, $R^2{=}(CH_2)\ 6$].

Standard commercial thickeners based on polyurethane are available, for example, under the names Acrysol®PM 12 V (mixture of 3–5% modified starch and 14-16% PUR resin in water, Rohm & Haas), Borchigel® L75-N (nonionogenic PUR dispersion, 50% strength in water, Borchers), Coatex® BR-100-P (PUR dispersion, 50% strength in water/butyl glycol, Dimed), Nopco® DSX-1514 (PUR dispersion, 40% strength in water/butyl triglycol, Henkel-Nopco), thickener QR 1001 (20% strength PUR emulsion in water/diglycol ether, Rohm & Haas) and Rilanit® VPW-3116 (PUR dispersion, 43% strength in water, Henkel). For the purposes of the present invention, when using aqueous dispersions it is to be ensured that the water content of the products according to the invention remains within the limits given above. If the use of aqueous dispersions is not possible for these reasons, dispersions in other solvents, or else the solids, may be used.

Modified polyacrylates which can be used for the purposes of the present invention are derived, for example, from acrylic acid or from methacrylic acid and can be described by the general formula IV

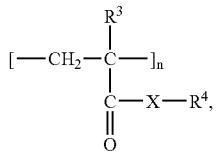

IV in which $R^3$ is H or a branched or unbranched $C_{1-4}$-alk(en)yl radical, X is N—$R^5$ or O, $R^4$ is an optionally alkoxylated branched or unbranched, possibly substituted $C_{8-22}$-alk(en)yl radical, $R^5$ is H or $R^4$ and n is a natural number. Generally, such modified polyacrylates are esters or amides of acrylic acid or of an α-substituted acrylic acid. Among these polymers, preference is given to those in which $R^3$ is H or a methyl group. In the polyacrylamides (X=N—$R^5$), either mono-($R^5$=H) or di-($R^5$=$R^4$) N-substituted amide structures are possible, where the two hydrocarbon radicals which are bonded to the N atom can be chosen independently of one another from optionally alkoxylated branched or unbranched $C_{8-22}$-alk(en)yl radicals. Among the polyacrylic esters (X=O), preference is given to those in which the alcohol has been obtained from natural or synthetic fats or oils and has additionally been alkoxylated, preferably ethoxylated. Preferred degrees of alkoxylation are between 2 and 30, particular preference being given to degrees of alkoxylation between 10 and 15.

Since the polymers which can be used are industrial compounds, the designation of the radicals bonded to X represents a statistical average value which can vary in individual cases with regard to chain length or degree of alkoxylation. Formula IV gives merely formulae for idealized homopolymers. However, for the purposes of the present invention, it is also possible to use copolymers in which the proportion of monomer units which satisfy formula IV is at least 30% by weight. Thus, for example, copolymers of modified polyacrylates and acrylic acid or salts thereof which also have acidic H atoms or basic —$COO^-$ groups can also be used.

Modified polyacrylates which are preferably to be used for the purposes of the present invention are polyacrylate-polymethacrylate copolymers which satisfy the formula V

V

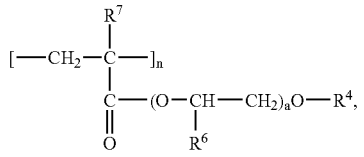

in which $R^4$ is a preferably unbranched, saturated or unsaturated $C_{8-22}$-alk(en)yl radical, $R^6$ and $R^7$, independently of one another, are H or $CH_3$, the degree of polymerization n is a natural number and the degree of alkoxylation a is a natural number between 2 and 30, preferably between 10 and 20. $R^4$ is preferably a fatty alcohol radical which has been obtained from natural or synthetic sources, the fatty alcohol in turn preferably being ethoxylated ($R^6$=H).

Products of the formula V are commercially available, for example under the name Acusol® 820 (Rohm & Haas) in the form of 30% strength by weight dispersions in water. In the case of said commercial product, $R^4$ is a stearyl radical, $R^6$ is a hydrogen atom, $R^7$ is H or $CH_3$ and the degree of ethoxylation a is 20. That stated above with regard to the water content of the products also applies for this dispersion.

Liquid dishwasher detergents preferred for the purposes of the present invention are characterized in that they additionally comprise 0.01 to 5% by weight, preferably 0.02 to 4% by weight, particularly preferably 0.05 to 3% by weight and in particular 0.1 to 1.5% by weight, of a polymeric thickener, preferably from the group of polyurethanes or of modified polyacrylates, particular preferably thickeners of the formula IV

IV

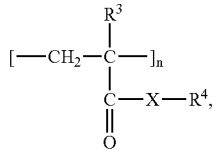

in which $R^3$ is H or a branched or unbranched $C_{1-4}$-alk(en)yl radical, X is N—$R^5$ or 0, $R^4$ is an optionally alkoxylated branched or unbranched, possibly substituted $C_{8-22}$-alk(en)yl radical, $R^5$ is H or $R^4$ and n is a natural number.

Solid supply forms of the dishwasher detergent according to the invention are, for example, finely to coarsely granular powders as are obtained, for example, by spray-drying or granulation, compacted substance mixtures from roll compaction, but also solidified melts or moldings obtained by extrusion or tableting. Within the scope of the present invention, such moldings have virtually all configurations which can be usefully handled, such as, for example, in the shape of a slab, in rod or bar form, a cube, a cuboid and corresponding spatial element with even side surfaces, and in particular cylindrical configurations with circular or oval cross section. This last configuration includes the presentation form of the actual tablet to compact cylinder sections with a height to diameter ratio above 1. Preferred tableted or extruded compositions within the scope of the present invention have two or more phases which can differ, for example, by virtue of their composition, their fraction of the total volume of the molding and/or their optical appearance.

The phases of such multiphase moldings may additionally be characterized by a different dissolution behavior in aqueous phase. Such moldings are suitable for the time-controlled release of certain ingredients (controlled release), for example in certain wash cycles of the dishwasher program. In a preferred embodiment, one of the phases of the molding has, as the main constituent, meltable or softenable substances from the group of waxes, paraffins and/or polyalkylene glycols. Furthermore, it has proven advantageous if the molding or molding constituent comprising these meltable or softenable substances is at least largely insoluble in water. The solubility in water should not exceed about 10 mg/l at a temperature of about 30° C. and should preferably be less 5 mg/l. In such cases the meltable or softenable substances should, however, have the lowest possible solubility in water, including in water at elevated temperature, in order to avoid as far as possible a temperature-dependent release of the active substances. The release of the active substance takes place in this way when the melting or softening point is reached.

As already mentioned at the start, the incorporation of magnesium and/or zinc salts of organic acids according to the invention into the dishwasher detergents according to the invention does not presuppose any limitation with regard to the supply forms or the formulations of these compositions. Within the scope of the present invention, dishwasher detergents can therefore be prepared either in solid or in liquid form.

Within the scope of this application, however, preference is given to dishwasher detergents according to the invention which comprise the described magnesium and/or zinc salts for glass corrosion protection, these salts being present in a formulated form such that they can be safely and reliably metered into a dishwasher detergent, even in small amounts, and furthermore do not separate in a completely formulated pulverulent or granular dishwasher detergent.

This application thus further preferably provides a dishwasher detergent according to the invention characterized in that one or more magnesium and/or zinc salt(s) is/are present in particulate form and in a, form formulated with one or more further active and/or builder substances.

Since the zinc and/or magnesium salts only constitute a small weight fraction of preferred dishwasher detergents, a compounding based on their "dilution effect" simplifies the dosing of these salts in the manufacture of dishwasher detergents according to the invention. However, even in the case where a composition according to the invention in the form of a special product for glass corrosion protection is only added to a standard commercial detergent by the consumer, the dosing is made easier as a result of the compounding. The advantages of compounding arise entirely independently of whether the dishwasher detergent to which the corresponding compounds are added is solid, liquid or in the form of a gel.

Solid supply forms of the dishwasher detergent according to the invention comprise, for example, finely to coarsely granular powders, as are obtained, for example, by spray-drying or granulation. Powders of this type can be marketed as a commercial product or be used as a premix for the compaction, for example for the tableting and generally have a particle size in the range from 0.1 to 10 mm. In order to prevent this powder separating from the added magnesium and/or zinc salt compounds, it is preferred for these compounds to have a particle size comparable with that of the powders.

The present application thus preferably provides a dishwasher detergent, characterized in that the particle size of the magnesium and/or zinc salts formulated with one or more active and/or builder substances is 0.1 to 10 mm, preferably 0.2 to 8 mm and in particular 0.5 to 5 mm, with preferred particulate compounds additionally having a density of from 0.1 to 2.0 g/cm$^2$, preferably from 0.2 to 1.6 g/cm$^3$ and in particular from 0.4 to 1.2 g/cm$^3$, to prevent separation processes.

Dishwasher detergents preferred according to the invention are characterized, in particular, in that the particles of the magnesium and/or zinc salts formulated with one or more active and/or builder substances comprise a weight fraction of these magnesium and/or zinc salt(s) of from 0.1 to 80% by weight, particularly preferably from 0.2 to 70% by weight and especially preferably from 0.5 to 60% by weight, in each case based on the total weight of the formulated magnesium and/or zinc salts.

The abovementioned particulate compounds are obtained, according to the invention preferably by spray-drying and/or granulation and/or extrusion and/or roll compaction and/or tableting and/or solidification and/or crystallization, but in particular by spray-drying and/or granulation.

During spray-drying, in a first step of the process, an aqueous slurry is prepared which, besides the magnesium and/or zinc salts according to the invention, may comprise further thermally stable active and/or filter substances which neither volatilize nor decompose under the conditions of spray-drying, and this slurry is then conveyed to the spray tower by means of pumps and sprayed via nozzles located in the top of the tower. Rising hot air dries the slurry and evaporates the adhering water, meaning that the detergent constituents are obtained as fine powders at the tower outlet. Further temperature-labile constituents, such as, for example, bleaches or fragrances, may be added to these, as required.

Apart from the spray-drying described above, the formulation of compositions according to the invention can also take place by a granulation process, particular preference being given to a fluidized-bed process in which finely particulate bed material which, besides the magnesium and/or zinc salts according to the invention, can comprise further active and/or builder substances, lying on horizontal, perforated bases is passed through from below by gases (e.g. hot air). Under certain flow conditions, a state is established which mimics that of a boiling liquid; the layer throws up bubbles, and the particles of the bed material are located within the layer in a constant, swirling to and fro motion and thus remain in suspended form to a certain extent. The large surface area of the swirling material then permits, for example, the reaction with further substances, such as solvents, solutions of active and/or builder substances, liquid active substances, but also further ingredients which are in the form of a solid at room temperature, but soften at least on the surface by increasing the temperature and/or adding very limited amounts of liquid additives and/or form a stickiness and adhesiveness under the influence of temperature. Typical examples of the above-mentioned substances are water, and aqueous solutions, it being possible, for example, to also use aqueous solutions of the magnesium and/or zinc salts according to the invention, surfactant compounds which are liquid or solid at room temperature, in particular nonionic surfactants, or else polymer compounds of synthetic and/or natural origin, for example (co)polymeric catboxylates.

A further procedure preferred for the granulation is the use of mixers/compacters, as are provided for this purpose by Lödige as well as by other suppliers and which are suitable in a particular manner for the production of particles formulated according to the invention since they offer the consumer, as the result of varying different process parameters, such as rotary speed of the mixer, the residence time of the individual components, the metering time of individual components during the mixing operation, the geometry of the mixing elements used or the energy input, the possibility of targeted control of the product properties of the resulting granulates. The particle size and/or density of granulates can also be influenced in a targeted manner in this way, and the formation of magnesium and/or zinc salts according to the invention with one or more further active and/or builder substance(s) in the above-mentioned mixers/compacters is therefore particularly preferred within the scope of the present invention.

Finally, there is the possibility of mixing the magnesium and/or zinc salts according to the invention mentioned above with further individual components which differ with respect to their bulk densities only slightly from those of said salts. Such mixtures have only slight separation tendencies of the components upon storage, transportation and processing and are therefore likewise suitable in a particular manner for the desired safe and reliable metering of the magnesium and/or zinc salts according to the invention. Within the scope of the present invention, preference is therefore given to mixtures of magnesium and/or zinc salts according to the invention with further active and/or builder substances, characterized in that the bulk density of the individual components mixed with one another differ by at most 200 g/l, preferably by at most 150 g/l, preferably by at most 100 g/l and in particular by at most 50 g/l.

The builder and/or active substances which can be used in the above-described formulation of preferred dishwasher detergents according to the invention include, besides other customary constituents of detergents, for example builders (inc. cobuilders), surfactants, bleaches, bleach activators, enzymes, dyes, fragrances, corrosion protectants or polymers. A further description of these active and/or builder substances is given in the sections below.

Whereas all said substances are in general suitable as active and/or builder substances for the formulation of magnesium and/or zinc salts according to the invention, within the scope of the present invention, however, particular preference is given to those dishwasher detergents in which the magnesium and/or zinc salts formulated with one or more active and/or builder substances comprise active and/or builder substances from the group of phosphates, carbonates, hydrogencarbonates, sulfates, silicates, citrates, citric acid, acetates, preferably in amounts of from 20 to 99% by weight, particularly preferably from 30 to 98% by weight and especially preferably from 40 to 95% by weight, in each case based on the total weight of the formulated magnesium and/or zinc salts.

In order to avoid repetitions with regard to the phosphates, carbonates, hydrogencarbonates and silicates, reference is made to the corresponding statements in the sections below.

Within the scope of the present invention, sulfates are referred to as salts of sulfuric acid which arise when one of the two H ions, or both H ions, of the $H_2SO_4$ molecule are replaced by metal ion radicals ($M^I$). In the first case, the readily water-soluble, readily melting "acidic sulfate" (hydrogensulfates) of the general formula $M^IHSO_4$ arise. In the second case, sulfates, "neutral" or normal sulfates, $M^I{}_2SO_4$ are obtained, which in most cases crystallize with water of crystallization, have a tendency to form double salts and are likewise usually readily soluble in water. Preferred metal ions are the alkali metal ions and the ammonium ions, but in particular the sodium and/or potassium and/or ammonium ion.

Citrates and acetates are the salts of citric acid and of acetic acid, respectively, where in the case of the citrates one, two or three H ions of the original citric acid may be replaced by metal ions. Suitable metal ions are, in particular, sodium and/or potassium ions, and the ammonium ion.

As is detailed in the context of the preferred formulation processes, surfactants, in particular nonionic surfactants, or (co)polymeric carboxylates are suitable in a particular manner as active and/or builder substances for the formulation of magnesium and/or zinc salts according to the invention. The present application thus further provides dishwasher detergents in which the magnesium and/or zinc salts formulated with one or more active and/or builder substances comprise one or more active and/or builder substance(s) from the group of surfactants, preferably nonionic surfactants, and/or polymeric carboxylates, in particular polysulfocarboxylates.

For a further description of particularly preferred surfactants or polymeric carboxylates and of polysulfocarboxylates, reference may be made again to the statements in the sections below.

The magnesium and/or zinc salts formulated with one or more active and/or builder substances and present in the form of particles may be provided with a coating for protection from environmental influences and thus for improving their storage stability or for influencing the dissolution behavior. Coating materials and processes for coating particulate compositions are widely described in the literature and will be described below only with respect to particularly preferred embodiments.

Particular preference is given to the use of meltable or softenable substances as coating material for the magnesium and/or zinc salts formulated according to the invention. (The term "coating" within the scope of the present invention means, as well as the coating of individual or two or more sides or surfaces of a particulate composition formulated according to the invention, also a complete coating, i.e. the enclosure of a particulate object.) Meltable substances whch are preferred according to the invention have a melting point above 30° C. If magnesium and/or zinc salts formulated according to the invention are to be released at different times, for example during the different wash cycles of a cleaning process, then this may take place, for example, through the use of different meltable coatings which differ with respect to their melting point, the melting points of these substances preferably being matched to the temperature course of this cleaning process and the difference in the melting points sufficing to ensure separate dissolution of the individual matrices or coatings. If, for example, it is intended to release magnesium and/or zinc salts formulated according to the invention at different times, then preference is given to those substances for the different coatings which differ with regard to their melting point by at least 5° C., preferably by 10° C., particularly preferably by 15° C. and especially by at least 20° C., it also being preferred that the melting point of at least one of the meltable substances which form a coating is less than 30° C., while the melting point of at least one other substance which form a further matrix or coating is above 30° C.

Such coatings can be applied, for example, by immersion, spraying or circulation in a drum coater or coating pan. For the coatings, particular preference is given to using waxes, paraffins, polyalkylene glycols etc. as meltable or softenable substances.

It has proven advantageous if the meltable or softenable substances do not exhibit a sharply defined melting point, as usually occurs in the case of pure, crystalline substances, but instead have a melting range which covers, under certain circumstances, several degrees Celsius. The meltable or softenable substances preferably have a melting range between about 45° C. and about 75° C. In the present case, this means that the melting range is within the given temperature interval, and does not define the width of the melting range. The width of the melting range is preferably at least 1° C., preferably about 2 to about 3° C.

The abovementioned properties are usually satisfied by so-called waxes. "Waxes" is understood as meaning a series of natural or artificially obtained substances which generally melt above 40° C. without decomposition, and are of relatively low-viscosity and are non-stringing at just a little above the melting point. They have a highly temperature-dependent consistency and solubility.

Depending on their origin, the waxes are divided into three groups: the natural waxes, chemically modified waxes and the synthetic waxes.

Natural waxes include, for example, plant waxes, such as candelilla wax, carnauba wax, Japan wax, asparto grass wax, cork wax, guaruma wax, rice germ oil wax, sugarcane wax, ouricury wax, or montan wax, animal waxes, such as beeswax, shellac wax, spermaceti, lanolin (wool wax), or uropygial grease, mineral waxes, such as ceresin or ozokerite (earth wax), or petrochemical waxes, such as petrolatum, paraffin waxes or microcrystalline waxes.

Chemically modified waxes include, for example, hard waxes, such as montan ester waxes, sassol waxes or hydrogenated jojoba waxes.

Synthetic waxes are generally understood as meaning polyalkylene waxes or polyalkylene glycol waxes. Meltable or softenable substances which can be used for the masses hardenable by cooling are also compounds from other classes of substance which satisfy said requirements with regard to the softening point. Synthetic compounds which have proven suitable are, for example, higher esters of phthalic acid, in particular dicyclohexyl phthalate, which is available commercially under the name Unimoll® 66 (Bayer AG). Also suitable are synthetically prepared waxes from lower carboxylic acids and fatty alcohols, for example dimyristyl tartrate, which is available under the name Cosmacol® ETLP (Condea). Conversely, synthetic or partially synthetic esters of lower alcohols with fatty acids from native sources may also be used. This class of substance includes, for example, Tegin® 90 (Goldschmidt), glycerol monostearate palmitate. Shellac, for example Schellack- KPS-Dreiring-SP (Kalkhoff GmbH) can also be used according to the invention as meltable or softenable substances.

Also covered by waxes within the scope of the present invention are, for example, the so-called wax alcohols. Wax alcohols are relatively high molecular weight, water-insoluble fatty alcohols having generally about 22 to 40 carbon atoms. The wax alcohols occur, for example, in the form of wax esters of relatively high molecular weight fatty acids (wax acids) as the major constituent of many natural waxes. Examples of wax alcohols are lignostearyl alcohol (1-tetracosanol), cetyl alcohol, myristyl alcohol or melissyl alcohol. The enclosure of the magnesium and/or zinc salts formulated according to the invention can optionally also comprise wool wax alcohols, which is understood as meaning triterpenoic and steroid alcohols, for example lanolin, which is available, for example, under the trade name Argowax® (Pamentier & Co). Within the scope of the present invention, further constituents of the meltable or softenable substances which may be used, at least in part, are fatty acid glycerol esters or fatty acid alkanolamines, but also, if desired, water-insoluble or only sparingly water-soluble polyalkylene glycol compounds.

Particularly preferred meltable or softenable substances are those from the group of polyethylene glycols (PEG) and/or polypropylene glycols (PPG), preference being given to polyethylene glycols with molar masses between 1500 and 36 000, particular preference being given to those with molar masses from 2000 to 6000, and special preference being given to those with molar masses from 3000 to 5000. Corresponding processes which are characterized in that the plastically deformable mass(es) comprises/comprise at least one substance from the group of polyethylene glycols (PEGs) and/or polypropylene glycols (PPGs) are also preferred.

Preference is given here to coatings which comprise, as the sole meltable or softenable substances, propylene glycols (PPGs) and/or polyethylene glycols (PEGs). Polypropylene glycols (abbreviation PPGs) which can be used according to the invention are polymers of propylene glycol which satisfy the general formula below

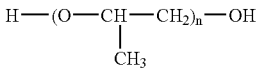

where n can assume values between 10 and 2000. Preferred PPGs have molar masses between 1000 and 10 000, corresponding to values of n between 17 and about 170.

Polyethylene glycols (abbreviations PEGs) which can be preferably used according to the invention are polymers of ethylene glycol which satisfy the general formula

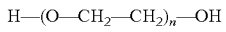

where n can assume values between 20 and about 1000. The above-mentioned preferred molecular weight ranges correspond here to preferred ranges of the value n in formula IV from about 30 to about 820 (precisely: from 34 to 818), particularly preferably from about 40 to about 150 (precisely: from 45 to 136) and in particular from about 70 to about 120 (precisely: from 68 to 113).

In a further preferred embodiment, the coating materials comprise paraffin wax.

Compared with the other named natural waxes, paraffin waxes have the advantage within the scope of the present invention that in an alkaline detergent environment no hydrolysis of the waxes takes place (as is to be expected, for example, in the case of the wax esters), since paraffin wax does not contain hydrolyzable groups.

Paraffin waxes consist primarily of alkanes, and low fractions of iso- and cycloalkanes. The paraffin to be used according to the invention preferably essentially has no constituents with a melting point of more than 70° C., particularly preferably of more than 60° C. Below this melting temperature in the detergent liquor, fractions of high-melting alkanes in the paraffin may leave behind undesired wax residues on the surfaces to be cleaned or on the ware to be cleaned. Such wax residues generally lead to an unattractive appearance of the cleaned surface and should therefore be avoided.

Meltable or softenable substances preferably to be processed comprise at least one paraffin wax with a melting range from 50° C. to 60° C., preferred coating materials being characterized in that they comprise a paraffin wax with a melting range from 50° C. to 55° C.

Preferably, the content of solid alkanes, isoalkanes and cycloalkanes which are solid at ambient temperature (generally about 10 to about 30° C.) in the paraffin wax used are as high as possible. The larger the amount of solid wax constituents in a wax at room temperature, the more useful the wax for the purposes of the present invention. As the proportion of solid wax constituents increases, so does the resistance of the process end-products toward impacts or friction on other surfaces, resulting in relatively long-lasting protection, High proportions of oils or liquid wax constituents can lead to a weakening of the coating, as a result of which pores are opened and the active substances are exposed to the ambient influences.

Besides paraffin as the main constituent, the meltable or softenable substances may also comprise one or more of the abovementioned waxes or wax-like substances. In a further preferred embodiment of the present invention, the mixture forming the meltable or softenable substances should be such that the mass and the coating formed therefrom are at least largely water-insoluble. At a temperature of about 30° C., the solubility in water should not exceed about 10 mg/l and should preferably be below 5 mg/l.

In such cases, however, the meltable or softenable substances should have the lowest possible solubility in water, even in water at elevated temperature, in order, as far as possible, to avoid temperature-dependent release of the active substances.

Preferred coating materials to be processed according to the invention are characterized in that they comprise, as meltable or softenable substances, one or more substances with a melting range from 40° C. to 75° C. in amounts of from 6 to 30% by weight, preferably from 7.5 to 25% by weight and in particular from 10 to 20% by weight, in each case based on the weight of the coating material.

A starting point for the technical translation of such a "controlled release" concept is the temperature dependency of the solubility of different ingredients or coating materials, in particular in those processes in which temperature curves are passed through, thus, for example, during the sterilization and pasteurization of foods, or else in washing and cleaning processes which may equally have two or more heating and cooling phases. In particular, in washing and cleaning processes, it may be advantageous to add, in a controlled manner, different active ingredients, such as, for example, fabric softeners or rinse aids, in the last process stage, e.g. the last rinse cycle of a washing machine or in the last rinse cycle of a dishwasher.

A group of coating materials which are used as so-called "inverse temperature switches" with the aim of the controlled release of active ingredients and are particularly suitable within the scope of the present invention for coating magnesium and/or zinc salts formulated according to the invention are the LCST polymers, substances which have a better solubility at low temperatures than at higher temperatures. LCST polymers are also referred to as substances with a lower critical separation temperature (LCST). With the help of LCST polymer-containing coatings, it is possible to release, in a controlled manner, active ingredients following a heat treatment upon entering the cooling phase and falling below the lower critical separation temperature (LCST).

LCST substances are generally polymers. Depending on the application conditions, the lower critical separation temperature should be between room temperature and the temperature of the heat treatment, for example between 20° C., preferably 30° C. and 100° C., in particular between 30° C. and 50° C. Suitable LCST substances are preferably cellulose derivatives, mono- or di-n-alkylated acrylamides, copolymers of mono- or di-n-substituted acrylamides with acrylamides and/or acrylates or acrylic acids and/or polyvinyl caprolactam, preference being given in particular to the alkylated and/or hydroxyalkylated polysaccharides, cellulose ethers, polyisopropylacrylamides, copolymers of polyisopropylacrylamide, and blends of these substances.

Examples of alkylated and/or hydroxyalkylated polysaccharides are methylhydroxypropylmethylcellulose (MHPC), ethyl(hydroxyethyl)cellulose (EHEC), hydroxypropylcellulose (HPC), methylcellulose (MC), ethylcellulose (EC), carboxymethylcellulose (CMC), carboxymethylmethylcellulose (CMMC)-, hydroxybutylcellulose (HBC), hydroxybutylmethylcellulose (HBMC), hydroxyethylcellulose (HEC), hydroxyethylcarboxymethylcellulose (HECMC), hydroxyethylethylcellulose (HEEC), hydroxypropylcellulose (HPC), hydroxypropylcarboxymethylcellulose (HPCMC), hydroxyethylmethylcellulose (HEMC), methylhydroxyethylcellulose (MHEC), methylhydroxyethylpropylcellulose (MHEPC), methylcellulose (MC) and propylcellulose (PC) and mixtures thereof, preference being given to carboxymethylcellulose, methylcellulose, methylhydroxyethylcellulose and methylhydroxypropylcellulose, and the alkali metal salts of CMC and the slightly ethoxylated MC or mixtures of the above.

Further examples of LCST substances are cellulose ethers, and mixtures of cellulose ethers with carboxymethylcellulose (CMC). Further polymers which exhibit a lower critical separation temperature in water and are likewise suitable are polymers of mono- or di-N-alkylated acrylamides, copolymers of mono- or di-N-substituted acrylamides with acrylates and/or acrylic acids or mixtures of interpenetrating networks of the abovementioned (co)polymers. Also suitable are polyethylene oxide or copolymers thereof, such as ethylene oxide/propylene oxide copolymers and graft copolymers of alkylated acrylamides with polyethylene oxide, polymethacrylic acid, polyvinyl alcohol and copolymers thereof, polyvinyl methyl ether, certain proteins, such as poly(VATGW), a repeat unit in the natural protein elastin and certain alginates. Mixtures of the polymers with salts or surfactants can likewise be used as LCST substance. By means of such additives or by way of copolymerization with more hydrophilic or more hydrophobic comonomers it is possible to modify the LCST (lower critical separation temperature) accordingly.

In order to avoid the LCST layer dissolving in the period prior to the onset of the heat treatment, it can optionally be provided with a further coating which starts to dissolve or to melt only when the heat treatment starts. For such a second coating, the coating materials mentioned above are particularly suitable.

The application of a coating to compositions with LCST coating which should effectively prevent softening or initial dissolution of the function layer within the first minutes of the wash cycle and therefore start to dissolve or melt only upon the onset of the heat treatment is possible, for example, by immersion processes (immersion of the particles into a melt) or spraying of the particles with the melt or the solution of the coating material in a drum coater. Finally, it is particularly preferred to provide magnesium and/or zinc salt compounds according to the invention which have a LCST coating with a coating material in the form of a dispersion, preferably a PIT emulsion or a suspension which comprises (1) 1 to 80% by weight of a coating which is solid at 200C,
(2) 0.1 to 30% by weight of a dispersant and
(3) 0.1 to 30% by weight of a codispersant, in each case based on the mixture of components (1) to (3), in 15 to 99% by weight of water, based on the dispersion. In this connection, it is important for the preparation of the dispersion that the ratio of components (2) and (3) is in the range from 0.5:1 to 20:1.

PIT emulsion is the term used for emulsions which undergo phase inversion at certain temperatures (PIT), where the phase inversion temperature characterizes the transition of the surfactant solubility of water to oil or from oil to water. Thus, for example, it is known that oil-in-water emulsions (O/W emulsions), which are prepared and stabilized with nonionogenic emulsifiers invert upon heating to water-in-oil emulsions (W/O emulsions). This operation is generally reversible, i.e. upon cooling the original emulsion type is reformed. It is known that emulsions which pass through a phase inversion during their preparation are characterized by particular stability and finely divided nature, whereas those which are prepared above the phase inversion temperature are less finely divided. Within the scope of the present invention, it is particularly preferred when the dispersions (preferably PIT emulsions or suspensions) intended for the coating have a particle size between 0.05 and 10 μm, and preferably between 0.1 and 5 μm and particularly preferably between 0.15 and 2 μm, where the particle size refers to the size of the particles of the dispersed phase.

Suitable coatings, i.e. component (1), are all substances which are solid at 20° C. (for example kneadable or coarsely to finely crystalline) and only convert to a pasty to flowable low-viscosity state above about 40° C. without decomposition. Preferred coatings are primarily lipids, in particular higher-chain hydrocarbons (e.g. paraffinum durum) and/or wax esters (e.g. cetyl palmitate).

Preferred dispersants, i.e. component (2) are hydrophilic nonionic dispersants, particularly preferably hydrophilic nonionic dispersants which have an HLB value of from 8 to 18. The HLB value (hydrophilic-lipophilic balance) should be understood as meaning a value which can be calculated in accordance with $$HLB=(100-L)/5$$

where L is the weight fraction of the lipophilic groups, i.e. the fatty alkyl or fatty acyl groups in percent in the ethylene oxide addition products.

Preferably, ethylene oxide addition products onto $C_{16-22}$-fatty alcohols are suitable. Such standard commercial products represent mixtures of homologous polyglycol ethers of the starting fatty alcohols. Dispersants which may be used are also ethylene oxide addition products onto partial esters from a polyol having 3 to 6 carbon atoms and $C_{14-22}$-fatty acids. Particularly suitable dispersants (2), are fatty alcohol polyglycol ethers of the general formula $$R^1—(O—CH_2—CH_2)_n—OH,$$

in which $R^1$ is a saturated or unsaturated, straight-chain or branched hydrocarbon radical having 8 to 22 carbon atoms, preferably 12 to 22 carbon atoms and n is an integer from 10 to 50, preferably from 10 to 30, and also addition products of from 4 to 20 mol of ethylene oxide onto one or more fatty acid partial glycerides.

Fatty acid partial glycerides of saturated or unsaturated fatty acids having 10 to 20 carbon atoms are understood here as meaning technical-grade mixtures of fatty acid mono-, di- and triglycerides which can be obtained by esterification of 1 mol of glycerol with 1 to 2 mol of a $C_{10-20}$-fatty acid or by transesterification of 1 mol of a $C_{10-20}$-fatty acid triglyceride with 0.5 to 2 mol of glycerol.

Preferably suitable dispersants are addition products of from 8 to 12 mol of ethylene oxide onto saturated fatty alcohols having 16 to 22 carbon atoms.

In addition to the dispersant (2), the preparation of a dispersion which is suitable for the abovementioned coating requires the presence of a codispersant (3), preferably a hydrophobic codispersant. Preferred codispersants are, in particular, those of the type of the fatty alcohols having 16 to 22 carbon atoms, e.g. cetyl alcohol, stearyl alcohol, arachidyl alcohol or behenyl alcohol, or mixtures of these alcohols, as are obtained in the industrial hydrogenation of vegetable or animal fatty acids having 16 to 22 carbon atoms or of the corresponding fatty acid methyl esters. Further particularly preferred codispersants (3) are partial esters from a polyol having 3 to 6 carbon atoms and fatty acids having 14 to 22 carbon atoms. Such partial esters are, for example, the monoglycerides of palmitic and/or stearic acid, the sorbitan mono- and/or diesters of myristic acid, palmitic acid, stearic acid or of mixtures of these fatty acids, the monoesters of trimethylolpropane, erythritol or pentaerythritol and saturated fatty acids having 14 to 22 carbon atoms. Monoesters are also understood as meaning the technical-grade monoesters which are obtained by esterification of 1 mol of polyol with 1 mol of fatty acid and which represent a mixture of monoester, diester and unesterified polyol.

Particularly preferred codispersants are cetyl alcohol, stearyl alcohol or a glycerol, sorbitan or trimethylolpropane monoester of a fatty acid having 14 to 22 carbon atoms or mixtures of these substances.

As already mentioned, the ratio of components (2) and (3) is a parameter critical for the preparation of the dispersion. The ratio of (2) and (3) should be in the range from 0.5:1 to 20:1, preference being given to a range from 1:1 to 10:1. In a particularly preferred variant of the process according to the invention, the ratio of components (2) and (3) is adjusted such that the phase inversion temperature of the total composition is above the melting point of the solid coating (1) and below 100° C.

To apply the dispersions, preferably the PIT emulsions or the suspensions, to the respective substrates, all devices with which coatings can be prepared from an aqueous solution are suitable. Relatively large objects can be sprayed directly with spray nozzles, preferably dual material nozzles, with simultaneous or subsequent drying. Relative small objects can be sprayed in drum coaters, as are customary for example, in pharmacy, or coating pans.

The homogeneity and diffusion closeness of coatings prepared in this way using dispersions (preferably PIT emulsions or suspensions) can be further increased by briefly melting the wax layer, for example under a heating lamp.

The present invention therefore preferably provides dishwasher detergents characterized in that the magnesium and/or zinc salts formulated with one or more active and/or builder substances additionally have a coating.

Apart from through the choice of a suitable coating, the dissolution behavior of magnesium and/or zinc salts formulated according to the invention can also be influenced by the above-mentioned compacting processes. In this connection, besides the level of pressure used and the use of auxiliarities, such as, for example, of binders, the choice of the coformulated active and/or builder substances, in particular, is of great importance. For example, compacted silicates, in particular disilicates, and/or polycarboxylates and/or mixtures of different polycarboxylates based on their delayed dissolution/dispersion and based on any gelling of the substances or substance mixtures which arises in aqueous liquor are particularly suitable as "donor substances" for the magnesium and/or zinc salts according to the invention.

For a detailed description of the formulation of silicates and polycarboxylates which can be used, reference is made to the sections below.

In a particular embodiment of the present invention, it is finally preferred to meter in a composition comprising the zinc and/or magnesium salts of an organic acid, preferably of an organic carboxylic acid, to the washing process in addition to a standard commercial detergent, for example in the form of a special glass protection agent. Such a dosing can take place here either prior to the start of each wash program, or else in the form of a donor product which brings about continuous release of the zinc and/or magnesium salts of organic acids according to the invention over a number of wash cycles.

Preferred dishwasher detergents according to the invention comprise, besides the builders (including cobuilders) and the zinc and/or magnesium salts of organic acids, also one or more substances from the group of surfactants, bleaches, bleach activators, enzymes, dyes, fragrances, corrosion protectants, polymers, or a further customary constituent of detergents and cleaners. These ingredients are described below.

Builders

According to the present invention, all builders customarily used in detergents and cleaners can be incorporated into the washing and cleaning detergents and cleaners, in particular silicates, carbonates, organic cobuilders and also the phosphates.

Suitable crystalline, layered sodium silicates have the general formula $NaMSi_xO_{2x+1}.H_2O$, where M is sodium or hydrogen, x is a number from 1.9 to 4 and y is a number from 0 to 20, and preferred values for x are 2, 3 or 4. Preferred crystalline phyllosilicates of the given formula are those in which M is sodium and x assumes the values 2 or 3. In particular, both 1- and also δ-sodium disilicates $Na_2Si_2O_5.yH_2O$ are preferred.

It is also possible to use amorphous sodium silicates with an $Na_2O:SiO_2$ modulus of from 1:2 to 1:3.3, preferably from 1:2 to 1:2.8 and in particular from 1:2 to 1:2.6, which have delayed dissolution and secondary detergency properties. The dissolution delay relative to conventional amorphous sodium silicates can have been induced in various ways, for example by surface treatment, compounding, compaction/ compression or by overdrying. Within the scope of this invention, the term "amorphous" is also understood as meaning "X-ray-amorphous". This means that in X-ray diffraction experiments, the silicates do not give sharp X-ray reflections typical of crystalline substances, but, at best, one or more maxima of the scattered X-ray radiation, which have a width of several degree units of the angle of diffraction. However, it is very possible that particularly good builder properties may result if, in electron diffraction experiments, the silicate particles give poorly defined or even sharp diffraction maxima. This is to be interpreted to the effect that the products have microcrystalline regions of size 10 to a few hundred nm, values up to a maximum of 50 nm and in particular up to a maximum of 20 nm being preferred. Particular preference is given to the compressed/compacted amorphous silicates compounded amorphous silicates and overdried X-ray-amorphous silicates.

Carbonates which may be present in the compositions are either the monoalkali metal salts or the dialkali metal salts of carbonic acid, or else sesquicarbonates. Preferred alkali metal ions are sodium and/or potassium ions. In one embodiment, it may be preferred to mix in the carbonate and/or bicarbonate separately or subsequently at least partially as a further component. Compounds of, for example, carbonate, silicate and optionally further auxiliaries, such as, for example, anionic surfactants or other, in particular organic, builder substances, may also be present as a separate component in the finished compositions.

It is of course also possible to use the generally known phosphates as builder substances, provided such a use should not be avoided for ecological reasons. Of the large number of commercially available phosphates, the alkali metal phosphates, particularly preferably pentasodium or pentapotassium triphosphate (sodium or potassium tripolyphosphate), are of the greatest importance in the detergents and cleaners industry.

Alkali metal phosphates is the collective term for the alkali metal (in particular sodium and potassium) salts of the various phosphoric acids, among which metaphosphoric acids $(HPO_3)_n$ and orthophosphoric acid $H_3PO_4$, in addition to higher molecular weight representatives, may be differentiated. The phosphates combine a number of advantages: they act as alkali carriers, prevent limescale film on machine components or limescale deposits on the ware and additionally contribute to the cleaning performance.

Sodium dihydrogenphosphate, $NaH_2PO_4$, exists as the dihydrate (density 1.91 $gcm^{-3}$, melting point 60°) and as the monohydrate (density 2.04 $gcm^{-3}$). Both salts are white powders which are very readily soluble in water, which lose the water of crystallization upon heating and undergo conversion at 200° C. into the weakly acidic diphosphate (disodium hydrogendiphosphate, $Na_2H_2P_2O_7$), at a higher temperature into sodium trimetaphosphate ($Na_3P_3O_9$) and Maddrell's salt (see below). $NaH_2PO_4$ is acidic; it is formed if phosphoric acid is adjusted to a pH of 4.5 using sodium hydroxide solution and the slurry is sprayed. Potassium dihydrogenphosphate (primary or monobasic potassium phosphate, potassium biphosphate, PDP), $KH_2PO_4$, is a white salt of density 2.33 $gcm^{-3}$, has a melting point of 253° [decomposition with the formation of potassium polyphosphate $(KPO_3)_x$] and is readily soluble in water.

Disodium hydrogenphosphate (secondary sodium phosphate), $Na_2HPO_4$, is a colorless, very readily water-soluble crystalline salt. It exists in anhydrous form and with 2 mol of water (density 2.066 $gcm^3$, water loss at 950), 7 mol of water (density 1.68 $gcm^{-3}$, melting point 480 with loss of $5H_2O$) and 12 mol of water (density 1.52 $gcm^{-3}$, melting point 35° with loss of $5H_2O$), becomes anhydrous at 1000 and converts to the diphosphate $Na_4P_2O_7$ upon more severe heating, Disodium hydrogenphosphate is prepared by neutralizing phosphoric acid with soda solution using phenolphthalein as indicator. Dipotassium hydrogenphosphate (secondary or dibasic potassium phosphate), $K_2HPO_4$, is an amorphous white salt which is readily soluble in water.

Trisodium phosphate, tertiary sodium phosphate, $Na_3PO_4$, are colorless crystals which as the dodecahydrate have a density of 1.62 $gcm^{-3}$ and a melting point of 73–76° C. (decomposition), as the decahydrate (corresponding to 19–20% of $P_2O_5$) have a melting point of 100° C. and in anhydrous form (corresponding to 39–40% of $P_2O_5$) have a density of 2.536 $gcm^{-3}$. Trisodium phosphate is readily soluble in water with an alkaline reaction and is prepared by evaporative concentration of a solution of exactly 1 mol of disodium phosphate and 1 mol of NaOH. Tripotassium phosphate (tertiary or tribasic potassium phosphate), $K_3PO_4$, is a white, deliquescent, granular powder of density 2.56 $gcm^{-3}$, has a melting point of 13400 and is readily soluble in water with an alkaline reaction. It is produced, for example, when Thomas slag is heated with charcoal and potassium sulfate. Despite the relatively high price, the more readily soluble and therefore highly effective potassium phosphates are often preferred in the cleaners industry over corresponding sodium compounds.

Tetrasodium diphosphate (sodium pyrophosphate), $Na_4P_2O_7$, exists in anhydrous form (density 2.534 $gcm^{-3}$, melting point 988°, 8800 also reported) and as the decahydrate (density 1.815–1.836 $gcm^{-3}$, melting point 94° with loss of water). Both substances are colorless crystals which are soluble in water with an alkaline reaction. $Na_4P_2O_7$ is formed when disodium phosphate is heated at >2000 or by reacting phosphoric acid with soda in the stoichiometric ratio and dewatering the solution by spraying. The decahydrate complexes heavy metal salts and water hardness constituents and therefore reduces the hardness of the water. Potassium diphosphate (potassium pyrophosphate), $K_4P_2O_7$, exists in the form of the trihydrate and is a colorless, hygroscopic powder with a density of 2.33 $gcm^{-3}$ which is soluble in water, the pH of the 1% strength solution at 25° being 10.4.

Condensation of the $NaH_2PO_4$ or of the $KH_2PO_4$ gives rise to higher molecular weight sodium and potassium phosphates, among which it is possible to differentiate between cyclic representatives, the sodium and potassium metaphosphates, and catenated types, the sodium and potassium polyphosphates. For the latter, in particular, a large number of names are in use: fused or high-temperature phosphates, Graham's salt, Kurrol's and Maddrell's salt. All higher sodium and potassium phosphates are referred to collectively as condensed phosphates.

The industrially important pentasodium triphosphate, $Na_5P_3O_{10}$ (sodium tripolyphosphate), is a nonhygroscopic, white, water-soluble salt which is anhydrous or crystallizes with $6H_2O$ and has the general formula NaO—[P(O)(ONa)—O]$_n$—Na where n=3. About 17 g of the salt free from water of crystallization dissolve in 100 g of water at room temperature, about 20 g dissolve at 60° C., and about 32 g dissolve at 100°; after heating the solution for 2 hours at 100°, about 8% orthophosphate and 15% diphosphate are produced by hydrolysis. In the case of the preparation of pentasodium triphosphate, phosphoric acid is reacted with soda solution or sodium hydroxide solution in the stoichiometric ratio and the solution is dewatered by spraying. Similarly to Graham's salt and sodium diphosphate, pentasodium triphosphate dissolves many insoluble metal compounds (including lime soaps, etc.). Pentapotassium triphosphate, $K_5P_3O_{10}$ (potassium tripolyphosphate), is commercially available, for example, in the form of a 50% strength by weight solution (>23% $P_2O_5$, 25% $K_2O$). The potassium polyphosphates are widely used in the detergents and cleaners industry. There also exist sodium potassium tripolyphosphates, which can likewise be used within the scope of the present invention. These form, for example, when sodium trimetaphosphate is hydrolyzed with KOH:

$$(NaPO_3)_3+2KOH \rightarrow Na_3K_2P_3O_{10}+H_2O$$

These can be used in accordance with the invention in exactly the same way as sodium tripolyphosphate, potassium tripolyphosphate or mixtures of the two; according to the invention, it is also possible to use mixtures of sodium tripolyphosphate and sodium potassium tripolyphosphate or mixtures of potassium tripolyphosphate and sodium potassium tripolyphosphate or mixtures of sodium tripolyphosphate and potassium tripolyphosphate and sodium potassium tripolyphosphate.

Dishwasher detergents preferred within the scope of the present invention comprise no sodium and/or potassium hydroxide. Dispensing with sodium and/or potassium hydroxide as the alkali source has proven particularly advantageous when the zinc salts used are zinc gluconate, zinc formate and zinc acetate.

Cobuilders

Organic cobuilders which may be used in the detergents within the scope of the present invention are, in particular, polycarboxylates/polycarboxylic acids, polymeric polycarboxylates, aspartic acid, polyacetals, dextrins, further organic cobuilders (see below), and phosphonates. These classes of substance are described below.

Organic builder substances which can be used are, for example, the polycarboxylic acids usable in the form of their sodium salts, the term polycarboxylic acids meaning carboxylic acids which carry more than one acid function. Examples of these are citric acid, adipic acid, succinic acid, glutaric acid, malic acid, tartaric acid, maleic acid, fumaric acid, sugar acids, aminocarboxylic acids, nitrilotriacetic acid (NTA), provided such a use is not objectionable on ecological grounds, and mixtures thereof. Preferred salts are the salts of the polycarboxylic acids such as citric acid, adipic acid, succinic acid, glutaric acid, tartaric acid, methylglycinediacetic acid, sugar acids and mixtures thereof.

The acids per se may also be used. In addition to their builder action, the acids typically also have the property of an acidifying component and thus also serve to establish a lower and milder pH of detergents or cleaners. In this connection, particular mention is made of citric acid, succinic acid, glutaric acid, adipic acid, gluconic acid and any mixtures thereof.

Also suitable as builders are polymeric polycarboxylates; these are, for example, the alkali metal salts of polyacrylic acid or of polymethacrylic acid, for example those with a relative molecular mass from 500 to 70 000 g/mol.

The molar masses given for polymeric carboxylates are, within the scope of this specification, weight-average molar masses $M_W$ of the respective acid, which have been determined fundamentally by means of gel permeation chromatography (GPC) using a UV detector. The measurement was made against an external polyacrylic acid standard which, owing to its structural similarity to the polymers under investigation, provides realistic molecular weight values. These figures differ considerably from the molecular weight values obtained using polystyrenesulfonic acids as the standard. The molar masses measured against polystyrenesulfonic acids are usually considerably higher than the molar masses given in this specification.

Suitable polymers are, in particular, polyacrylates which preferably have a molecular mass of from 1000 to 20 000 g/mol. Owing to their superior solubility, preference in this group may be given in turn to the short-chain polyacrylates which have molar masses of from 1000 to 10 000 g/mol and particularly preferably from 1200 to 4000 g/mol.

In the compositions according to the invention, particular preference is given to using either polyacrylates or copolymers of unsaturated carboxylic acids, monomers containing sulfonic acid groups, and optionally further ionic or nonionogenic monomers. The copolymers containing sulfonic acid groups are described in detail below.

However, it is also possible to provide products according to the invention which, being so-called "3 in 1" products, combine the conventional detergent, rinse aid and a salt replacement function. In this regard preference is given to dishwasher detergents according to the invention which additionally comprise 0.1 to 70% by weight of copolymers of i) unsaturated carboxylic acids, ii) monomers containing sulfonic acid groups iii) optionally further ionic or nonionogenic monomers.

These copolymers lead to the parts of dishes treated with such compositions becoming significantly cleaner in subsequent washing operations than parts of dishes which were rinsed with conventional compositions.

An additional positive effect is the shortening of the drying time of the parts of dishes treated with the detergent, i.e. the consumer can take the dishes from the machine earlier and reuse them after the wash program is finished.

The invention is notable for improved "cleanability" of the treated substrates during later washing operations and for a considerable shortening of the drying time compared with comparable products without the use of polymers containing sulfonic acid groups.

For the purposes of the teaching according to the invention, drying time is generally understood as having the literal meaning, i.e. the time which elapses until a surface of the dishes treated in a dishwasher machine has dried, but in particular which elapses until 90% of a surface treated with a cleaning composition or rinse aid in concentrated or diluted form has dried.

For the purposes of the present invention, unsaturated carboxylic acids of the formula VI are preferred as monomer, $$R^1(R^2)C{=}C(R^3)COOH \qquad \text{(VI)},$$

in which $R^1$ to $R^3$, independently of one another, are —H—$CH_3$, a straight-chain or branched saturated alkyl radical having 2 to 12 carbon atoms, a straight-chain or branched, mono- or polyunsaturated alkenyl radical having 2 to 12 carbon atoms, alkyl or alkenyl radicals as defined above and substituted by —$NH_2$, —OH or —COOH, or —COOH or —$COOR^4$, where $R^4$ is a saturated or unsaturated, straight-chain or branched hydrocarbon radical having 1 to 12 carbon atoms.

Among the unsaturated carboxylic acids which can be described by the formula I, particular preference is given to acrylic acid ($R^1{=}R^2{=}R^3{=}H$), methacrylic acid ($R^1{=}R^2{=}H$; $R^3{=}CH_3$) and/or maleic acid ($R^1{=}COOH$; $R^2{=}R^3{=}H$).

In the case of the monomers containing sulfonic acid groups, preference is given to those of the formula VII, $$R^5(R^6)C{=}C(R^7){-}X{-}SO_3H \quad (VII),$$

in which $R^5$ to $R^7$, independently of one another, are —H—$CH_3$, a straight-chain or branched saturated alkyl radical having 2 to 12 carbon atoms, a straight-chain or branched, mono- or polyunsaturated alkenyl radical having 2 to 12 carbon atoms, alkyl or alkenyl radicals as defined above and substituted by —$NH_2$, —OH or —COOH, or —COOH or —$COOR^4$, where $R^4$ is a saturated or unsaturated, straight-chain or branched hydrocarbon radical having 1 to 12 carbon atoms, and X is an optionally present spacer group which is chosen from —$(CH_2)_n$—, where n=0 to 4, —COO—$(CH_2)_k$— where k=1 to 6, —C(O)—NH—C$(CH_3)_2$— and —C(O)—NH—CH($CH_2CH_3$)—.

Among these monomers, preference is given to those of the formulae VIIa, VIIb and/or VIIc, $$H_2C{=}CH{-}X{-}SO_3H \quad (VIIa),$$

$$H_2C{=}C(CH_3){-}X{-}SO_3H \quad (VIIb),$$

$$HO_3S{-}X{-}(R^6)C{=}C(R^7){-}X{-}SO_3H \quad (VIIc),$$

in which $R^6$ and $R^7$, independently of one another, are chosen from —H, —$CH_3$, —$CH_2CH_3$, —$CH_2CH_2CH_3$, —$CH(CH_3)_2$ and X is an optionally present spacer group which is chosen from —$(CH_2)_n$—, where n=0 to 4, —COO—$(CH_2)_k$— where k=1 to 6, —C(O)—NH—C$(CH_3)$ 2- and —C(O)—NH—CH($CH_2CH_3$)—.

Particularly preferred monomers containing sulfonic acid groups here are 1-acrylamido-1-propanesulfonic acid (X=—C(O)NH—CH($CH_2CH_3$) in formula VIIa), 2-acrylamido-2-propanesulfonic acid (X=—C(O)NH—C$(CH_3)_2$ in formula VIIa), 2-acrylamido-2-methyl-1-propanesulfonic acid (X=—C(O)NH—CH($CH_3$)$CH_2$— in formula VIIa), 2-methacrylamido-2-methyl-1-propanesulfonic acid (X=—C(O)NH—CH($CH_3$)$CH_2$— in formula VIIb), 3-methacrylamido-2-hydroxypropanesulfonic acid (X=—C(O)NH—$CH_2$CH(OH)$CH_2$— in formula VIIb), allylsulfonic acid (X=$CH_2$ in formula VIIa), methallylsulfonic acid (X=$CH_2$ in formula VIIb), allyloxybenzenesulfonic acid (X=$CH_2$—O—$C_6H_4$— in formula VIIa), methallyloxybenzenesulfonic acid (X=$CH_2$—O—$C_6H_4$— in formula VIIb), 2-hydroxy-3-(2-propenyloxy)propanesulfonic acid, 2-methyl-2-propene-1-sulfonic acid (X=$CH_2$ in formula VIIb), styrenesulfonic acid (X=$C_6H_4$ in formula VIIa), vinylsulfonic acid (X not present in formula VIIa), 3-sulfopropyl acrylate (X=C(O)NH—$CH_2CH_2CH_2$— in formula VIIa), 3-sulfopropyl methacrylate (X=—C(O)NH—$CH_2CH_2CH_2$— in formula VIIb), sulfomethacrylamide (X=—C(O)NH— in formula VIIb), sulfomethyl methacrylamide (X=—C(O)NH—$CH_2$— in formula VIIb) and water-soluble salts of said acids.

Suitable further ionic or nonionogenic monomers are, in particular, ethylenically unsaturated compounds. Preferably the content of the monomers of group iii) in the polymers used according to the invention is less than 20% by weight, based on the polymer. Polymers to be used with particular preference consist merely of monomers of groups i) and ii).

In summary, copolymers of i) unsaturated carboxylic acids of the formula VI $$R^1(R^2)C{=}C(R^3)COOH \quad (VI),$$

in which $R^1$ to $R^3$, independently of one another, are —H, —$CH_3$, a straight-chain or branched saturated alkyl radical having 2 to 12 carbon atoms, a straight-chain or branched, mono- or polyunsaturated alkenyl radical having 2 to 12 carbon atoms, alkyl or alkenyl radicals as defined above and substituted by —$NH_2$, —OH or —COOH, or —COOH or —$COOR^4$, where $R^4$ is a saturated or unsaturated, straight-chain or branched hydrocarbon radical having 1 to 12 carbon atoms, ii) monomers of the formula VII containing sulfonic acid groups $$R^5(R^6)C{=}C(R^7){-}X{-}SO_3H \quad (VII),$$

in which $R^5$ to $R^7$, independently of one another, are —H, —$CH_3$, a straight-chain or branched saturated alkyl radical having 2 to 12 carbon atoms, a straight-chain or branched, mono- or polyunsaturated alkenyl radical having 2 to 12 carbon atoms, alkyl or alkenyl radicals as defined above and substituted by —$NH_2$, —OH or —COOH, or —COOH or —$COOR^4$, where $R^4$ is a saturated or unsaturated, straight-chain or branched hydrocarbon radical having 1 to 12 carbon atoms, and X is an optionally present spacer group which is chosen from —$(CH_2)_n$—, where n=0 to 4, —COO—$(CH_2)_k$— where k=1 to 6, —C(O)—NH—C$(CH_3)_2$— and —C(O)—NH—CH($CH_2CH_3$)— iii) optionally further ionic or nonionogenic monomers are particularly preferred.

Particularly preferred copolymers consist of i) one or more unsaturated carboxylic acids from the group consisting of acrylic acid, methacrylic acid and/or maleic acid ii) one or more monomers containing sulfonic acid groups and of the formulae VIIa, VIIb and/or VIIc:

$$H_2C{=}CH{-}X{-}SO_3H \quad (VIIa),$$

$$H_2C{=}C(CH_3){-}X{-}SO_3H \quad (VIIb),$$

$$HO_3S{-}X{-}(R^6)C{=}C(R^7){-}X{-}SO_3H \quad (VIIc),$$

in which $R^6$ and $R^7$, independently of one another, are chosen from —H, —$CH_3$, —$CH_2CH_3$, —$CH_2CH_2CH_3$, —$CH(CH_3)_2$ and X is an optionally present spacer group which is chosen from —$(CH_2)_n$—, where n=0 to 4, —COO—$(CH_2)_k$—, where k=1 to 6, —C(O)—NH—C$(CH_3)$ 2- and —C(O)—NH—CH($CH_2CH_3$)— iii) optionally further ionic or nonionogenic monomers.

The copolymers present according to the invention in the products can comprise the monomers from groups i) and ii), and optionally iii) in varying amounts, where all of the representatives from group i) can be combined with all of the representatives from group ii) and all of the representatives from group iii), Particularly preferred polymers have certain structural units which are described below.

Thus, for example, preference is given to products according to the invention which are characterized in that they comprise one or more copolymers which contain structural units of the formula VIII $$-[CH_2{-}CHCOOH]_m{-}[CH_2{-}CHC(O){-}Y{-}SO_3H]_p{-} \quad (VIII),$$

in which m and p are in each case a whole natural number between 1 and 2000, and Y is a spacer group chosen from substituted or unsubstituted aliphatic, aromatic or araliphatic hydrocarbon radicals having 1 to 24 carbon atoms, where spacer groups in which Y is —O—$(CH_2)_n$—, where n=0 to 4, is —O— $(C_6H_4)$—, is —NH—C$(CH_3)_2$— or —NH—CH($CH_2CH_3$)— are preferred.

These polymers are prepared by copolymerization of acrylic acid with an acrylic acid derivative containing sulfonic acid groups. Copolymerizing the acrylic acid derivative containing sulfonic acid groups with methacrylic acid leads to another polymer which is likewise used with preference in the products according to the invention and is characterized in that the products comprise one or more copolymers which contain structural units of the formula IX $$—[CH_2—C(CH_3)COOH]_m[CH_2—CHC(O)—Y—SO_3H]_p— \quad (IX),$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is $—O—(CH_2)_n—$, where n=0 to 4, is $—O—(C_6H_4)—$, is $—NH—C(CH_3)_2—$ or $—NH—CH(CH_2CH_3)—$ are preferred.

Entirely analogously, acrylic acid and/or methacrylic acid can also be copolymerized with methacrylic acid derivatives containing sulfonic acid groups, as a result of which the structural units in the molecule are changed. For example, products according to the invention which comprise one or more copolymers which contain structural units of the formula X $$—[CH_2—CHCOOH]_m[CH_2—C(CH_3)C(O)—Y—SO_3H]_p— \quad (X),$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is $—O—(CH_2)_n—$, where n=0 to 4, is $—O—(C_6H_4)—$, is $—NH—C(CH_3)_2—$ or $—NH—CH(CH_2CH_3)—$ are preferred, are likewise a preferred embodiment of the present invention, just as preference is also given to products which are characterized in that they comprise one or more copolymers which contain structural units of the formula XI $$—[CH_2—C(CH_3)COOH]_m—[CH_2—C(CH_3)C(O)—Y—SO_3H]_p— \quad (XI),$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is $—O—(CH_2)_n—$, where n=0 to 4, is $—O—(C_6H_4)—$, is $—NH—C(CH_3)_2—$ or $—NH—CH(CH_2CH_3)—$ are preferred.

In place of acrylic acid and/or methacrylic acid, or in addition thereto, it is also possible to use maleic acid as particularly preferred monomer from group i). This gives products preferred according to the invention which are characterized in that they comprise one or more copolymers which contain structural units of the formula XII $$—[HOOCCH—CHCOOH]_m—[CH_2—CHC(O)—Y—SO_3H]_p— \quad (XII),$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is $—O—(CH_2)_n—$, where n=0 to 4, is $—O—(C_6H_4)—$, is $—NH—C(CH_3)_2—$ or $—NH—CH(CH_2CH_3)—$ are preferred, and gives products which are characterized in that they comprise one or more copolymers which contain structural units of the formula XIII $$—[HOOCCH—CHCOOH]_m—[CH_2—C(CH_3)C(O)O—Y—SO_3H]_p— \quad (XIII),$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is $—O—(CH_2)_n—$, where n=0 to 4, is $—O—(C_6H_4)—$, is $—NH—C(CH_3)_2—$ or $—NH—CH(CH_2CH_3)—$ are preferred.

In summary, dishwasher detergents according to the invention are preferred which comprise, as ingredient b), one or more copolymers which contain structural units of the formulae VIII and/or 1× and/or X and/or XI and/or XII and/or XIII $$—[CH_2—CHCOOH]_m—[CH_2—CHC(O)—Y—SO_3H]_p—(VIII),$$

$$—[CH_2—C(CH_3)COOH]_m—[CH_2—CHC(O)—Y—SO_3H]_p— \quad (IX),$$

$$—[CH_2—CHCOOH]_m—[CH_2—C(CH_3)C(O)—Y—SO_3H]_p— \quad (X),$$

$$—[CH_2—C(CH_3)COOH]_m—[CH_2—C(CH_3)C(O)—Y—SO_3H]_p—(XI),$$

$$—[HOOCCH—CHCOOH]_m[CH_2—CHC(O)—Y—SO_3H]_p— \quad (XII),$$

$$—[HOOCCH—CHCOOH]_m—[CH_2—C(CH_3)C(O)O—Y—SO_3H]_p— \quad (XIII),$$

in which m and p are in each case a whole natural number between 1 and 2000, and Y is a spacer group which is chosen from substituted or unsubstituted aliphatic, aromatic or araliphatic hydrocarbon radicals having 1 to 24 carbon atoms, where spacer groups in which Y is $—O—(CH_2)_n—$, where n=0 to 4, is $—O—(C_6H_4)—$, is $—NH—C(CH_3)_2—$ or $—NH—CH(CH_2CH_3)—$ are preferred.

In the polymers, all or some of the sulfonic acid groups can be present in neutralized form, i.e. the acidic hydrogen atom of the sulfonic acid group in some or all sulfonic acid groups can be replaced with metal ions, preferably alkali metal ions and in particular with sodium ions. Corresponding products which are characterized in that the sulfonic acid groups in the copolymer are in partially or completely neutralized form are preferred in accordance with the invention.

The monomer distribution of the copolymers used in the products according to the invention is, in the case of copolymers which comprise only monomers from groups i) and ii), preferably in each case 5 to 95% by weight of i) or ii), particularly preferably 50 to 90% by weight of monomer from group i) and 10 to 50% by weight of monomer from group ii), in each case based on the polymer.

In the case of terpolymers, particular preference is given to those which comprise 20 to 85% by weight of monomer from group i), 10 to 60% by weight of monomer from group ii), and 5 to 30% by weight of monomer from group iii).

The molar mass of the polymers used in the products according to the invention can be varied in order to match the properties of the polymers to the desired intended use. Preferred dishwasher detergents are characterized in that the copolymers have molar masses of from 2000 to 200 000 $gmol^{-1}$, preferably from 4000 to 25 000 $gmol^{-1}$ and in particular from 5000 to 15 000 $gmol^{-1}$.

The content of one or more copolymers in the products according to the invention can vary depending on the intended use and desired product performance, preferred dishwasher detergents according to the invention being characterized in that the copolymer or copolymers is/are present in amounts of from 0.25 to 50% by weight, preferably from 0.5 to 35% by weight, particularly preferably from 0.75 to 20% by weight and in particular from 1 to 15% by weight.

As already mentioned above, in the compositions according to the invention particular preference is given both to using polyacrylates and also the above-described copolymers of unsaturated carboxylic acids, monomers containing sulfonic acid groups, and optionally further ionic or nonionogenic monomers. The polyacrylates have been described in detail above. Particular preference is given to combinations of the above-described copolymers containing sulfonic acid groups with polyacrylates of low molar mass, for example in the range between 1000 and 4000 daltons. Such polyacrylates are commercially available under the trade name Sokalan® PA15 and Sokalan® PA25 (BASF).

Surprisingly, it has been found that with a combination of zinc salts according to the invention, in particular of zinc stearate, zinc oleate, zinc citrate, zinc gluconate, zinc lactate and/or zinc acetate with the copolymers containing sulfonic acid groups described above in a dishwasher detergent, the corrosion-inhibiting effect of the zinc salts is considerably increased, i.e. consequently the amount of the zinc salt used can be reduced. Preferred dishwasher detergents within the scope of the present invention thus comprise, besides builder(s) and optionally further constituents of detergents, also one or more zinc salts, preferably from the group consisting of zinc stearate, zinc oleate, zinc citrate, zinc gluconate, zinc lactate and/or zinc acetate, and one or more copolymers containing sulfonic acid groups. The preferred weight ratio of zinc salt (calculated on the basis of $Zn^{2+}$) to copolymer containing sulfonic acid groups for such a preferred dishwasher detergent is between 20:1 and 1:500, in particular between 1:1 and 1:400 and particularly preferably between 1:10 and 1:250.

Also suitable are copolymeric polycarboxylates, in particular those of acrylic acid with methacrylic acid and of acrylic acid or methacrylic acid with maleic acid. Copolymers which have been found particularly suitable are those of acrylic acid with maleic acid which contain from 50 to 90% by weight of acrylic acid and from 50 to 10% by weight of maleic acid. Their relative molecular mass, based on free acids, is generally 2000 to 100 000 g/mol, preferably 20 000 to 90 000 g/mol and in particular 30 000 to 80 000 g/mol.

The (co)polymeric polycarboxylates can either be used as powder or as aqueous solution. The content of (co)polymeric polycarboxylates in the compositions is preferably 0.5 to 20% by weight, in particular 3 to 10% by weight.

In order to improve the solubility in water, the polymers may also contain allylsulfonic acids, such as, for example, allyloxybenzenesulfonic acid and methallylsulfonic acid, as monomers.

Particular preference is also given to biodegradable polymers comprising more than two different monomer units, for example those comprising, as monomers, salts of acrylic acid and of maleic acid, and also vinyl alcohol or vinyl alcohol derivatives, or those comprising, as monomers, salts of acrylic acid and of 2-alkylallylsulfonic acid, and sugar derivatives.

Further preferred copolymers have, as monomers, preferably acrolein and acrylic acid/acrylic acid salts or acrolein and vinyl acetate.

Further preferred builder substances which may likewise be mentioned are polymeric aminodicarboxylic acids, salts thereof or precursor substances thereof. Particular preference is given to polyaspartic acids and salts and derivatives thereof.

Further suitable builder substances are polyacetals, which may be obtained by reacting dialdehydes with polyolcarboxylic acids which have 5 to 7 carbon atoms and at least 3 hydroxyl groups. Preferred polyacetals are obtained from dialdehydes such as glyoxal, glutaraldehyde, terphthalaldehyde, and mixtures thereof and from polyolcarboxylic acids, such as gluconic acid and/or glucoheptonic acid.

Further suitable organic builder substances are dextrins, for example oligomers or polymers of carbohydrates which may be obtained by partial hydrolysis of starches. The hydrolysis can be carried out in accordance with customary processes, for example acid- or enzyme-catalyzed processes. The hydrolysis products preferably have average molar masses in the range from 400 to 500 000 g/mol. Preference is given here to a polysaccharide with a dextrose equivalent (DE) in the range from 0.5 to 40, in particular from 2 to 30, DE being a customary measure of the reducing effect of a polysaccharide compared with dextrose, with a DE of 100. It is possible to use either maltodextrins with a DE between 3 and 20 and dried glucose syrups having a DE of between 20 and 37, and also so-called yellow dextrins and white dextrins having higher molar masses in the range from 2000 to 30 000 g/mol.

The oxidized derivatives of such dextrins are their reaction products with oxidizing agents which are able to oxidize at least one alcohol function of the saccharide ring to the carboxylic acid function. A product oxidized on $C_6$ of the saccharide ring may be particularly advantageous.

Oxydisuccinates and other derivatives of disuccinates, preferably ethylenediaminedisuccinate, are also other suitable cobuilders. Ethylenediamine-N,N'-disuccinate (EDDS) is used preferably in the form of its sodium or magnesium salts. Further preference in this context is given to glycerol disuccinates and glycerol trisuccinates as well. Suitable use amounts in formulations containing zeolite and/or silicate are from 3 to 15% by weight.

Further organic cobuilders which can be used are, for example, acetylated hydroxycarboxylic acids and salts thereof, which may also be present in lactone form and which contain at least 4 carbon atoms and at least one hydroxyl group, and not more than two acids groups.

A further class of substance having cobuilder properties is the phosphonates. These are, in particular, hydroxyalkane- and aminoalkanephosphonates. Among the hydroxyalkanephosphonates, 1-hydroxyethane-1,1-diphosphonate (HEDP) is of particular importance as cobuilder. It is preferably used as the sodium salt, the disodium salt being neutral and the tetrasodium salt giving an alkaline (pH 9) reaction. Suitable aminoalkanephosphonates are preferably ethylenediaminetetramethylenephosphonate (EDTMP), diethylenetriaminepentamethylenephosphonate (DTPMP), and higher homologs thereof. They are preferably used in the form of the neutrally reacting sodium salts, e.g. as the hexasodium salt of EDTMP or as the hepta- and octasodium salt of DTPMP. The builder used in this case is from the class of phosphonates, preferably HEDP. In addition, the aminbalkanephosphonates have a marked heavy-metal-binding capacity. Accordingly, particularly when the compositions also comprise bleach, it may be preferred to use aminoalkanephosphonates, in particular DTPMP, or mixtures of said phosphonates.

Moreover, all compounds which are able to form complexes with alkaline earth metal ions may be used as cobuilders.

Within the scope of the present application, compositions according to the invention are characterized in that they comprise builders, preferably from the group of silicates, carbonates, organic cobuilders and/or phosphates, in amounts of from 0.1 to 99.5% by weight, preferably from 1 to 95% by weight, particularly preferably from 5 to 90% by weight and in particular from 10 to 80% by weight, in each case based on the composition.

Surfactants

Within the scope of the present application, preferred detergents comprise one or more surfactant(s) from the group of anionic, nonionic, cationic and/or amphoteric surfactants.

The anionic surfactants used are, for example, those of the sulfonate and sulfate type. Suitable surfactants of the sulfonate type are preferably $C_{9-13}$-alkylbenzenesulfonates, olefinsulfonates, i.e. mixtures of alkene- and hydroxyalkanesulfonates, and disulfonates, as are obtained, for example, from $C_{12-18}$-monoolefins with terminal or internal double bond by sulfonation with gaseous sulfur trioxide and subsequent alkaline or acidic hydrolysis of the sulfonation products. Also suitable are alkanesulfonates which are obtained from $C_{12-18}$-alkanes, for example by sulfochlorination or sulfoxidation with subsequent hydrolysis or neutralization. Likewise suitable are also the esters of α-sulfo fatty acids (ester sulfonates), e.g. the α-sulfonated methyl esters of hydrogenated coconut, palm kernel or tallow fatty acids.

Further suitable anionic surfactants are sulfated fatty acid glycerol esters. Fatty acid glycerol esters are understood as meaning the mono-, di- and triesters, and mixtures thereof, as are obtained in the preparation by esterification of a monoglycerol with 1 to 3 mol of fatty acid or in the transesterification of triglycerides with 0.3 to 2 mol of glycerol. Preferred sulfated fatty acid glycerol esters here are the sulfation products of saturated fatty acids having 6 to 22 carbon atoms, for example of caproic acid, caprylic acid, capric acid, myristic acid, lauric acid, palmitic acid, stearic acid or behenic acid.

Preferred alk(en)yl sulfates are the alkali metal and in particular the sodium salts of the sulfuric half-esters of $C_{12}$–$C_{18}$-fatty alcohols, for example from coconut fatty alcohol, tallow fatty alcohol, lauryl, myristyl, cetyl or stearyl alcohol or of the $C_{10}$–$C_{20}$-oxo alcohols and those half-esters of secondary alcohols of these chain lengths. Preference is also given to alk(en)yl sulfates of said chain length which contain a synthetic straight-chain alkyl radical prepared on a petrochemical basis and which have a degradation behavior analogous to that of the equivalent compounds based on fatty chemical raw materials. From a washing point of view, preference is given to the $C_{12}$–$C_{16}$-alkyl sulfates and $C_{12}$–$C_{15}$-alkyl sulfates, and $C_{14}$–$C_{15}$-alkyl sulfates. 2,3-Alkyl sulfates which can be obtained as commercial products of the Shell Oil Company under the name DAN® are also suitable anionic surfactants.

The sulfuric monoesters of straight-chain or branched $C_{7-21}$-alcohols ethoxylated with 1 to 6 mol of ethylene oxide, such as 2-methyl-branched $C_{9-11}$-alcohols having, on average, 3.5 mol of ethylene oxide (EO) or $C_{12-18}$-fatty alcohol with 1 to 4 EO, are also suitable. Due to their high foaming behavior, they are used in detergents only in relatively small amounts, for example in amounts of from 1 to 5% by weight.

Further suitable anionic surfactants are also the salts of alkylsulfosuccinic acid, which are also referred to as sulfosuccinates or as sulfosuccinic esters, and represent the monoesters and/or diesters of sulfosuccinic acid with alcohols, preferably fatty alcohols and in particular ethoxylated fatty alcohols. Preferred sulfosuccinates contain $C_{8-1}$8-fatty alcohol radicals or mixtures of these. Particularly preferred sulfosuccinates contain a fatty alcohol radical which is derived from ethoxylatd fatty alcohols which, considered in themselves, represent nonionic surfactants (description see below). In this connection, particular preference is in turn given to sulfosuccinates whose fatty alcohol radicals are derived from ethoxylated fatty alcohols with a narrowed homologue distribution. It is likewise also possible to use alk(en)ylsuccinic acid having preferably 8 to 18 carbon atoms in the alk(en)yl chain or salts thereof.

Suitable further anionic surfactants are, in particular, soaps. Saturated fatty acid soaps, such as the salts of lauric acid, myristic acid, palmitic acid, stearic acid, hydrogenated erucic acid and behenic acid, and soap mixtures derived in particular from natural fatty acids, e.g. coconut, palm kernel or tallow fatty acids, are suitable.

The anionic surfactants including the soaps may be present in the form of their sodium, potassium or ammonium salts, and as soluble salts of organic bases, such as mono-, di- or triethanolamine. The anionic surfactants are preferably in the form of their sodium or potassium salts, in particular in the form of the sodium salts.

A further group of washing-active substances are the nonionic surfactants. The nonionic surfactants used are preferably alkoxylated, advantageously ethoxylated, in particular primary alcohols having preferably 8 to 18 carbon atoms and, on average, 1 to 12 mol of ethylene oxide (EO) per mole of alcohol in which the alcohol radical may be linear or preferably methyl-branched in the 2 position or may contain linear and methyl-branched radicals in the mixture, as are usually present in oxo alcohol radicals. In particular, however, preference is given to alcohol ethoxylates with linear radicals from alcohols of natural origin having 12 to 18 carbon atoms, e.g. from coconut alcohol, palm alcohol, tallow fatty alcohol or oleyl alcohol, and on average 2 to 8 EO per mole of alcohol. Preferred ethoxylated alcohols include, for example, $C_{12-14}$-alcohols with 3 EO or 4 EO, $C_{9-11}$-alcohol with 7 EO, $C_{13-15}$-alcohols with 3 EO, 5 EO, 7 EO or 8 EO, $C_{12-18}$-alcohols with 3 EO, 5 EO or 7 EO and mixtures of these, such as mixtures of $C_{12-14}$-alcohol with 3 EO and $C_{12-18}$-alcohol with 5 EO. The degrees of ethoxylation given represent statistical average values which may be an integer or a fraction for a specific product. Preferred alcohol ethoxylates have a narrowed homolog distribution (narrow range ethoxylates, NRE), In addition to these nonionic surfactants, fatty alcohols with more than 12 EO can also be used. Examples thereof are tallow fatty alcohol with 14 EO, 25 EO, 30 EO or 40 EO.

A further class of preferably used nonionic surfactants, which are used either as the sole nonionic surfactant or in combination with other nonionic surfactants, are alkoxylated, preferably ethoxylated or ethoxylated and propoxylated fatty acid alkyl esters, preferably having 1 to 4 carbon atoms in the alkyl chain, in particular fatty acid methyl esters.

A further class of nonionic surfactants which can advantageously be used are the alkyl polyglycosides (APGs). Alkyl polyglycosides which can be used satisfy the general formula $RO(G)_z$, in which R is a linear or branched, in particular methyl-branched in the 2 position, saturated or unsaturated, aliphatic radical having 8 to 22, preferably 12 to 18, carbon atoms, and G is the symbol which represents a glycose unit having 5 or 6 carbon atoms, preferably glucose. The degree of glycosylation z here is between 1.0 and 4.0, preferably between 1.0 and 2.0 and in particular between 1.1 and 1.4. Preference is given to using linear alkyl polyglucosides, e.g. alkyl polyglycosides which consist of a glucose radical and an n-alkyl chain.

A further class of preferably used nonionic surfactants, which are used either as the sole nonionic surfactant or in combination with other nonionic surfactants, are alkoxylated, preferably ethoxylated or ethoxylated and propoxylated fatty acid alkyl esters, preferably having 1 to 4 carbon atoms in the alkyl chain.

Nonionic surfactants of the amine oxide type, for example N-cocoalkyl-N,N-dimethylamine oxide and N-tallow-alkyl-N,N-dihydroxyethylamine oxide, and of the fatty acid alkanolamide type, may also be suitable. The amount of these nonionic surfactants is preferably not more than that of the ethoxylated fatty alcohols, in particular not more than half thereof.

Further suitable surfactants are polyhydroxy fatty acid amides of the formula (XIV),

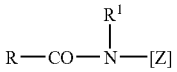

(XIV)

in which RCO is an aliphatic acyl radical having 6 to 22 carbon atoms, $R^1$ is hydrogen, an alkyl or hydroxyalkyl radical having 1 to 4 carbon atoms and [Z] is a linear or branched polyhydroxyalkyl radical having 3 to 10 carbon atoms and 3 to 10 hydroxyl groups. The polyhydroxy fatty acid amides are known substances which can usually be obtained by reductive amination of a reducing sugar with ammonia, an alkylamine or an alkanolamine and subsequent acylation with a fatty acid, a fatty acid alkyl ester or a fatty acid chloride.

The group of polyhydroxy fatty acid amides also includes compounds of the formula (XV),

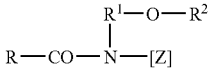

(XV)

in which R is a linear or branched alkyl or alkenyl radical having 7 to 12 carbon atoms, $R^1$ is a linear, branched or cyclic alkyl radical or an aryl radical having 2 to 8 carbon atoms, and $R^2$ is a linear, branched or cyclic alkyl radical or an aryl radical or an oxy-alkyl radical having 1 to 8 carbon atoms, where $C_{1-4}$-alkyl or phenyl radicals are preferred and [Z] is a linear polyhydroxyalkyl radical whose alkyl chain is substituted by at least two hydroxyl groups, or alkoxylated, preferably ethoxylated or propoxylated, derivatives of this radical.

[Z] is preferably obtained by reductive amination of a reduced sugar, for example glucose, fructose, maltose, lactose, galactoses mannose or xylose. The N-alkoxy- or N-aryloxy-substituted compounds can then be converted into the desired polyhydroxy fatty acid amides by reaction with fatty acid methyl esters in the presence of an alkoxide as catalyst.

In the case of washing and cleaning compositions for machine dishwashing, suitable surfactants are generally all surfactants. However, preference is given for this intended use to the above-described nonionic surfactants and here primarily to low-foaming nonionic surfactants. Particular preference is given to the alkoxylated alcohols, particularly the ethoxylated and/or propoxylated alcohols. In this connection, the person skilled in the art generally understands alkoxylated alcohols as meaning the reaction products of alkylene oxide, preferably ethylene oxide, with alcohols, preferably for the scope of the present invention the longer-chain alcohols ($C_{10}$ to $C_{18}$, preferably between $C_{12}$ and $C_{16}$, such as, for example, $C_{11}$-, $C_{12}$-, $C_{13}$-, $C_{14}$-, $C_{15}$-, $C_{16}$-, $C_{17}$- and $C_{18}$-alcohols), As a rule, n moles of ethylene oxide and one mole of alcohol produce a complex mixture of addition products of a varying degree of ethoxylation, depending on the reaction conditions. A further embodiment consists in the use of mixtures of the alkylene oxides, preferably of the mixture of ethylene oxide and propylene oxide. If desired, subsequent etherification with short-chain alkyl groups, such as preferably the butyl group, may also lead to the class of substance of "capped" alcohol ethoxylates, which can likewise be used within the scope of the invention. Very particular preference within the scope of the present invention is given here to highly ethoxylated fatty alcohols or mixtures thereof with terminally capped fatty alcohol ethoxylates.

Within the scope of the present invention, low-foaming nonionic surfactants which have alternate ethylene oxide and alkylene oxide units have proven to be particularly preferred as nonionic surfactants. Among these, preference is in turn given to surfactants with EO-AO-EO-AO blocks, where in each case one to ten EO or AO groups are bonded to one another before a block from the respective other groups follows. In this connection preference is given to dishwasher detergents according to the invention which comprise, as nonionic surfactant(s), surfactants of the general formula XVI

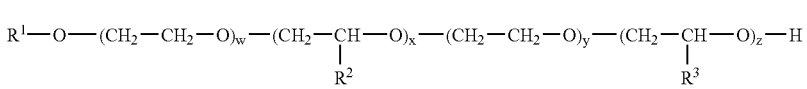

(XVI)

in which $R^1$ is a straight-chain or branched, saturated or mono- or polyunsaturated $C_{6-24}$-alkyl or -alkenyl radical; each group $R^2$ or $R^3$, independently of the other, is chosen from $—CH_3$; $—CH_2CH_3$, $—CH_2CH_2—CH_3$, $—CH(CH_3)_2$ and the indices w, x, y, z, independently of one another, are integers from 1 to 6.

The preferred nonionic surfactants of the formula XVI can be prepared by known methods from the corresponding alcohols $R^1$—OH and ethylene oxide or alkylene oxide. The radical $R^1$ in the above formula XVI can vary depending on the origin of the alcohol. If natural sources are used, the radical $R^1$ has an even number of carbon atoms and is usually unbranched, preference being given to the linear radicals from alcohols of natural origin having 12 to 18 carbon atoms, e.g. from coconut alcohol, palm alcohol, tallow fatty alcohol or oleyl alcohol. Alcohols accessible from synthetic sources are, for example, the Guerbet alcohols or radicals methyl-branched in the 2 position, or linear and methyl-branched radicals in a mixture, as are customarily present in oxo alcohol radicals. Irrespective of the type of alcohol used for the preparation of the nonionic surfactants present according to the invention in the compositions, preference is given to dishwasher detergents according to the invention in which $R^1$ in the formula XVI is an alkyl radical having 6 to 24, preferably 8 to 20, particularly preferably 9 to 15 and especially 9 to 11, carbon atoms.

Besides propylene oxide, a suitable alkylene oxide unit which is present alternately to the ethylene oxide unit in the preferred nonionic surfactants is, in particular, butylene oxide. However, further alkylene oxides in which $R^2$ and $R^3$ are chosen independently of one another from $—CH_2CH_2—CH_3$ and $—CH(CH_3)_2$ are also suitable. Preferred dishwasher detergents are characterized in that $R^2$ and $R^3$ are a radical $—CH_3$, w and x, independently of one another, are values of 3 or 4, and y and z, independently of one another, are values of 1 or 2.

In summary, for the use in the compositions according to the invention, particular preference is given to nonionic surfactants which have a $C_{9-15}$-alkyl radical having 1 to 4 ethylene oxide units, followed by 1 to 4 propylene oxide units, followed by 1 to 4 ethylene oxide units, followed by 1 to 4 propylene oxide units.

The preferred additional surfactants used are low-foaming nonionic surfactants. With particular preference, the dishwasher detergents according to the invention comprise a nonionic surfactant which has a melting point above room temperature. Consequently, preferred compositions are characterized in that they comprise nonionic surfactant(s) with a melting point of 20° C., preferably above 25° C., particularly preferably between 25 and 60° C. and in particular between 26.6 and 43.3° C.

Suitable nonionic surfactants in addition to the nonionic surfactants present according to the invention in the compositions which have melting or softening points in the stated temperature range are, for example, low-foaming nonionic surfactants which may be solid or of high viscosity at room temperature. If nonionic surfactants are used which are of high viscosity at room temperature, then it is preferred for these to have a viscosity above 20 Pas, preferably above 35 Pas and in particular above 40 Pas. Nonionic surfactants which have a wax-like consistency at room temperature are also preferred.

Nonionic surfactants to be used which are solid at room temperature preferably originate from the groups of alkoxylated nonionic surfactants, in particular the ethoxylated primary alcohols and mixtures of these surfactants with structurally more complicated surfactants, such as polyoxypropylene/polyoxy-ethylene/polyoxypropylene (PO/EO/PO) surfactants. Such (PO/EO/PO) nonionic surfactants are, moreover, characterized by good foam control.

In a preferred embodiment of the present invention, the nonionic surfactant with a melting point above room temperature is an ethoxylated nonionic surfactant which arises from the reaction of a monohydroxyalkanol or alkylphenol having 6 to 20 carbon atoms with preferably at least 12 mol, particularly preferably at least 15 mol, in particular at least 20 mol, of ethylene oxide per mole of alcohol or alkylphenol.

A particularly preferred nonionic surfactant to be used which is solid at room temperature is obtained from a straight-chain fatty alcohol having 16 to 20 carbon atoms ($C_{16-20}$-alcohol), preferably a $C_{18}$-alcohol and at least 12 mol, preferably at least 15 mol and in particular at least 20 mol of ethylene oxide. Among these, particular preference is given to the so-called "narrow range ethoxylates" (see above).

Accordingly, particularly preferred compositions according to the invention comprise ethoxylated nonionic surfactant(s) which has/have been obtained from $C_{6-20}$-monohydroxyalkanols or $C_{6-20}$-alkylphenols or $C_{16-20}$-fatty alcohols and more than 0.12 mol, preferably more than 15 mol and in particular more than 20 mol, of ethylene oxide per mole of alcohol.

The nonionic surfactant preferably additionally has propylene oxide units in the molecule. Preferably, such PO units constitute up to 25% by weight, particularly preferably up to 20% by weight and in particular up to 15% by weight of the total molar mass of the nonionic surfactant. Particularly preferred nonionic surfactants are ethoxylated monohydroxyalkanols or alkylphenols which additionally have polyoxyethylene-polyoxypropylene block copolymer units. The alcohol or alkylphenol moiety of such nonionic surfactant molecules here constitutes preferably more than 30% by weight, particularly preferably more than 50% by weight and in particular more than 70% by weight, of the total molar mass of such nonionic surfactants. Preferred dishwasher detergents are characterized in that they comprise ethoxylated and propoxylated nonionic surfactants in which the propylene oxide units in the molecule constitute up to 25% by weight, preferably up to 20% by weight and in particular up to 15% by weight, of the total molar mass of the nonionic surfactant.

Further nonionic surfactants with melting points above room temperature to be used particularly preferably comprise 40 to 70% of a polyoxypropylene/polyoxyethylene/polyoxypropylene block polymer blend, of which 75% by weight of an inverse block copolymer of polyoxyethylene and polyoxypropylene with 17 mol of ethylene oxide and 44 mol of propylene oxide and 25% by weight of a block copolymer of polyoxyethylene and polyoxypropylene, initiated with trimethylolpropane and comprising 24 mol of ethylene oxide and 99 mol of propylene oxide per mol of trimethylolpropane, are preferred.

Nonionic surfactants which can be used with particular preference are available, for example, under the name Poly Tergent® SLF-18 from Olin Chemicals. A further preferred dishwasher detergent according to the invention comprises nonionic surfactants of the formula $$R^1O[CH_2CH(CH_3)O]_x[CH_2CH_2O]_y[CH_2CH(OH)R^2],$$

in which $R^1$ is a linear or branched aliphatic hydrocarbon radical having 4 to 18 carbon atoms or mixtures thereof, $R^2$ is a linear or branched hydrocarbon radical having 2 to 26 carbon atoms or mixtures thereof, and x is values between 0.5 and 1.5 and y is a value of at least 15.

Further nonionic surfactants which can preferably be used are the terminally capped poly(oxyalkylated) nonionic surfactants of the formula $$R^2O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals having 1 to 30 carbon atoms, $R^3$ is H or a methyl, ethyl, n-propyl, isopropyl, n-butyl, 2-butyl or 2-methyl-2-butyl radical, x is values between 1 and 30, k and j are values between 1 and 12, preferably between 1 and 5. If the value x is ≧2, each $R^3$ in the above formula may be different. $R^1$ and $R^2$ are preferably linear or branched, saturated or unsaturated, aliphatic or aromatic hydrocarbon radicals having 6 to 22 carbon atoms, particular preference being given to radicals with 8 to 18 carbon atoms. For the radical $R^3$, H, —$CH_3$ or —$CH_2CH_3$ are particularly preferred. Particularly preferred values for x are in the range from 1 to 20, in particular from 6 to 15.

As described above, each $R^3$ in the above formula may be different if x is ≧2. As a result of this, the alkylene oxide unit in the square brackets may be varied. If, for example, x is 3, the radical $R^3$ may be chosen in order to form ethylene oxide ($R^3$H) or propylene oxide ($R^3$═$CH_3$) units, which can be arranged in any order, for example (EO)(PO)(EO), (EO)(EO)(PO), (EO) (EO) (EO), (PO) (EO) (PO), (PO) (PO) (EO) and (PO) (PO) (PO) The value 3 for x has been chosen here by way of example and it is entirely possible for it to be larger, the scope for variation increasing with increasing values of x and embracing, for example, a large number of (EO) groups, combined with a small number of (PO) groups, or vice versa.

Particularly preferred terminally capped poly(oxyalkylated) alcohols of the above formula have values of k=1 and j=1, so that the above formula is simplified to $$R^1O[CH_2CH(R^3)O]_xCH_2CH(OH)CH_2OR^2.$$

In the last-mentioned formula, $R^1$, $R^2$ and $R^3$ are as defined above and x represents numbers from 1 to 30, preferably from 1 to 20 and in particular from 6 to 18. Particular preference is given to surfactants in which the radicals $R^1$ and $R^2$ have 9 to 14 carbon atoms, $R^3$ is H and x assumes values from 6 to 15.

Summarizing the last-mentioned statements, preference is given to dishwasher detergents according to the invention which comprise terminally capped poly(oxyalkylated) nonionic surfactants of the formula $$R^1O[CH_2CH(R^3)O]_x[CH_2]_kCH(OH)\ [CH_2]_jOR^2$$

in which $R^1$ and $R^2$ are linear or branched, saturated or unsaturated, aliphatic or aromatic hydrocarbon radicals having 1 to 30 carbon atoms, $R^3$ is a methyl, ethyl, n-propyl, isopropyl, n-butyl, 2-butyl or 2-methyl-2-butyl radical, x is values between 1 and 30, k and j are values between 1 and 12, preferably between 1 and 5, particular preference being given to surfactants of the type $$R^1O[CH_2CH(R^3)O]\ CH_2CH(OH)CH_2OR^2$$

in which x is numbers from 1 to 30, preferably from 1 to 20 and in particular from 6 to 18.

In conjunction with said surfactants it is also possible to use anionic, cationic and/or amphoteric surfactants, the latter, due to their foaming behavior in dishwasher detergents, being only of minor importance and in most cases only used in amounts below 10% by weight, in most cases even below 5% by weight, for example from 0.01 to 2.5% by weight, in each case based on the composition. The compositions according to the invention may thus also comprise anionic, cationic, and/or amphoteric surfactants as surfactant component.

As cationic active substances, the compositions according to the invention can, for example, comprise cationic compounds of the formulae XVII, XVIII or XIX:

(XVII)

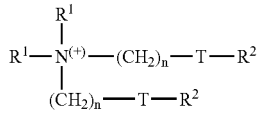

(XVIII)

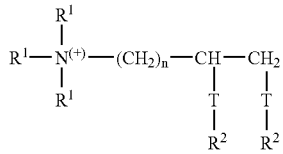

(XIX)

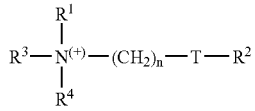

in which each group $R^1$ is chosen independently of the others from $C_{1-6}$-alkyl, -alkenyl or -hydroxyalkyl groups; each group $R^2$ is chosen independently of the others from $C_{8-28}$-alkyl or -alkenyl groups; $R^3$═$R^1$ or $(CH_2)_n$-T-$R^2$; $R^4$=$R^1$ or $R^2$ or $(CH_2)_n$-T-$R^2$; T=—$CH_2$—, —O—CO— or —CO—O— and n is an integer from 0 to 5.

Within the scope of the present invention, it is preferred for the dishwasher detergents to comprise surfactant(s), preferably nonionic surfactant(s), in amounts of from 0.5 to 10% by weight, preferably from 0.75 to 7.5% by weight and in particular from 1.0 to 5% by weight, in each case based on the total composition.

Bleaches

Bleaches and bleach activators are important constituents of detergents and cleaners and a detergent and cleaner can, within the scope of the present invention, comprise one or more substances from the groups given. Among the compounds used as bleaches which produces $H_2O_2$ in water, sodium percarbonate is of particular importance. Further bleaches which can be used are, for example, sodium perborate tetrahydrate and sodium perborate monohydrate, peroxypyrophosphates, citrate perhydrates, and $H_2O_2$-producing peracidic salts or peracids, such as perbenzoates, peroxophthalates, diperazelaic acid, phthaloimino peracid or diperdodecanedioic acid.

"Sodium percarbonate" is a term used unspecifically for sodium carbonate peroxohydrates, which, strictly speaking, are not "percarbonates" (i.e. salts of percarbonic acid) but hydrogen peroxide adducts with sodium carbonate. The commercial product has the average composition $2Na_2CO_3 .3H_2O_2$ and is thus not a peroxycarbonate. Sodium percarbonate forms a white, water-soluble powder of density 2.14 $gcm^{-3}$, which readily breaks down into sodium carbonate and oxygen which has a bleaching and/or oxidizing effect.

Sodium carbonate peroxohydrate was obtained for the first time in 1899 by precipitation with ethanol from a solution of sodium carbonate in hydrogen peroxide, but regarded incorrectly as peroxycarbonate. Only in 1909 was the compound recognized as hydrogen peroxide addition compound; nevertheless the historic name "sodium percarbonate" has become accepted in practice.

The industrial preparation of sodium percarbonate is made predominantly by precipitation from aqueous solution (so-called wet process). In this process, aqueous solutions of sodium carbonate and hydrogen peroxide are combined and the sodium percarbonate is precipitated by means of salting-out agents (predominantly sodium chloride), crystallization auxiliaries (for example polyphosphates, polyacrylates) and stabilizers (for example $Mg^+$ ions). The precipitated salt, which still comprises 5 to 12% by weight of mother liquor, is then centrifuged off and dried in fluidized-bed dryers at 90° C. The bulk density of the finished product can vary between 800 and 1200 g/l depending on the preparation process. As a rule, the percarbonate is stabilized by an additional coating. Coating processes and substances which are used for the coating are described widely in the patent literature. In principle, all standard commercial percarbonate grades can be used according to the invention, as are supplied, for example, from Solvay Interox, Degussa, Kemira or Akzo.

Dishwasher detergents may also comprise bleaches from the group of organic bleaches. Typical organic bleaches which may be used as ingredients within the scope of the present invention are the diacyl peroxides, such as, for example, dibenzoyl peroxide. Further typical organic bleaches are the peroxy acids, particular examples being the alkyl peroxy acids and the aryl peroxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, c-phthalimidoperoxycaproic acid [phthaloiminoperoxyhexanoic acid (PAP)], o-carboxybenzamidoperoxycaproic acid, N-nonenylamidoperadipic acid and N-nonenylamidopersuccinate, and (c) aliphatic and araliphatic peroxydicarboxylic acids, such as 1,2-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi(6-aminopercaproic acid) may be used.

According to the present invention, bleaches which may be used for machine dishwashing are also substances which release chlorine or bromine. Among suitable chlorine- or bromine-releasing materials, examples include heterocyclic N-bromoamides and N-chloroamides, examples being trichloroisocyanuric acid, tribromoisocyanuric acid, dibromoisocyanuric acid and/or dichloroisocyanuric acid (DICA) and/or salts thereof with cations such as potassium and sodium. Hydantoin compounds, such as 1,3-dichloro-5,5-dimethylhydantoin, are likewise suitable.

Within the scope of the present invention, advantageous compositions comprise one or more bleaches, preferably from the group of oxygen or halogen bleaches, in particular chlorine bleaches, particularly preferably sodium percarbonate and/or sodium perborate monohydrate, in amounts of from 0.5 to 40% by weight, preferably from 1 to 30% by weight, particularly preferably from 2.5 to 25% by weight and in particular from 5 to 20% by weight, in each case based on the total composition.

Bleach Activators

In order to achieve an improved bleaching effect when washing at temperatures of 60° C. and below, within the scope of the present invention, detergents can comprise bleach activators, Bleach activators which may be used are compounds which, under perhydrolysis conditions, produce aliphatic peroxocarboxylic acids having preferably 1 to 10 carbon atoms, in particular 2 to 4 carbon atoms, and/or optionally substituted perbenzoic acid. Substances which carry O- and N-acyl groups of said number of carbon atoms and/or optionally substituted benzoyl groups are suitable. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), carboxylic anhydrides, in particular phthalic anhydride, acylated polyhydric alcohols, in particular triacetin, ethylene glycol diacetate and 2,5-diacetoxy-2,5-dihydrofuran.

In addition to the conventional bleach activators, or instead of them, so-called bleach catalysts can also be incorporated according to the present invention into the detergents. These substances are bleach-boosting transition metal salts or transition metal complexes, such as, for example, Mn-, Fe-, Co-, Ru- or Mo-salen complexes or -carbonyl complexes. Mn, Fe, Co, Ru, Mo, Ti, V and Cu complexes with N-containing tripod ligands, and also Co-, Fe-, Cu- and Ru-ammine complexes can also be used as bleach catalysts.

According to the invention, preference is given to compositions comprising one or more substances from the group of bleach activators, in particular from the groups of polyacylated alkylenediamines, in particular tetraacetylethylenediamine (TAED), N-acylimides, in particular N-nonanoylsuccinimide (NOSI), acylated phenolsulfonates, in particular n-nonanoyl- or isononanoyloxybenzenesulfonate (n- or iso-NOBS) and n-methylmorpholiniumacetonitrile methylsulfate (MMA), in amounts of from 0.1 to 20% by weight, preferably from 0.5 to 15% by weight and in particular from 1 to 10% by weight, in each case based on the total composition.

Bleach activators which are preferred within the scope of the present invention further include the "nitrile quats", cationic nitrites of the formula (XX),

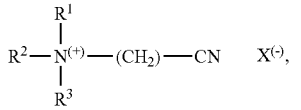

(XX)

in which $R^1$ is —H, —$CH_3$, a $C_{2-24}$-alkyl or -alkenyl radical, a substituted $C_{2-24}$-alkyl or -alkenyl radical with at least one substituent from the group —Cl, —Br, —OH, —$NH_2$, —CN, an alkyl- or alkenylaryl radical with a $C_{1-24}$-alkyl group, or is a substituted alkyl- or alkenylaryl radical with a $C_{1-24}$-alkyl group and at least one further substituent on the aromatic ring, $R^2$ and $R^3$, independently of one another, are chosen from —$CH_2$—CN, —$CH_3$, —$CH_2$—$CH_3$, —$CH_2$—$CH_2$—$CH_3$, —CH($CH_3$)—$CH_3$, —$CH_2$—OH, —$CH_2$—$CH_2$—OH, —CH(OH)—$CH_3$, —$CH_2$—$CH_2$—$CH_2$—OH, —$CH_2$—CH(OH)—$CH_3$, —CH(OH)—$CH_2$—$CH_3$, —($CH_2CH_2$—O)$_n$H where n=1, 2, 3, 4, 5 or 6 and X is an anion.

The general formula (XX) covers a large number of cationic nitrites which can be used within the scope of the present invention. With particular advantage, the detergent and cleaner shaped bodies according to the invention comprise cationic nitrites in which $R^1$ is methyl, ethyl, propyl, isopropyl or an n-butyl, n-hexyl, n-octyl, n-decyl, n-dodecyl, n-tetradecyl, n-hexadecyl or n-octadecyl radical. $R^2$ and $R^3$ are preferably chosen from methyl, ethyl, propyl, isopropyl and hydroxyethyl, where one or both of the radicals may advantageously also be a cyanomethylene radical.

For reasons of easier synthesis, preference is given to compounds in which the radicals $R^1$ to $R^3$ are identical, for example $(CH_3)_3N^{(+)}CH_2$—CN X–, $(CH_3CH_2)_3N^{(+)}CH_2$—CN $X^-$, $(CH_3CH_2CH_2)_3N^{(+)}CH_2$—CN $X^-$, $(CH_3CH(CH_3))_3N^{(+)}CH_2$—CN $X^-$ or (HO—$CH_2$—$CH_2)_3N^{(+)}CH_2$—CN $X^-$, where $X^-$ is preferably an anion which is chosen from the group consisting of chloride, bromide, iodide, hydrogensulfate, methosulfate, p-toluenesulfonate (tosylate) or xylenesulfonate.

Detergents and cleaners preferred within the scope of the present invention are characterized in that they comprise the cationic nitrile of the formula (XX) in amounts of from 0.1 to 20% by weight, preferably from 0.25 to 15% by weight and in particular from 0.5 to 10% by weight, in each case based on the weight of the shaped body.

Enzymes

Suitable enzymes are, in particular, those from the classes of hydrolases, such as the proteases, esterases, lipases and lipolytic enzymes, amylases, cellulases or other glycosyl hydrolases, and mixtures of said enzymes. In the washing, all of these hydrolases contribute to the removal of stains, such as proteinaceous, fatty or starchy stains and graying. Cellulases and other glycosylhydrolases may, furthermore, contribute to the retention of color and to an increase in the softness of the textile by removing pilling and microfibrils. For the bleaching and for inhibiting color transfer it is also possible to use oxidoreductases. Especially suitable enzymatic active ingredients are those obtained from bacterial strains or fungi such as *Bacillus subtilis, Bacillus licheniformis, Streptomyceus griseus, Coprinus cinereus* and *Humicola insolens*, and also from genetically modified variants thereof. Preference is given to using proteases of the subtilisin type and in particular proteases which are obtained from *Bacillus lentus*. Of particular interest in this context are enzyme mixtures, examples being those of protease and amylase or protease and lipase or lipolytic enzymes, or protease and cellulase or of cellulase and lipase or lipolytic enzymes or protease, amylase and lipase or lipolytic enzymes, or protease, lipase or lipolytic enzymes and cellulase, but in particular protease and/or lipase-containing mixtures or mixtures containing lipolytic enzymes. Examples of such lipolytic enzymes are the known cutinases.

Peroxidases or oxidases have also proven suitable in some cases. Suitable amylases include, in particular, α-amylases, isoamylases, pullulanases, and pectinases. The cellulases used are preferably cellobiohydrolases, endoglucanases and endoglucosidases, which are also cellobiases, and mixtures thereof. Because different types of cellulase differ in their CMCase and Avicelase acctivities, specific mixtures of the cellulases may be used to establish the desired activities.

The enzymes can be adsorbed on carrier substances or embedded in coating substances in order to protect them against premature decomposition. Preferred compositions according to the invention comprise enzymes, preferably in the form of liquid and/or solid enzyme preparations, in amounts of from 0.1 to 10% by weight, preferably from 0.5 to 8% by weight and in particular from 1 to 5% by weight, in each case based on the total composition.

Dyes

In order to improve the esthetic impression of the detergents and cleaners, they may be colored with suitable dyes. Dyes which are preferred within the scope of the invention, the selection of which presents no difficulty whatsoever to the person skilled in the art, have a high storage stability and insensitivity toward the other ingredients of the compositions and toward light and have no pronounced substantivity toward textile fibers, so as not to stain them.

Preference for use in the detergents and cleaners according to the invention is given to all colorants which can be oxidatively destroyed in the wash process, and to mixtures thereof with suitable blue dyes, so-called bluing agents. It has proven advantageous to use colorants which are soluble in water or, at room temperature, in liquid organic substances. Examples of suitable colorants are anionic colorants, e.g. anionic nitroso dyes. One possible colorant is, for example, naphthol green (Colour Index (CI) Part 1: Acid Green 1; Part 2: 10020), which is available as a commercial product, for example as Basacid® Green 970 from BASF, Ludwigshafen, Germany, and mixtures thereof with suitable blue dyes. Further suitable colorants are Pigmosol® Blue 6900 (CI 74160), Pigmosol® Green 8730 (CI 74260), Basonyl® Red 545 FL (CI 45170), Sandolan® Rhodamin EB400 (CI 45100), Basacid® Yellow 094 (CI 47005), Sicovit® Patent Blue 85 E 131 (CI 42051), Acid Blue 183 (CAS 12217-22-0, CI Acid Blue 183), Pigment Blue 15 (CI 74160), Supranol® Blue GLW (CAS 12219-32-8, CI Acid Blue 221)), Nylosan® Yellow N-7GL SGR (CAS 61814-57-1, CI Acid Yellow 218) and/or Sandolan® Blue (CI Acid Blue 182, CAS 12219-26-0).

When choosing the colorant, it must be ensured that the colorants do not have too great an affinity toward the textile surfaces and especially toward synthetic fibers. At the same time, it should also be borne in mind when choosing appropriate colorants that colorants have different stabilities with respect to oxidation. The general rule is that water-insoluble colorants are more stable to oxidation than water-soluble colorants. Depending on the solubility and hence also on the oxidation sensitivity, the concentration of the colorant in the detergents or cleaners varies. In the case of readily water-soluble colorants, e.g. the abovementioned Basacid® Green, or the likewise above-mentioned Sandolan® Blue, colorant concentrations are typically chosen in the range from a few $10^{-2}$ to $10^{-3}$% by weight. In the case of the pigment dyes which are particularly preferred due to their brilliance but are less readily soluble in water, for example the abovementioned Pigmosol® dyes, the suitable concentration of the colorant in detergents or cleaners is, by contrast, typically from a few $10^{-3}$ to $10^{-4}$% by weight.

Fragrances

Fragrances are added to the compositions within the scope of the present invention in order to improve the esthetic impression of the compositions and to provide the consumer with not only the performance of the composition, but also a visually and sensorily "typical and unmistakable" composition.

Perfume oils and fragrances which can be used within the scope of the present invention are individual odorant compounds, e.g. the synthetic compositions of the ester, ether, aldehyde, ketone, alcohol and hydrocarbon type. Odorant compounds of the ester type are, for example, benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethyl methylphenylglycinate, allyl cyclohexyl propionate, styrallyl propionate and benzyl salicylate. The ethers include, for example, benzyl ethyl ether; the aldehydes include, for example, the linear alkanals having 8–18 carbon atoms, citral, citronellal, citronellyloxyacetaldehyde, cyclamen aldehyde, hydroxycitronellal, lilial and bourgeonal; the ketones include, for example, the ionones, α-isomethylionone and methyl cedryl ketone; the alcohols include anethol, citronellol, eugenol, geraniol, linalool, phenylethyl alcohol and terpineol; the hydrocarbons include primarily the terpenes such as limonene and pinene.

Preference, however, is given to mixtures of different odorants which together produce a pleasing fragrance note. Such perfume oils may also comprise natural odorant mixtures, as are available from plant sources, examples being pine oil, citrus oil, jasmine oil, patchouli oil, rose oil or ylang ylang oil. Likewise suitable are clary sage oil, camomile oil, oil of cloves, balm oil, mint oil, cinnamon leaf oil, lime blossom oil, juniper berry oil, vetiver oil, olibanum oil, galbanum oil and labdanum oil, and also orange blossom oil, neroli oil, orange peel oil and sandalwood oil.

Corrosion Protectants

Dishwasher detergents can comprise corrosion inhibitors to protect the ware or the machine, with silver protectants being of particular importance in the field of machine dishwashing. The known substances of the prior art may be used. In general, it is possible to use, in particular, silver protectants chosen from the group of triazoles, of benzotriazoles, of bisbenzotriazoles, of aminotriazoles, of alkylaminotriazoles and of transition metal salts or complexes. Particular preference is given to the use of benzotriazole and/or alkylaminotriazole. Frequently encountered in cleaning formulations, furthermore, are agents containing active chlorine, which may significantly reduce corrosion of the silver surface. In chlorine-free cleaners, use is made in particular of oxygen- and nitrogen-containing organic redox-active compounds, such as di- and trihydric phenols, e.g. hydroquinone, pyrocatechol, hydroxyhydroquinone, gallic acid, phloroglucinol, pyrogallol, and derivatives of these classes of compounds. Inorganic compounds in the form of salts and complexes, such as salts of the metals Mn, Ti, Zr, Hf, V, Co and Ce, are also often used. Preference is given here to the transition metal salts which are chosen from the group of manganese and/or cobalt salts and/or complexes, particularly preferably cobalt(ammine) complexes, cobalt(acetato) complexes, cobalt(catbonyl) complexes, the chlorides of cobalt or of manganese and manganese sulfate, and the manganese complexes $[\text{Me-TACN})\text{Mn}^{IV}(\text{m-0})_3\text{Mn}^{IV}(\text{Me-TACN})]^{2+}(\text{PF}_6^-)_2$, $[\text{Me-Me-TACN})\text{Mn}^{IV}(\text{M-0})_3\text{Mn}^{IV}(\text{Me-Me-TACN})]^{2+}(\text{PF}_6^-)_2$, $[\text{Me-TACN})\text{Mn}^{III}(\text{m-0})\ (\text{m-0Ac})_2\text{Mn}^{III}(\text{Me-TACN})]^{2+}(\text{PF}_6^-)_2$ and $[\text{Me-Me-TACN})\text{Mn}^{III}(\text{m-0})(\text{m-0Ac})_2\text{Mn}^{III}(\text{Me-Me-TACN})]^{2+}(\text{PF}_6^-)_2$, where Me-TACN is 1,4,7-trimethyl-1,4,7-triazacyclononane and Me-Me-TACN is 1,2,4,7-tetramethyl-1,4,7-triazacyclononane. Zinc compounds may likewise be used to prevent corrosion on the ware.

Within the scope of the present invention, preference is given to dishwasher detergents which additionally comprise at least one silver protectant chosen from the group of triazoles, benzotriazoles, bisbenzotriazoles, aminotriazoles, alkylaminotriazoles, preferably benzotriazole and/or alkylaminotriazole, in amounts of from 0.001 to 1% by weight, preferably from 0.01 to 0.5% by weight and in particular from 0.05 to 0.25% by weight, in each case based on the total composition.

The dishwasher detergents according to the invention for machine dishwashing can be supplied to the consumer in conventional containers, for example bottles, screw glassware, canisters, balloons, beakers or spray vessels, from which he meters these for use. Relatively high viscosity compositions can also be supplied in tubes or metered dispensers, as are known for toothpaste or sealing compositions. Such containers are nowadays usually prepared from non-water-soluble polymers and can, for example, consist of all customary water-insoluble packaging materials which are well known to the person skilled in the art in this field. Preferred polymers which may be mentioned here are, in particular, hydrocarbon-based plastics. Particularly preferred polymers include polyethylene, polypropylene (more preferably oriented polypropylene) and polymer mixtures, such as, for example, mixtures of said polymers with polyethylene terephthalate. Also suitable are one or more polymers from the group consisting of polyvinyl chloride, polysulfones, polyacetals, water-insoluble cellulose derivatives, cellulose acetate, cellulose propionate, cellulose acetobutyrate and mixtures of said polymers or copolymers comprising said polymers.

A particularly preferred embodiment of the present invention, however, aims to lend the consumer a helping hand in the form of preportioned compositions according to the invention so that he can utilize the dosing advantages known to him from the "tablet" supply form, and combine them with the rapid dissolution and release rate and the performance advantages of the compositions according to the invention. Such preportioned compositions according to the invention can likewise be in the form of water-insoluble packagings, so that the consumer has to open these prior to use in a suitable manner. It is, however, also possible and preferred to package portioned compositions according to the invention so that the consumer can place them into the dishwasher directly, i.e. together with the packaging, without further handling steps. Such packagings include water-soluble or water-disintegrable packagings such as pouches made of water-soluble film, pouches or other packagings made of water-soluble or water-disintegrable nonwovens or else flexible or rigid bodies made of water-soluble polymers, preferably in the form of filled hollow bodies which can be produced, for example, by deep-drawing, injection molding, blow molding, calendering etc.

The present invention thus preferably provides dishwasher detergents which are packaged in portions in a water-soluble enclosure.

Dishwasher detergents according to the invention preferably comprise an enclosure which is completely or partially soluble in water. The shape of the enclosure is not limited to particular shapes. In principle, all archimedic and platonic bodies, i.e. three-dimensional shaped bodies, are suitable as enclosure shapes. Examples of the shape of the enclosure are capsules, cubes, spheres, egg-shaped bodies, cuboids, cones, rods or pouches. Hollow bodies with one or more compartments are also suitable as enclosure for the dishwasher detergents. In preferred embodiments of the invention, the enclosures have the form of capsules, as are also used, for example, in pharmacy for administering medicaments, of spheres or of pouches. The latter are preferably sealed or adhered on at least one side, where the adhesive used in particularly preferred embodiments of the invention is an adhesive which is water-soluble.

According to a preferred embodiment of the invention, the water-soluble polymer material partially or completely surrounding the dishwasher detergent is a water-soluble packaging. This is understood as meaning a flat component which partially or completely surrounds the dishwasher detergent. The exact shape of such a packaging is not critical and can be adapted largely to the use conditions. For example, processed plastic films or sheets, capsules and other conceivable shapes worked into different shapes (such as tubes, sachets, cylinders, bottles, disks or the like) are suitable. According to the invention, particular preference is given to films which can be adhered and/or sealed, for example, to give packagings such as tubes, sachets or the like after they have been filled with part portions of the detergents according to the invention or with the detergents according to the invention themselves.

Also preferred according to the invention are plastic film packagings made of water-soluble polymer materials due to the properties which can be matched in an excellent manner to the desired physical conditions. Such films are known in principle from the prior art.

In summary, hollow bodies of any shape, which can be produced by injection molding, bottle blowing, deep-drawing etc., and also hollow bodies made of films, in particular pouches, are preferred as packagings for portioned compositions according to the invention. Preferred dishwasher detergents according to the invention are thus characterized in that the water-soluble enclosure comprises a pouch made of water-soluble film and/or an injection-molded section and/or a blow-molded section and/or a deep-drawn section.

According to the invention, it is preferred for one or more enclosure(s) to be sealed. This brings the advantage that the dishwasher detergents are optimally protected against environmental influences, in particular against moisture. In addition, by virtue of these sealed enclosures, it is possible to further develop the invention inasmuch as the detergents comprise at least one gas to protect the contents of the enclosure(s) against moisture, see below.

Suitable materials for the completely or partially water-soluble enclosure are in principle all materials which are completely or partially soluble in aqueous phase under the given conditions of a washing operation, rinsing operation or cleaning operation (temperature, pH, concentration of washing-active components). The polymer materials may particularly preferably belong to the groups consisting of (optionally partially acetalized) polyvinyl alcohol, polyvinylpyrrolidone, polyethylene oxide, gelatin, cellulose and derivatives thereof, starch and derivatives thereof, in particular modified starches, and mixtures (polymer blends, composites, coextrudates etc.) of said materials. Particular preference is given to gelatin and polyvinyl alcohols, and said two materials in each case in a composite with starch or modified starch. Inorganic salts and mixtures thereof are also suitable materials for the at least partially water-soluble enclosure.

Preferred dishwasher detergents according to the invention are characterized in that the enclosure comprises one or more materials from the group consisting of acrylic acid-containing polymers, polyacrylamides, oxazoline polymers, polystyrenesulfonates, polyurethanes, polyesters and polyethers and mixtures thereof.

Particularly preferred dishwasher detergents according to the invention are characterized in that the enclosure comprises one or more water-soluble polymer(s), preferably a material from the group consisting of (optionally acetalized) polyvinyl alcohol (PVAL), polyvinylpyrrolidone, polyethylene oxide, gelatin, cellulose, and derivatives thereof and mixtures thereof, more preferably (optionally acetalized) polyvinyl alcohol (PVAL).

"Polyvinyl alcohols" (abbreviation PVAL, sometimes also PVOH) is here the name for polymers of the general structure

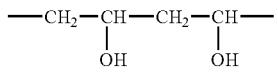

which also contain structural units of the type

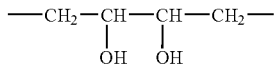

in small amounts (about 2%)

Standard commercial polyvinyl alcohols, which are supplied as white-yellowish powders or granules with degrees of polymerization in the range from about 100 to 2500 (molar masses from about 4000 to 100 000 g/mol), have degrees of hydrolysis of 98–99 or 87–89 mol % and thus also contain a residual content of acetyl groups. The polyvinyl alcohols are characterized on the part of the manufacturers by stating the degree of polymerization of the starting polymer, the degree of hydrolysis, the hydrolysis number and the solution viscosity.

Depending on the degree of hydrolysis, polyvinyl alcohols are soluble in water and less strongly polar organic solvents (formamide, dimethylformamide, dimethyl sulfoxide); they are not attacked by (chlorinated) hydrocarbons, esters, fats and oils. Polyvinyl alcohols are classified as being toxicologically acceptable and are at least partially biodegradable. The solubility in water can be reduced by after-treatment with aldehydes (acetalization); by complexation with Ni or Cu salts or by treatment with dichromates, boric acid or borax. The coatings made of polyvinyl alcohol are largely impenetrable to gases such as oxygen, nitrogen, helium, hydrogen, carbon dioxide, but allow water vapor to pass through.

For the purposes of the present invention, it is preferred that the enclosure comprises a polyvinyl alcohol whose degree of hydrolysis is 70 to 100 mol %, preferably 80 to 90 mol %, particularly preferably 81 to 89 mol % and in particular 82 to 88 mol %.

As materials for the enclosure, preference is given to using polyvinyl alcohols of a certain molecular weight range, it being preferred according to the invention for the enclosure to comprise a polyvinyl alcohol whose molecular weight is in the range from 10 000 to 100 000 $gmol^{-1}$, preferably from 11 000 to 90 000 $gmol^{-1}$, particularly preferably from 12 000 to 80 000 $gmol^{-1}$ and in particular from 13 000 to 70 000 $gmol^{-1}$.

The degree of polymerization of such preferred polyvinyl alcohols is between approximately 200 to approximately 2100, preferably between approximately 220 to approximately 1890, particularly preferably between approximately 240 to approximately 1680 and in particular between approximately 260 to approximately 1500.

The polyvinyl alcohols described above are commercially available widely, for example under the trade name Mowiol® (Clariant). Polyvinyl alcohols which are particularly suitable within the scope of the present invention are, for example, Mowiol® 3-83, Mowiol® 4-88, Mowiol® 5-88 and Mowiol® 8-88.

Further polyvinyl alcohols which are particularly suitable as material for the hollow bodies are given in the table below:

| Name | Degree of hydrolysis [%] | Molar mass [kDa] | Melting point [° C.] |
|---|---|---|---|
| Airvol ® 205 | 88 | 15–27 | 230 |
| Vinex ® 2019 | 88 | 15–27 | 170 |
| Vinex ® 2144 | 88 | 44–65 | 205 |
| Vinex ® 1025 | 99 | 15–27 | 170 |
| Vinex ® 2025 | 88 | 25–45 | 192 |
| Gohsefimer ® 5407 | 30–28 | 23 600 | 100 |
| Gohsefimer ® LL02 | 41–51 | 17 700 | 100 |

Further polyvinyl alcohols suitable as material for the hollow shape are ELVANOL® 51-05, 52-22, 50-42, 85-82, 75-15, T-25, T-66, 90-50 (trade name of Du Pont), ALCOTEX® 72.5, 78, B72, F80/40, F88/4, F88/26, F88/40, F88/47 (trade name of Harlow Chemical Co.), Gohsenol® NK-05, A-300, AH-22, C-500, GH-20, GL-03, GM-14L, KA-20, KA-500, KH-20, KP-06, N-300, NH-26, NM11Q, KZ-06 (trade name of Nippon Gohsei K.K.).

The solubility of PVAL in water can be changed by after-treatment with aldehydes (acetalization) or ketones (ketalization). Polyvinyl alcohols which have proven to be particularly preferred and particularly advantageous due to their outstandingly good solubility in cold water are those which are acetalized or ketalized with the aldehyde or keto groups, respectively, of saccharides or polysaccharides or mixtures thereof. It has proven especially advantageous to use the reaction products of PVAL and starch.

In addition, the solubility in water can be changed by complexation with Ni or Cu salts or by treatment with dichromates, boric acid, borax and thus be adjusted to desired values in a targeted manner. Films made of PVAL are largely impenetrable to gases such as oxygen, nitrogen, helium, hydrogen, carbon dioxide, but allow water vapor to pass through.

Examples of suitable water-soluble PVAL films are the PVAL films obtainable under the name "SOLUBLON®" from Syntana Handelsgesellschaft E. Harke GmbH & Co. Their solubility in water can be adjusted to a precise degree and films of this product series are available which are soluble in the aqueous phase in all temperature ranges relevant for the application.

Polyvinylpyrrolidones, shortened to PVPs, can be described by the following general formula:

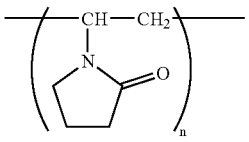

PVPs are prepared by free-radical polymerization of 1-vinylpyrrolidone. Standard commercial PVPs have molar masses in the range from about 2500 to 750 000 g/mol and are supplied as white, hygroscopic powders or as aqueous solutions.

Polyethylene oxides, shortened to PEOXs, are polyalkylene glycols of the general formula $$H—[O—CH_2—CH_2]_n—OH$$

which are prepared industrially by base-catalyzed polyaddition of ethylene oxide (oxirane) in systems comprising mostly small amounts of water with ethylene glycol as starter molecule. They have molar masses in the range from about 200 to 5 000 000 g/mol, corresponding to degrees of polymerization n of from about 5 to >100 000. Polyethylene oxides have an extremely low concentration of reactive hydroxy end groups and exhibit only weak glycol properties.

Gelatin is a polypeptide (molar mass: about 15 000 to >250 000 g/mol) which is obtained primarily by hydrolysis of the collagen present in animal skin and bones under acidic or alkaline conditions. The amino acid composition of the gelatin largely corresponds to that of the collagen from which it has been obtained and varies depending on its provenance, The use of gelatin as water-soluble shell material is extremely widespread in particular in pharmacy in the form of hard or soft gelatin capsules. Gelatin is not used widely in the form of films due to its high cost relative to the polymers specified above.

Within the scope of the present invention, preference is also given to dishwasher detergents whose packaging consists at least partially of water-soluble film of at least one polymer from the group consisting of starch and starch derivatives, cellulose and cellulose derivatives, in particular methylcellulose and mixtures thereof.

Starch is a homoglycan, where the glucose units are α-glycosidically joined. Starch is made up of two components of different molecular weight: from about 20 to 30% of straight-chain amylose (MW about 50 000 to 150 000) and 70 to 80% of branched-chain amylopectin (MW about 300 000 to 2 000 000), In addition, small amounts of lipids, phosphoric acid and cations are also present. Whereas the amylose forms long, helical, intertwined chains with about 300 to 1200 glucose molecules as a result of the bond in the 1,4 position, the chain in the case of amylopectin branches after on average 25 glucose building blocks by a 1,6 bond to a branch-like structure with about 1500 to 12 000 molecules of glucose. As well as pure starch, starch derivatives which are obtainable from starch by polymer-analogous reactions are also suitable for the preparation of water-soluble enclosures for the washing composition, rinse composition and cleaning composition portions within the scope of the present invention. Such chemically modified starches include, for example, compositions from esterifications or etherifications in which hydroxy hydrogen atoms have been substituted. However, starches in which the hydroxy groups have been replaced by functional groups which are not bonded via an oxygen atom can also be used as starch derivatives. The group of starch derivatives includes, for example, alkali metal starches, carboxymethylstarch (CMS), starch esters and starch ethers, and aminostarches.

Pure cellulose has the formal gross composition $(C_6H_{10}O_5)_n$ and, considered formally, is a β-1,4-polyacetal of cellobiose which, for its part, is constructed from two molecules of glucose. Suitable celluloses consist of about 500 to 5000 glucose units and, accordingly, have average molar masses of from 50 000 to 500 000. Cellulose-based disintegrants which can be used within the scope of the present invention are also cellulose derivatives which are obtainable from cellulose by polymer-analogous reactions. Such chemically modified celluloses include, for example, compositions of esterifications and etherifications in which hydroxyl hydrogen atoms have been substituted. However, celluloses in which the hydroxy groups have been replaced by functional groups not attached via an oxygen atom may also be used as cellulose derivatives. The group of cellulose derivatives includes, for example, alkali metal celluloses, carboxymethylcellulose (CMC), cellulose esters and ethers, and aminocelluloses.

Preferred enclosures of at least partially water-soluble film comprise at least one polymer with a molar mass between 5000 and 500 000 g/mol, preferably between 7500 and 250 000 g/mol and in particular between 10 000 and 100 000 g/mol. The enclosure has different material thicknesses depending on the production process, preference being given to dishwasher detergents according to the invention in which the wall thickness of the enclosure is 10 to 5000 μm, preferably 20 to 3000 μm, particularly preferably 25 to 2000 μm and in particular 100 to 1500 μm.

If film pouches are chosen as packaging, then the water-soluble film which forms the enclosure preferably has a thickness of from 1 to 300 μm, preferably from 2 to 200 μm, particularly preferably from 5 to 150 μm and in particular from 10 to 100 μm.

These water-soluble films can be produced by various production processes. In principle, blowing, calendering and casting processes should be mentioned. In a preferred process, the films are blown starting from a melt using air by means of a blowing mandrel to give a hose. In the calendering process, which is likewise a type of preferred production process, the raw materials plasticized by suitable additives are atomized to form the films. It may in particular be necessary here to follow the atomization with a drying step. In the casting process, which is likewise a type of preferred production process, an aqueous polymer preparation is placed onto a heatable drying roll, is optionally cooled following evaporation of the water and the film is removed in the form of a sheet. Where necessary, this sheet is additionally powdered before being removed or whilst being removed.

According to the invention, preference is given to an embodiment according to which the enclosure is water-soluble as a whole, i.e. dissolves completely when used in accordance with directions during machine washing if the conditions envisaged for dissolution are achieved; Particularly preferred completely water-soluble enclosures are e.g. capsules made of gelatin, advantageously made of soft gelatin, or pouches made of (optionally partially acetalized) PVAL or spheres of gelatin or (optionally partially acetalized) PVAL or of one or more organic and/or inorganic salts, preferably spheres of soft gelatin. An essential advantage of this embodiment is that the enclosure must at least partially dissolve within a practically relevant short time—as a non-limiting example a few seconds to 5 min—under exactly defined conditions in the cleaning liquor and thus, in accordance with the requirements, introduce the surrounded content, i.e. the cleaning-active material or two or more materials, into the liquor.

In another embodiment of the invention, which is likewise preferred on the basis of advantageous properties, the water-soluble enclosure includes sections which are less readily soluble or even insoluble in water or are soluble in water only at elevated temperature, and sections which are readily water-soluble or water-soluble at a low temperature. In other words, the enclosure consists not only of one uniform material having the same solubility in water in all areas, but of materials of differing solubility in water. In this connection, a distinction is to be made between areas of good solubility on the one hand and areas with less good solubility in water, with poor or even no solubility in water or areas in which the solubility in water achieves the desired value only at elevated temperature or only at a different pH or only at a changed electrolyte concentration. This may lead, when using the product in accordance with the directions under adjustable conditions, to certain areas of the enclosure dissolving, while other areas remain intact. An enclosure provided with pores or holes thus forms into which water and/or liquor can penetrate, dissolve washing-active, rinse-active or cleaning-active ingredients and flush them out of the enclosure. In the same way, enclosure systems in the form of multichamber pouches or in the form of hollow bodies arranged inside one another (e.g. spheres: "onion system") can also be provided. In this way, systems with controlled release of the washing-active, rinse-active or cleaning-active ingredients can be prepared.

For the formation of such systems, the invention is not subject to limitations. For example, enclosures can be provided in which a uniform polymer material includes small areas of incorporated compounds (for example of salts) which are more rapidly soluble in water than the polymer material. On the other hand, two or more polymer materials with different solubility in water can also be mixed (polymer blend), so that the polymer material which dissolves more quickly is more rapidly disintegrated under defined conditions by water or the liquor than the material which dissolves more slowly.

It corresponds to a particularly preferred embodiment of the invention that the areas of the enclosure which are less readily soluble in water or areas which are completely insoluble in water or areas which are soluble in water only at elevated temperature are areas made of a material which essentially corresponds chemically to that of the readily water-soluble areas or areas which are water-soluble at a lower temperature, but has a higher layer thickness and/or has a changed degree of polymerization of the same polymer and/or has a higher degree of crosslinking of the same polymer structure and/or has a higher degree of acetalization (in the case of PVAL, for example with saccharides, polysaccharides, such as starch) and/or has a content of water-insoluble salt components and/or has a content of a water-insoluble polymer. Even taking into consideration the fact that the enclosure does not dissolve completely, cleaning composition portions according to the invention can be prepared which have advantageous properties upon release of the dishwasher detergent into the particular liquor.

The water-soluble shell material is preferably transparent. For the purposes of this invention, transparency is understood as meaning that the transmittance within the visible spectrum of light (410 to 800 nm) is greater than 20%, preferably greater than 30%, most preferably greater than 40% and especially greater than 50%. Thus, as soon as a wavelength of the visible spectrum of light has a transmittance greater than 20%, it can be considered to be transparent within the scope of the invention.

Dishwasher detergents according to the invention which are packaged in transparent enclosures or containers may comprise a stabilizer as an essential constituent. For the purposes of the invention, stabilizers are materials which protect the detergent constituents in their water-soluble, transparent enclosures against decomposition or deactivation as a result of light irradiation. Antioxidants, UV absorbers and fluorescent dyes have proven particularly suitable.

For the purposes of the invention, particularly suitable stabilizers are the antioxidants. In order to prevent undesired changes to the formulations caused by light irradiation and thus free-radical decomposition, the formulations may comprise antioxidants, Antioxidants which may be used here are, for example, phenols, bisphenols and thiobisphenols substituted by sterically hindered groups. Further examples are propyl gallate, butylhydroxytoluene (BHT), butylhydroxyanisole (BHA), t-butylhydroquinone (TBHQ), tocopherol and the long-chain (C8–C22) esters of gallic acid, such as dodecyl gallate. Other classes of substance are aromatic amines, preferably secondary aromatic amines and substituted p-phenylenediamines, phosphorus compounds with trivalent phosphorus, such as phosphines, phosphites and phosphonites, citric acids and citric acid derivatives, such as isopropyl citrate, compounds containing enediol groups, so-called reductones, such as ascorbic acid and its derivatives, such as ascorbic acid palmitate, organosulfur compounds, such as the esters of 3,3'-thiodipropionic acid with $C_{1-18}$-alkanols, in particular $C_{10-18}$-alkanols, metal ion deactivators which are able to complex the autooxidation-catalyzing metal ions, such as, for example, copper, such as nitrilotriacetic acid and modifications thereof and admixtures. Antioxidants may be present in the formulations in amounts up to 35% by weight, preferably up to 25% by weight, particularly preferably from 0.01 to 20% by weight and in particular from 0.03 to 20% by weight.

A further class of stabilizers which can preferably be used are the UV absorbers. UV absorbers are able to improve the resistance of the formulation constituents to light. They are understood as meaning organic substances (light protection filters) which are able to absorb ultraviolet rays and emit the absorbed energy again in the form of long-wave radiation, e.g. heat. Compounds which have these desired properties are, for example, the compounds and derivatives of benzophenone with substituents in the 2 and/or 4 position which are effective as a result of radiation-free deactivation. Also suitable are, furthermore, substituted benzotriazoles, such as, for example, the water-soluble benzenesulfonic acid 3-(2H-benzotriazol-2-yl)-4-hydroxy-5-(methylpropyl) monosodium salt (Cibafast® H), acrylates which are substituted by phenyl in the 3 position (cinnamic acid derivatives), optionally by cyano groups in the 2 position, salicylates, organic Ni complexes and natural substances such as umbelliferone and endogenous urocanic acid. Biphenyl and, in particular, stilbene derivatives are of particular importance; these are available commercially as Tinosorb® FD or Tinosorb® FR ex Ciba. Examples of UV-B-absorbers are 3-benzylidenecamphor or 3-benzylidenenorcamphor and derivatives thereof, e.g. 3-(4-methylbenzylidene)camphor; 4-aminobenzoic acid derivatives, preferably 2-ethylhexyl 4-(dimethylamino)benzoate, 2-octyl 4-(dimethylamino)benzoate and amyl 4-(dimethylamino)benzoate; esters of cinnamic acid, preferably 2-ethylhexyl 4-methoxycinnamate, propyl 4-methoxycinnamate, isoamyl 4-methoxycinnamate, 2-ethylhexyl 2-cyano-3,3-phenylcinnamate (octocrylene); esters of salicylic acid, preferably 2-ethylhexyl salicylate, 4-isopropylbenzyl salicylate, homomenthyl salicylate; derivatives of benzophenone, preferably 2-hydroxy-4-methoxybenzophenone, 2-hydroxy-4-methoxy-4'-methylbenzophenone, 2,2'-dihydroxy-4-methoxybenzophenone; esters of benzalmalonic acid, preferably di-2-ethylhexyl 4-methoxybenzmalonate; triazine derivatives, such as, for example, 2,4,6-trianilino(p-carbo-2'-ethyl-1'-hexyloxy)-1,3,5-triazine and octyl triazone or dioctylbutamidotriazone (Uvasorb® HEB); propane-1,3-diones, such as, for example, 1-(4-tert-butylphenyl)-3-(4'-methoxyphenyl)propane-1,3-dione; ketotricyclo(5.2.1.0)decane derivatives. Also suitable are 2-phenylbenzimidazole-5-sulfonic acid and the alkali metal, alkaline earth metal, ammonium, alkylammonium, alkanolammonium and glucammonium salts thereof; sulfonic acid derivatives of benzophenones, preferably 2-hydroxy-4-methoxybenzophenone-5-sulfonic acid and its salts; sulfonic acid derivatives of 3-benzylidenecamphor, such as, for example, 4-(2-oxo-3-bornylidenemethyl)-benzenesulfonic acid and 2-methyl-5-(2-oxo-3-bornylidene)sulfonic acid and salts thereof.

Suitable typical UV-A filters are, in particular, derivatives of benzoylmethane, such as, for example, 1-(4'-tert-butylphenyl)-3-(4'-methoxyphenyl)propane-1,3-dione, 4-tert-butyl-4'-methoxydibenzoylmethane (Parsol 1789), 1-phenyl-3-(4'-isopropylphenyl)propane-1,3-dione, and enamine compounds. The UV-A and UV-B filters can of course also be used in mixtures. As well as said soluble substances, insoluble light protection pigments are also suitable for this purpose, namely finely dispersed, preferably nanoized, metal oxides or salts. Examples of suitable metal oxides are, in particular, zinc oxide and titanium dioxide and also oxides of iron, zirconium, silicon, manganese, aluminum and cerium, and mixtures thereof. Salts which may be used are silicates (talc), barium sulfate or zinc stearate. The oxides and salts are already used in the form of pigments for skin care and skin-protecting emulsions and decorative cosmetics. The particles should here have an average diameter of less than 100 nm, preferably between 5 and 50 nm and in particular between 15 and 30 nm. They may have a spherical shape, although it is also possible to use particles which have an ellipsoidal shape or a shape which deviates in some other way from the spherical form. The pigments may also be surface-treated, i.e. hydrophilicized or hydrophobicized. Typical examples are coated titanium dioxides, such as, for example, titanium dioxide T 805 (Degussa) or Eusolex® T2000 (Merck). Suitable hydrophobic coating agents here are primarily silicones and, particularly preferably, trialkoxyoctylsilanes or simethicones. Preference is given to using micronized zinc oxide.

UV absorbers may be present in the dishwasher detergents in amounts up to 5% by weight, preferably up to 3% by weight, particularly preferably from 0.01 to 2.0% by weight and in particular from 0.03 to 1% by weight.

A further class of stabilizers which can preferably be used are the fluorescent dyes. These include the 4,4'-diamino-2,2'-stilbenedisulfonic acids (flavone acids), 4,4'-distyrylbiphenyls, methylumbelliferones, coumarins, dihydroquinolinones, 1,3-diarylpyrazolines, naphthalimides, benzoxazole, benzisooxazole and benzimidazole systems, and pyrene derivatives substituted by heterocycles. Of particular importance in this connection are the sulfonic acid salts of diaminostilbene derivatives, and polymeric fluorescent substances, as disclosed in U.S. Pat. No. 5,082,578.

Fluorescent substances may be present in the formulations in amounts up to 5% by weight, preferably up to 1% by weight, particularly preferably from 0.01 to 0.5% by weight and in particular from 0.03 to 0.1% by weight.

In a preferred embodiment, the above-mentioned stabilizers are used in any desired mixtures. The stabilizers are used in amounts up to 40% by weight, preferably up to 30% by weight, particularly preferably from 0.01 to 20% by weight, in particular from 0.02 to 5% by weight.

EXAMPLES

1) Unsoiled glasses were washed in a continuously operated dishwasher using a standard commercial dishwasher detergent at a water hardness of 0–1° German hardness.

In the comparative example V1, for each wash cycle only 25 g of a standard commercial dishwasher detergent were dosed in, whereas in the example E1 according to the invention 440 mg of zinc gluconate were additionally dosed in (total dosing amount 25.44 g). The wash operation was repeated 50 times under the conditions described above. The overall appearance of the ware was assessed by reference to the evaluation scale given below. The results are given in the table below:

| | V1 | E1 |
|---|---|---|
| Lager glass | T 1–2 | T 0 |
| Long drink glass | T 3–4 | T 0 |

Evaluation scale:
T 0 = no clouding to T 4 = severe clouding

2) In a second experimental series, unsoiled glasses were washed in a continuously operated dishwasher using a standard commercial dishwasher detergent at a water hardness of 0–1° German hardness. In comparative example V1 for each wash cycle only 24.5 g of a standard commercial dishwasher detergent were dosed in, whereas in the example E1 according to the invention 250 mg of zinc acetate were dosed in with the 24.5 g of the standard commercial dishwasher detergent. The wash operation was repeated 50 times under the conditions described above. The overall appearance of the ware was assessed by reference to the evaluation scale given below.

The results are given in the table below:

| | V1 | E1 |
|---|---|---|
| Lager glass | T 1–2 | T 0 |
| Long drink glass | T 3–4 | T 0 |

Evaluation scale:
T 0 = no clouding to T 4 = severe clouding

Examples 1 and 2 show that the dishwasher detergent according to the invention has significantly better glass corrosion properties under the given conditions. The addition of zinc gluconate or zinc acetate suppresses clouding on the glasses.

As used herein, the article "a" means at least one or one or more, unless it is specifically defined to mean otherwise. All numerical quantities are understood to be modified by the word "about," unless specifically noted otherwise or unless an exact amount is needed to define the invention over the prior art.

What is claimed is:

1. A dishwasher detergent comprising a builder, one or more magnesium and/or zinc salt(s) of at least one monomeric and/or polymeric organic acid, excluding zinc ricinoleate, zinc abietate, and zinc oxalate, and 0.1 to 7% by weight of one or more copolymers of:

i) unsaturated carboxylic acids;

ii) monomers containing sulfonic acid groups; and iii) optionally further ionic or nonionogenic monomers.

2. The dishwasher detergent of claim 1, wherein the monomeric and/or polymeric organic acids are one or more selected from the group consisting of unbranched saturated or unsaturated monocarboxylic acids, branched saturated or unsaturated monocarboxylic acids, saturated and unsaturated dicarboxylic acids, aromatic mono-, di- and tricarboxylic acids, sugar acids, hydroxy acids, oxo acids, amino acids, and polymeric carboxylic acids.

3. The dishwasher detergent claim 1, comprising no magnesium or zinc salts of unbranched or branched, unsaturated or saturated, mono- or polyhydroxylated fatty acids having at least 8 carbon atoms and/or resin acids.

4. The dishwasher detergent of claim 2, wherein the uribranched saturated or unsaturated monocarboxylic acid(s) are selected from the group consisting of methanoic acid (formic acid), ethanoic acid (acetic acid), propanoic acid (propionic acid), pentanoic acid (valerie acid), hexanoic acid (caproic acid), heptanoic acid enanthic acid), octanoic acid (caprylic acid), nonanoic acid (pelargonic acid), decanoic acid (capric acid), undecanoic acid, dodecanoic acid (lauric acid), tridecanoic acid, tetradecanoic acid (myristic acid), pentadecanoic acid, hexadecanoic acid (palmitic acid), heptadecanoic acid (margaric acid), occadecanoic acid (stearic acid), eicosafloic acid (arachidic acid), docosanoic acid (behenic acid), tetracosaroic acid (lignoceric acid), hexacosanoic acid (cerotic acid), triacontanoic acid (melissic acid), 9c-hexadecenoic acid (palmitoleic acid), 6c-octadecenoic acid (pecroselie acid), 6t-octadecenoic acid (petroselaidic acid), 9c-octadecenoic acid (oleic acid), 9t-octadecenoic acid (elaidic acid), 9c,12c-octadecadienoic acid (linoleic acid), 9t,12t-octadecadienoic acid (linolaidic acid), 9c,12c15c-octadecatrienoic acid (linolenic acid), and mixtures thereof.

5. The dishwasher detergent of claim 2, wherein the branched saturated or unsaturated monocarboxylic acid(s) are selected from the group consisting of 2-methylpentanoic acid, 2-ethylhexanoic acid, 2-propylheptanoic acid, 2-butyloctanoic acid, 2-pentylnonanoic acid, 2-hexyldecanoic acid, 2-heptylundecafloic acid, 2-octryldodecanoic acid, 2-nonyltridecanoic acid, 2-decyltetradecanoic acid, 2-undecylpentadetanoic acid, 2-dodecylhexadecanoic acid, 2-tridecylheptadecanoic acid, 2tetradecyloctadecanoic acid, 2-pentadecylnonadecanoic acid, 2-hexadecyleicosanoic acid, 2-heptadecylheneicosanoic acid, and mixtures thereof.

6. The dishwasher detergent of claim 2, wherein the unbranched saturated or unsaturated di- or tricarboxylic acid(s) are selected from the group consisting of propanedioic acid (malonic acid), butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), 2c-butenedioic acid (maleic acid), 2t-butenedioic acid (fumaric acid), 2butynedicarboxylic acid (acetylenedicarboxylic acid), and mixtures thereof.

7. The dishwasher detergent of claim 2, wherein the aromatic mono-, di- and tricarboxylic acid(s) are selected from the group consisting of benzoic acid, 2-carboxybenzoic acid (phthalic acid), 3-carboxybenzoic acid (isophthalic acid), 4-carboxybenzoic acid (terephthalic acid), 3,4-dicarboxybenzoic acid (trimellitic acid), 3,5-dicarboxybenzoic acid (trimesionic acid), and mixtures thereof.

8. The dishwasher detergent of claim 2, wherein the sugar acid(s) is (are) selected from the group consisting of: gluconic acid, galactonic acid, mannonic acid, fructonic acid, arabinonic acid, xylonic acid, ribonic acid, 2deoxyribonic acid, alginic acid, and mixtures thereof.

9. The dishwasher detergent of claim 2, wherein the flyctroxy acid(s) are selected from the group consisting of hydroxyphenylacetic acid (inandelic acid), 2-hydroxypropionic acid (lactic acid), hydroxysuccinic acid (malic acid), 2,3-dihydroxybutanedioic acid (tartaric acid), 2-hydroxy-1, 2,3-propanetricarboxylic acid (citric acid), ascorbic acid, 2hydroxyberizoic acid (salicylic acid), 3,4,5-trihydroxybenzoic acid (gallic acid), and mixtures thereof.

10. The dishwasher detergent of claim 2, wherein the oxo acid(s) are selected from the group consisting of 2-oxopropionic acid (pyruvic acid), 4-oxopentanoic acid (levulinic acid), and mixtures thereof.

11. The dishwasher detergent of claim 2 wherein the amino acid(s) are selected from the group consisting of alanine, valine, leucine, isoleucine, proline, tryptophan, phenylalanine, methionine, glycine, serine, tyrosine, threonine, cysteine, asparagine, glutamine, aspartic acid, glutamic acid, lysine, arginine, histidine, and mixtures thereof.

12. The dishwasher detergent of claim 2, wherein the polymeric carboxylic acid(s) are selected from the group consisting of polyacrylac acid, polymethacrylic acid, alkylacrylamide/actylic acid copolymers, alkyl-acrylamide/methacrylic acid copolymers, alkylacryl-amide/methylmethacrylic acid copolymers, copolymers of unsaturated carboxylic acids, vinyl acetate/crotonic acid copolyrners, vinylpyrrolidone/vinyl acrylate copolymers, and mixtures thereof.

13. The dishwasher detergent of claim 1, wherein it comprises at least one zinc salt, but no magnesium salt of an organic acid.

14. The dishwasher detergent ot claim 1, wherein it comprises at least one zinc salt of an organic carboxylic acid.

15. The dishwasher detergent of claim 14, wherein Nt comprises, as zinc salt, zinc oleate, zinc stearate, zinc gluconate, zinc acetate, zinc lactate and/or zinc citrate.

16. The dishwasher detergent of claim 15, wherein it comprises the at least one zinc salt in amounts of from 0.1 to 5% by weight.

17. The dishwasher detergent of claim 16, wherein it comprises the at least one zinc salt in amounts of 0.2 to 4% by weight.

18. The dishwasher detergent of claim 17, wherein it comprises the at least one zinc salt in amounts of from 0.4 to 3% by weight.

19. The dishwasher detergent of claim 14, wherein it comprises zinc in oxidized form in amounts of from 0.01 to 1% by weight.

20. The dishwasher detergent of claim 14, wherein it comprises zinc in oxidized form in amounts of from 0.02 to 0.5% by weight.

21. The dishwasher detergent of claim 14, wherein it comprises zinc in oxidized form in amounts of from 0.04 to 0.2% by weight.

22. The dishwasher detergent of claim 1, wherein it comprises one or more surfactants in amounts of from 0.5 to 10% by weight.

23. The dishwasher detergent of claim 22, comprising one or more surfactants in amounts of from 0.75 to 7.5% by weight.

24. The dishwasher detergent of claim 23, comprising one or more surfactants in amounts of from 1.0 to 5% by weight.

25. The dishwasher detergent of claim 22, wherein it has a viscosity of from 500 to 500 000 mPas.

26. The dishwasher detergent of claim 25, wherein it has a viscosity of from 900 to 200 000 mPas.

27. The dishwasher detergent of claim 26, wherein it has a viscosity of from 1300 to 100 000 mPas.

28. The dishwasher detergent of claim 25, wherein it comprises a nonaqueous solvent.

29. The dishwasher detergent of claim 28, wherein the solvent(s) are selected from the group consisting of polyethylene glycols, polypropylene glycols, glycerol, glycerol carbonate, triacetin, ethylene glycol, propylene glycol, propylene carbonate, hexylene glycol, ethanol, n-propanol, isopropanol, and mixtures thereof.

30. The dishwasher detergent of claim 28, wherein it comprises the nonaqueous solvent in amounts of from 0.1 to 70% by weight.

31. The dishwasher detergent of claim 30, wherein it comprises the nonaqueous solvent in amounts of from 0.5 to 60% by weight.

32. The dishwasher detergent of claim 31, wherein it comprises the nonagueous solvent in amounts of from 1 to 50% by weight.

33. The dishwasher detergent of claim 32, wherein it comprises the nonaquecus solvent in amounts of from 2 to 40% by weight.

34. The dishwasher detergent of claim 33, wheren it comprises the nonaqueous solvent in amounts of from 2.5 to 30% by weight.

35. The dishwasher detergent of claim 1, wherein it comprises one or more substances selected from the group consisting of acidifying agents, chelating agents, and film-inhibiting polymers.

36. The dishwasher detergent of claim 1, wherein it comprises 1 to 25% by weight of a nonionic surfactant.

37. The dishwasher detergent of claim 36, wherein it comprises 2 to 22.5% by weight of a nonionic surfactant.

38. The dishwasher detergent of claim 37, wherein t comprises 3 to 20% by weight of a nonionic surfactant.

39. The dishwasher detergent of claim 38, wherein it comprises 4 to 17.5% by weight by weight of a nonionic surfactant.

40. The dishwasher detergent of claim 1, wherein the content of free water is less than 10% by weight.

41. The dishwasher detergent of claim 40, wherein the content of tree water is less than 8% by weight.

42. The dishwasher detergent of claim 41, wherein the content of free water is less than 6% by weight.

43. The dishwasher detergent of claim 1, comprising 20 to 60% by weight of one or more water-soluble builders.

44. The dishwasher detergent of claim 43, wherein the one or more watersoluble builders comprise cirrares and/or phosphates.

45. The dishwasher detergent of claim 43, wherein the one or more water-soluble builders comprise alkali metal phosphates.

46. The dishwasher detergent of claim 43, wherein the one or more water-soluble builders comprise pentasodium or pentapotassium triphosphate.

47. The dishwasher detergent of claim 43, wherein it comprises the water-soluble builder(s) in amounts of from 22.5 to 55% by weight.

48. The dishwasher detergent of claim 47, wherein it comprises the water-soluble builder(s) in amounts of from 25 to 50% by weight.

49. The dishwasher detergent of claim 48, wherein it comprises the water-soluble builder(s) in amounts of from 27.5 to 45% by weight.

50. The dishwasher detergent of claim 1, comprising 0.01 to 5% by weight of a polymeric thickener.

51. The dishwasher detergent of claim 50, comprising 0.02 to 4% by weight of the polymeric thickener.

52. The dishwasher detergent of claim 51, comprising 0.05 to 3% by weight of the polymeric thickener.

53. The dishwasher detergent of claim 52, comprising 0.1 to 1.5% by weight of the polymeric thickener.

54. The dishwasher detergent of claim 50, wherein the polymeric thickener is selected from the group consisting of polyurethanes, modified polyacrylates, and mixtures thereof.

55. The dishwasher detergent of claim 50, wherein the polymeric thickener comprises a compound of the formula IV:

IV

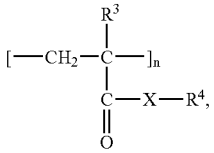

in which $R^3$ is H or a branched or unbranched $C_{1-4}$-alk(en)yl radicals X is or N—$R^5$ or O, $R^4$ is an optionally alkoxylated branched or unbranched, optionally substituted $C_{8-22}$-alk(en)yl radical, $R^5$ is H or $R^4$, and n is a natural number.

56. The dishwasher detergent of claim 1, wherein it comprises hydroxyethylcellulose and/or hydroxypropylcellulose.

57. The dishwasher detergent of claim 56, wherein it comprises the hydroxyethylcellulose and/or hydroxypropylcellulose in amounts of from 0.01 to 4.01 by weight.

58. The dishwasher detergent of claim 57, wherein it comprises the hydroxyethylcellulose and/or hydroxypropylcellulose in amounts of from 0.01 to 3.0% by weight.

59. The dishwasher detergent of claim 58, wherein it comprises the hydroxyethylcellulose and/or hydroxypropylcellulose in amounts of from 0.01 to 2.0% by weight.

60. The dishwasher detergent of claim 1, wherein the one or more magnesium and/or zinc salts are present in particulate form and in a form formulated with one or more further active and/or builder substances.

61. The dishwasher detergent of claim 60, wherein the particle size of the magnesium and/or zinc salts formulated with one or more active and/or builder substances is 0.1 to 10 mm.

62. The dishwasher detergent of claim 61, wherein the particle size of the magnesium and/or zinc salts formulated with one or more active and/or builder substances is 0.2 to 8 mm.

63. The dishwasher detergent at claim 62, wherein the particle size of the magnesium and/or zinc salts formulated with one or more active and/or builder substances is 0.5 to 5 mm.

64. The dishwasher detergent of claim 60, wherein the particles have a density of from 0.1 to 2.0 g/cm$^3$.

65. The dishwasher detergent of claim 64, wherein the particles nave a density of from 0.2 to 1.6 g/cm$^3$.

66. The dishwasher detergent of claim 65, wherein the particles have a density of from 0.4 to 1.2 g/cm$^3$.

67. The dishwasher detergent of claim 60, wherein the particles comprise me magnesium and/or zinc salts in an amount of from 0.1 to 80% by weight.

68. The dishwasher detergent of claim 67, wherein the particles comprise the magnesium and/or zinc salts in an amount of from 0.2 to 70% by weight.

69. The dishwasher detergent of claim 68, wherein the particles comprise the magnesium and/or zinc salts in an amount of from 0.5 to 60% by weight.

70. The dishwasher detergent of claim 60, wherein the one or more active and/or builder substances comprise active and/or builder substances selected from the group consisting of phosphates, carbonates, hydrogencarbonates, sulfates, silicates, citrates, citric acid, and acetates.

71. The dishwasher detergent of claim 70, wherein the particles comprise the one or more active and/or builder substances in amounts of from 20 to 99% by weight.

72. The dishwasher detergent of claim 71, wherein the particles comprise the one or more active and/or builder substances in amounts of from 30 to 98% by weight.

73. The dishwasher detergent of claim 72, wherein the particles comprise the one or more active and/or builder substances in amounts of from 40 to 95% by weight.

74. The dishwasher detergent of claim 60, wherein the one or more active and/or builder substances comprise surfactants and/or polymeric polycarboxylates.

75. The dishwasher detergent of claim 74, wherein the surfactants and/or polymeric polycarboxylates comprise nonionic surfactants and/or polysulfocarboxylates.

76. The dishwasher detergent of claim 60, wherein the particles have a coating.

77. The dishwasher detergent of claim 1, wherein it is packaged as a portion in a water-soluble enclosure.

78. The dishwasher detergent of claim 77, wherein the watersoluble enclosure comprises a sachet made of water-soluble film and/or an injection-molded part and/or a blow-molded part and/or a deep-drawn part.

79. The dishwasher detergent of claim 77, wherein the enclosure has a wall thickness of 10 to 5000 μm.

80. The dishwasher detergent of claim 79, wherein the enclosure has a wall thickness of 20 to 3000 μm.

81. The dishwasher detergent of claim 80, wherein the enclosure has a wall thickness of 25 to 2000 μm.

82. The dishwasher detergent of claim 81, wherein the enclosure has a wall thickness of 1.00 to 1500 μm.

83. The dishwasher detergent of claim 77, wherein the enclosure comprises a film sachet wherein the film which forms the enclosure has a thickness of from 1 to 300 μm.

84. The dishwasher detergent of claim 83, wherein the enclosure comprises a film sachet wherein the film which forms the enclosure has a thickness of from 2 to 200 μm.

85. The dishwasher detergent of claim 84, wherein the enclosure comprises a film sachet wherein the film which forms the enclosure has a thickness of from 5 to 150 μm.

86. The dishwasher detergent of claim 85, wherein the enclosure comprises a film sachet wherein the film which forms the enclosure has a thickness of from 10 to 100 μm.

87. The dishwasher detergent of claim 77, wherein the enclosure comprises one or more materials selected from the group consisting of acrylic acid-containing polymers, polyacrylamides, oxazoline polymers, polystyrene sultonates, polyurethanes, polyesters, polyethers, and mixtures thereof.

88. The dishwasher detergent of. claim 77, wherein the enclosure comprises one or more water-soluble polymers selected from the group consisting of (optionally acetalated) polyvinyl alcohol (PVAL), polyvinylpyrrolidone, polyethylene oxide, gelatin, cellulose, derivatives thereof, and mixtures thereof.

89. The dishwasher detergent of claim 77, wherein the enclosure comprises a polyvinyl alcohol having a degree of hydrolysis 70 to 100 mol %.

90. The dishwasher detergent of claim 89, wherein the enclosure comprises a polyvinyl alcohol having a degree of hydrolysis 80 to 90 mol %.

91. The dishwasher detergent of claim 90, wherein the enclosure comprises a polyvinyl alcohol having a degree of hydrolysis 81 to 89 mol %.

92. The dishwasher detergent of claim 91, wherein the enclosure comprises a polyvinyl alcohol having a degree of hydrolysis 82 to 88 mol %.

93. The dtshwasher detergent of claim 77, wherein the enclostare comprises a polyvinyl alcohol whose molecular weight is 10,000 to 100,000 $gmol^{-1}$.

94. The dishwasher detergent of claim 93, wherein the enclosure comprises a polyvinyl alcohol whose molecular weight is 11,000 to 90,000 $gmol^{-1}$.

95. The dishwasher detergent of claim 94, wherein the enclosure comprises a polyvinyl alcohol whose molecular weight is 12,000 to 80,000 $gmol^{-1}$.

96. The dishwasher detergent of claim 95, wherein the enclosure comprises a polyvinyl alcohol whose molecular weight is 13,000 to 70,000 $gmol^{-1}$.

97. A method of inhibiting glass corrosion by treatment with one or more salts of magnesium and/or zinc with organic acids, excluding formic acid, acetic actd, gluconic acid, and oxalic acid, in combination with one or more copolymers of:

i) unsturated carboxylic acids;

ii) monomers containing sulfonic acid groups; and iii) optionally further ionic or nonionogenic monomers.

* * * * *